US006598567B2

(12) United States Patent
Schmied

(10) Patent No.: US 6,598,567 B2
(45) Date of Patent: Jul. 29, 2003

(54) RECIPROCATING INTERNAL COMBUSTION ENGINE

(76) Inventor: Walter Schmied, Rte. 1, Box 459, Bonners Ferry, ID (US) 83805

( * ) Notice: Subject to any disclaimer, the term of this patent is extended or adjusted under 35 U.S.C. 154(b) by 0 days.

(21) Appl. No.: 10/147,372

(22) Filed: May 15, 2002

(65) Prior Publication Data

US 2002/0166521 A1 Nov. 14, 2002

Related U.S. Application Data

(63) Continuation-in-part of application No. 10/136,780, filed on May 1, 2002, which is a continuation-in-part of application No. 09/819,938, filed on Mar. 27, 2001, which is a continuation of application No. 09/520,265, filed on Mar. 7, 2000, now abandoned, which is a continuation of application No. 08/926,088, filed on Sep. 2, 1997, now Pat. No. 6,032,622.

(51) Int. Cl.[7] ..... F02B 59/00

(52) U.S. Cl. ..... 123/42; 123/48 R; 123/78 B

(58) Field of Search ..... 123/42, 78 R, 123/78 A, 78 AA, 78 B, 78 BA, 48 R, 48 A, 48 AA, 48 B

(56) References Cited

U.S. PATENT DOCUMENTS

| | | | | |
|---|---|---|---|---|
| 1,019,856 A | | 3/1912 | Strickland | |
| 2,455,245 A | * | 11/1948 | Franxis | 123/42 |
| 3,931,809 A | | 1/1976 | Corte et al. | |
| 4,058,088 A | | 11/1977 | Brown | |
| 4,838,214 A | | 6/1989 | Barrett | |
| 5,103,775 A | | 4/1992 | Hue | |
| 5,456,219 A | | 10/1995 | Clarke | |
| 5,526,778 A | * | 6/1996 | Springer | 123/42 |
| 5,647,307 A | | 7/1997 | Clarke et al. | |
| 6,032,622 A | | 3/2000 | Schmied | |
| 6,314,923 B1 | * | 11/2001 | Tompkins | 123/42 |

* cited by examiner

*Primary Examiner*—Marguerite McMahon
(74) *Attorney, Agent, or Firm*—Christensen O'Connor; Johnson Kindness PLLC

(57) ABSTRACT

An internal combustion engine (1010) having an adjustable compression ratio is disclosed. The engine includes a housing (1013), a piston assembly (1012) adjustably coupled to the housing, and a cylinder(1014) reciprocatingly disposed within the housing. The cylinder reciprocates relative to the piston assembly during operation of the engine. The engine further includes a compression ratio adjustment mechanism (1300) in communication with the piston assembly. The compression ratio adjustment mechanism is adaptable to adjust the compression ratio of the engine during operation. In another aspect of the present invention, the engine includes an exhaust valve (1052) in fluid communication with the cylinder and a crankshaft (1016) coupled to the cylinder, wherein the crankshaft includes a lobe (1054) for actuating the exhaust valve.

72 Claims, 42 Drawing Sheets

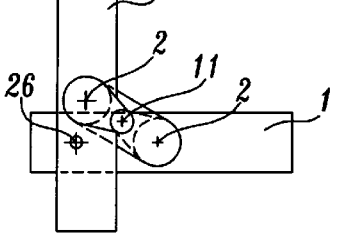
Fig. 16A.
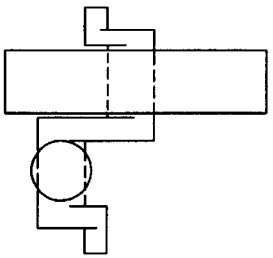
Fig. 16B.
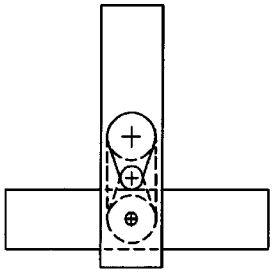
Fig. 16C.
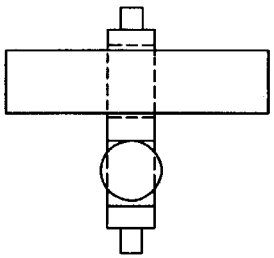
Fig. 16D.
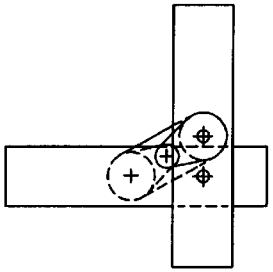
Fig. 16E.
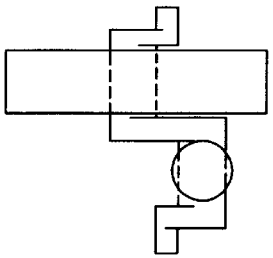
Fig. 16F.
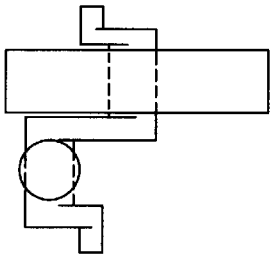
Fig. 16G.
Fig. 16H.

RECIPROCATING INTERNAL COMBUSTION ENGINE

CROSS-REFERENCES TO RELATED APPLICATIONS

This application is a continuation in part of U.S. patent application Ser. No. 10/136,780, filed May 1, 2002, which is a continuation in part of U.S. patent application Ser. No. 09/819,938, filed Mar. 27, 2001, which is a continuation of related U.S. patent application Ser. No. 09/520,265, filed Mar. 7, 2000, now abandoned which is a continuation of U.S. patent application Ser. No. 08/926,088, filed Sep. 2, 1997, now U.S. Pat. No. 6,032,622, issued Mar. 7, 2000, priority from the filing date of which is hereby claimed under 35 U.S.C. §120 and the disclosures of which are hereby expressly incorporated by reference.

FIELD OF THE INVENTION

The present invention is directed generally to internal combustion engines and, more particularly, to reciprocating internal combustion engines having substantially stationary pistons.

BACKGROUND OF THE INVENTION

As is well known in the art, an internal combustion engine is a machine for converting heat energy into mechanical work. In an internal combustion engine, a fuel-air mixture that has been introduced into a combustion chamber is compressed as a piston slides within the chamber. A high voltage for ignition is applied to a spark plug installed in the combustion chamber to generate an electric spark to ignite the fuel-air mixture. The resulting combustion pushes the piston downwardly within the chamber, thereby producing a force that is convertible to a rotary output.

Such internal combustion engines have a variety of problems. First, because of the multitude of moving parts, such engines are costly to assemble. Further, because of the moving parts, such engines are subjected to a shortened useful life due to frictional wear between the moving parts. Finally, because of the multiple parts, such engines are heavy.

Thus, there exists a need for an internal combustion engine that not only produces a high power-to-weight ratio, but is also economical to manufacture, has a high degree of reliability, and has fewer moving parts than the reciprocating engines currently available.

SUMMARY OF THE INVENTION

An internal combustion engine having an adjustable compression ratio is disclosed. The engine includes a housing, a first piston assembly adjustably coupled to the housing, and a first cylinder reciprocatingly disposed within the housing. The first cylinder reciprocates relative to the first piston assembly during operation of the engine. The engine further includes a compression ratio adjustment mechanism in communication with the first piston assembly. The compression ratio adjustment mechanism is adaptable to adjust the compression ratio of the engine during operation. In accordance with a further aspect of the invention, the compression ratio adjustment mechanism also controls the power setting of the engine.

In another aspect of the present invention, the engine includes an exhaust valve in fluid communication with the first cylinder and a crankshaft coupled to the first cylinder, wherein the crankshaft includes a lobe for actuating the exhaust valve between an open position and a closed position.

In accordance with further aspects of the present invention, the engine includes a first intake port located in the first cylinder where the port is operable to deliver a gas into the first cylinder. The compression ratio adjustment mechanism is adaptable to adjust the first piston assembly to position the first piston assembly to selectively impede passage of the gas through the first intake port.

In accordance with still further aspects of the present invention, the internal combustion engine further includes a second piston assembly coupled to the housing so as to oppose the first piston assembly and a second cylinder coupled to the first cylinder. The first and second cylinders reciprocate relative to the first and second piston assemblies during operation of the internal combustion engine.

In accordance with yet still further aspects of the present invention, the internal combustion engine further includes a third piston assembly coupled to the housing so as to oppose a fourth piston assembly coupled to the housing and a third cylinder coupled to a fourth cylinder. The third and fourth cylinders reciprocate relative to the third and fourth piston assemblies during operation of the internal combustion engine and reciprocate substantially orthogonally relative to the first and second cylinders.

In accordance with still other aspects of the present invention, the internal combustion engine further includes an intake chamber and a gas compression apparatus. The gas compression apparatus is coupled to the first cylinder, wherein when the first cylinder reciprocates in a first direction, the gas compression apparatus passes through the intake chamber, thereby compressing a gas contained therewithin. In accordance with still yet other aspects of the present invention, the gas compressed by the gas compression apparatus is released through an intake port into the first cylinder.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 16 illustrates the cylinder motion for an internal combustion engine formed in accordance with the present invention;

DETAILED DESCRIPTION OF THE PREFERRED EMBODIMENT

An internal combustion cylinder engine formed in accordance with the present invention suitably operates on the two cycle principle. The engine of the present invention is distinguished from those currently available through the use of one double cylinder 1 for each double cylinder housing 9. Through the center of the double cylinder 1 is cylinder journal pin 2. The cylinder journal pin 2 is suitably disposed therein on bearings (roller or other) 10. The cylinder journal pin 2 is turnable. A connecting rod does not exist.

Figure 11:
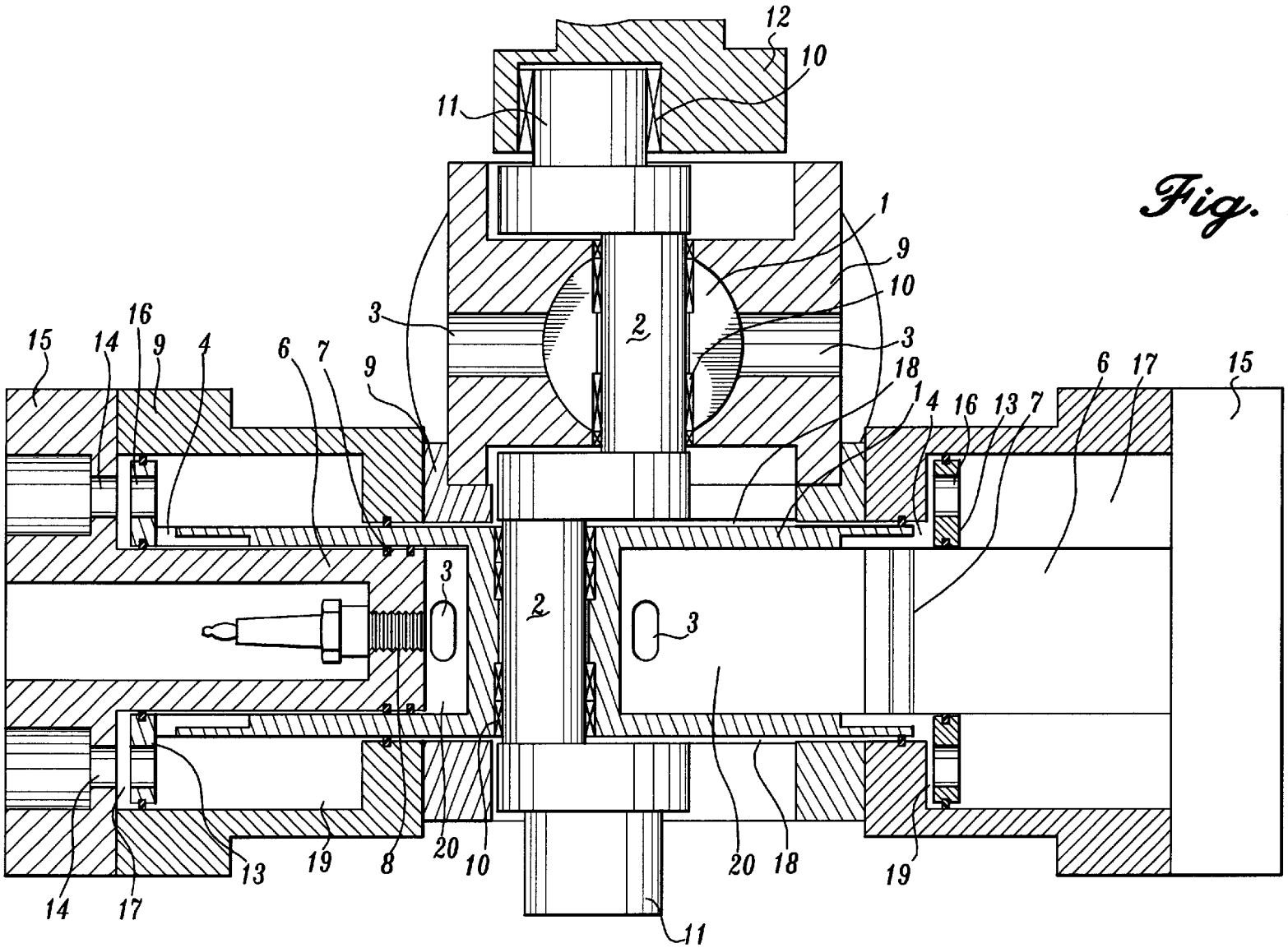
FIG. 11 is a cross-sectional view of an internal combustion engine formed in accordance with the present invention showing the major components of the engine.

Exhaust 3 and intake ports 4 are located on the opposite ends of the cylinder bore. As seen in FIG. 11, the exhaust and intake ports 3 and 4 are vertically spaced. This is different to the diametrical opposed intake and exhaust ports of known two cycle engines.

The intake ports 4 can be placed around the whole circumference of the cylinder. The exhaust ports 3 may be located on both sides of the diameter of the cylinder.

Figure 5:
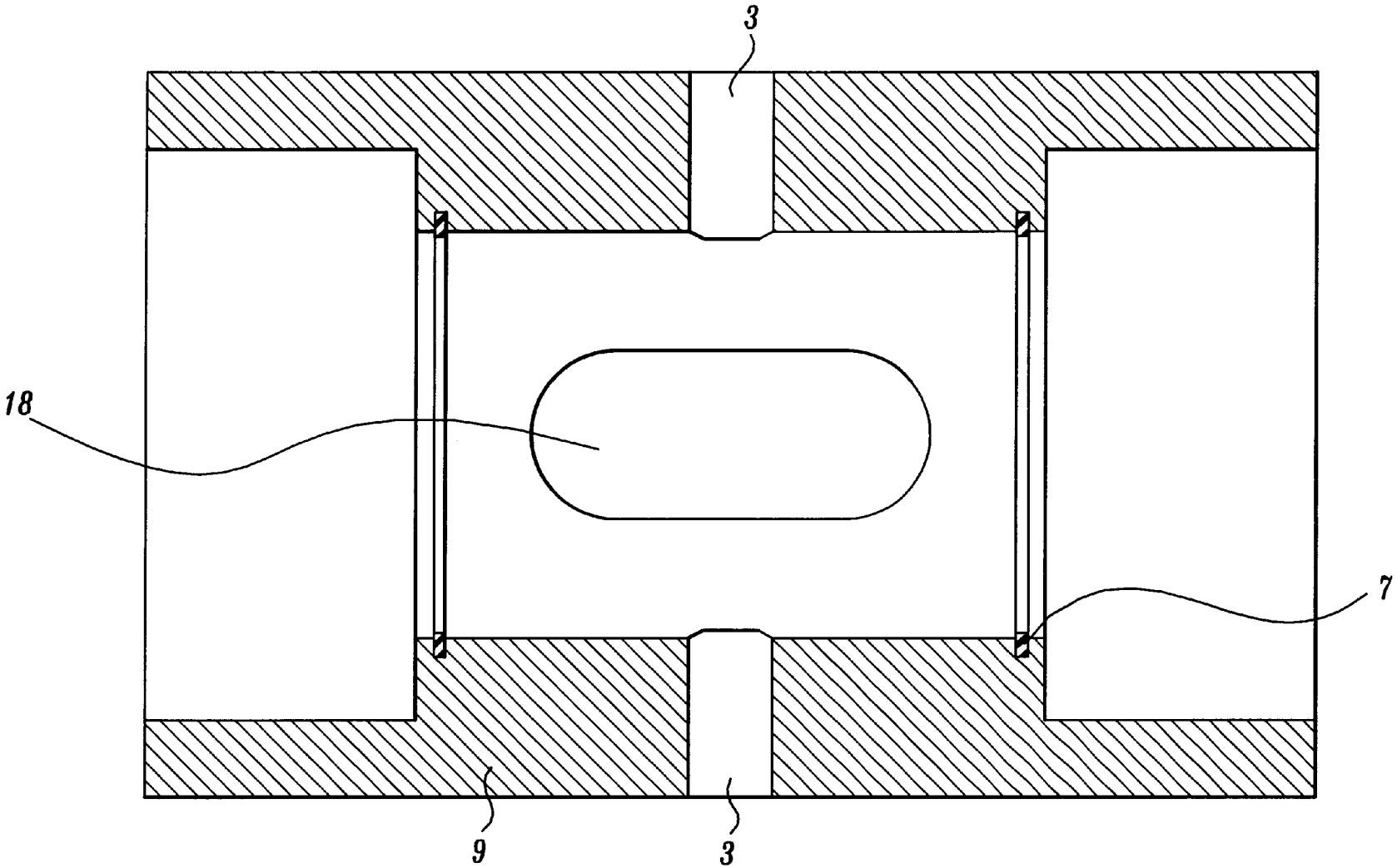
FIG. 5 is a cross-sectional view of an internal combustion engine formed in accordance with the present invention showing the cylinder journal pin slots, exhaust ports, housing and cylinder rings.
Figure 8C:
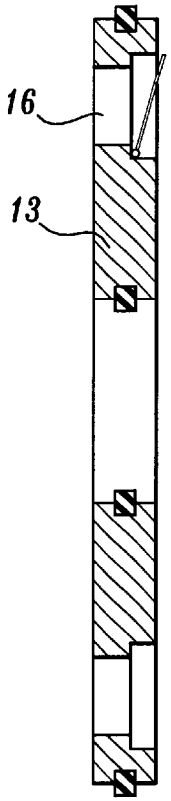
FIG. 8C is a cross-sectional end view of a precompression plate for an internal combustion engine formed in accordance with the present invention.
Figure 8B:
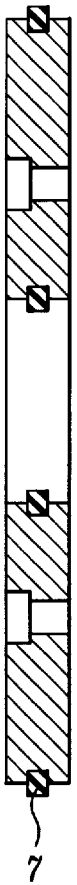
FIG. 8B is a cross-sectional end view of a precompression plate for an internal combustion engine formed in accordance with the present invention.
Figure 8A:
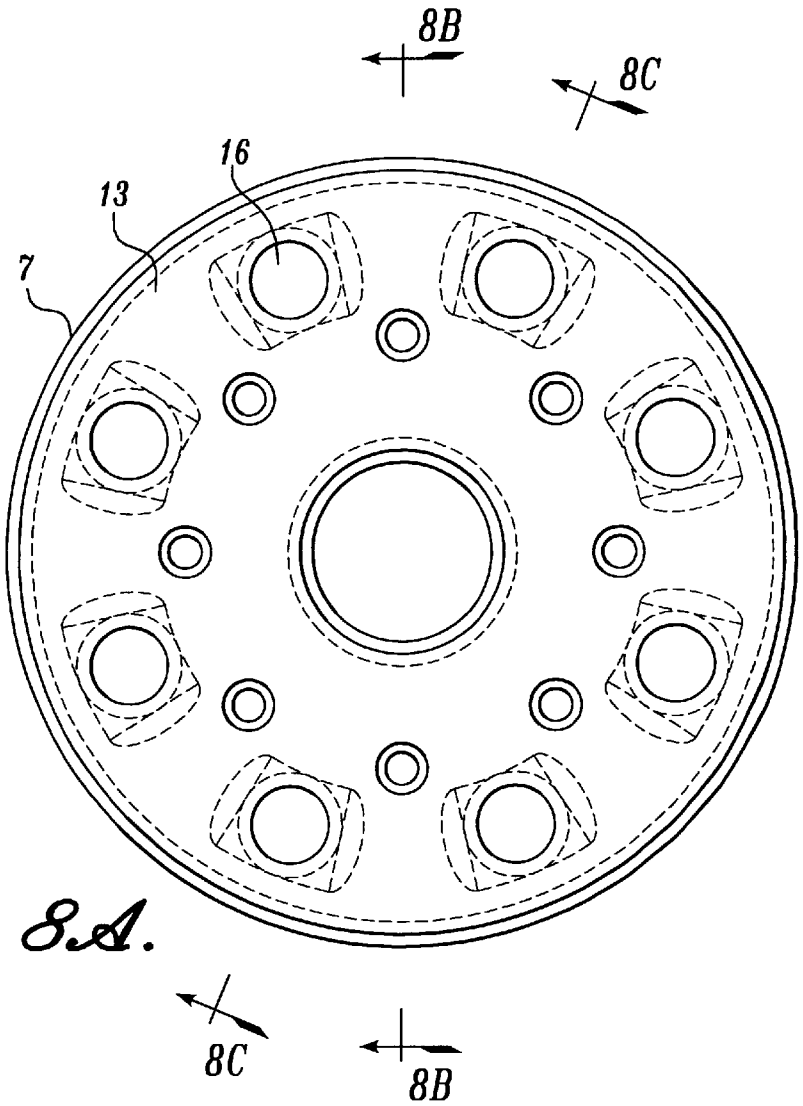
FIG. 8A is a top view of a precompression plate for an internal combustion engine formed in accordance with the present invention.
Figure 9:
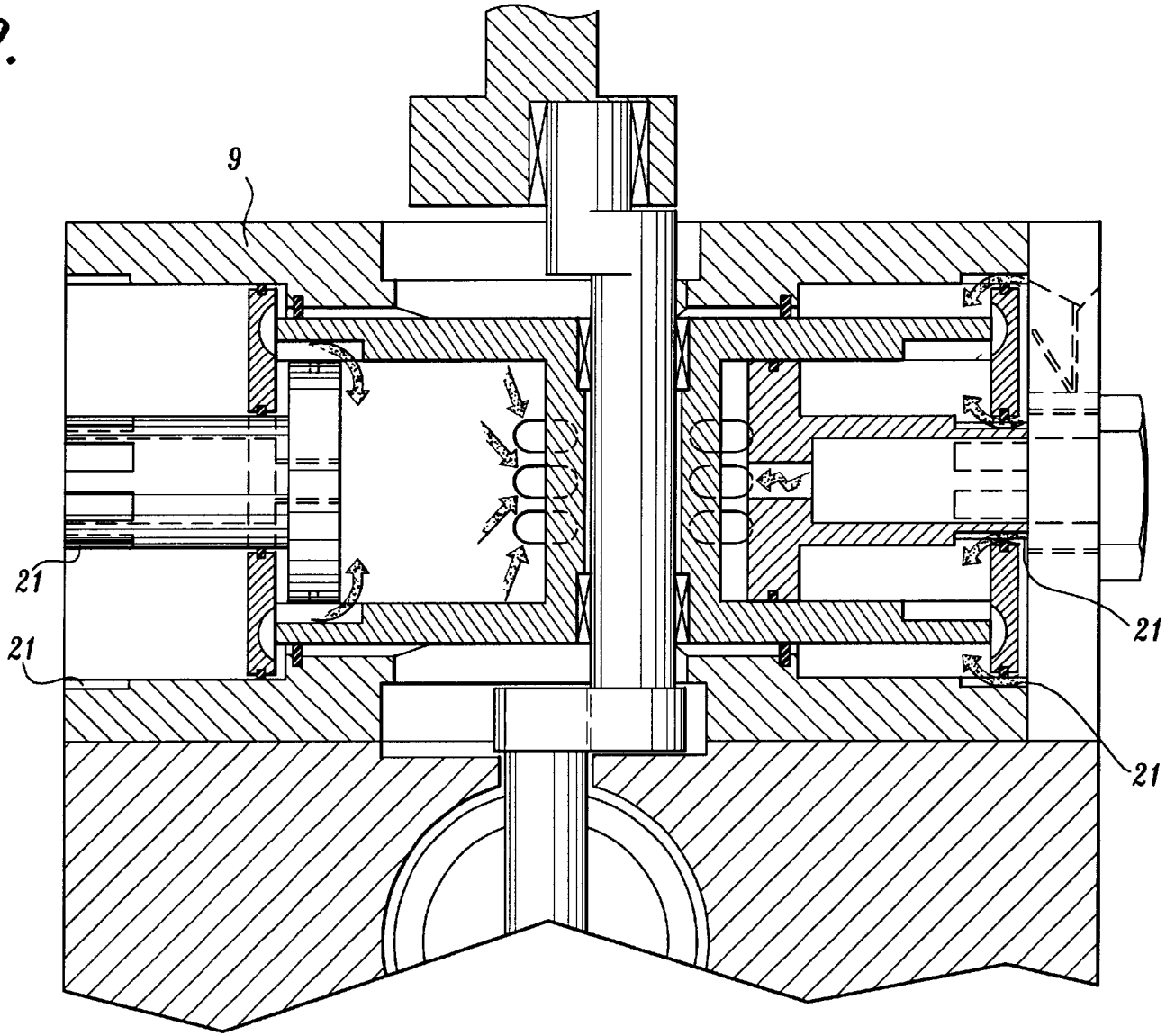
FIG. 9 is a cross-sectional side view of an internal combustion engine formed in accordance with the present invention showing the entrance of a fuel-air mixture into the combustion chamber and exhaustion of exhaust gases through the exhaust ports.
Figure 10:
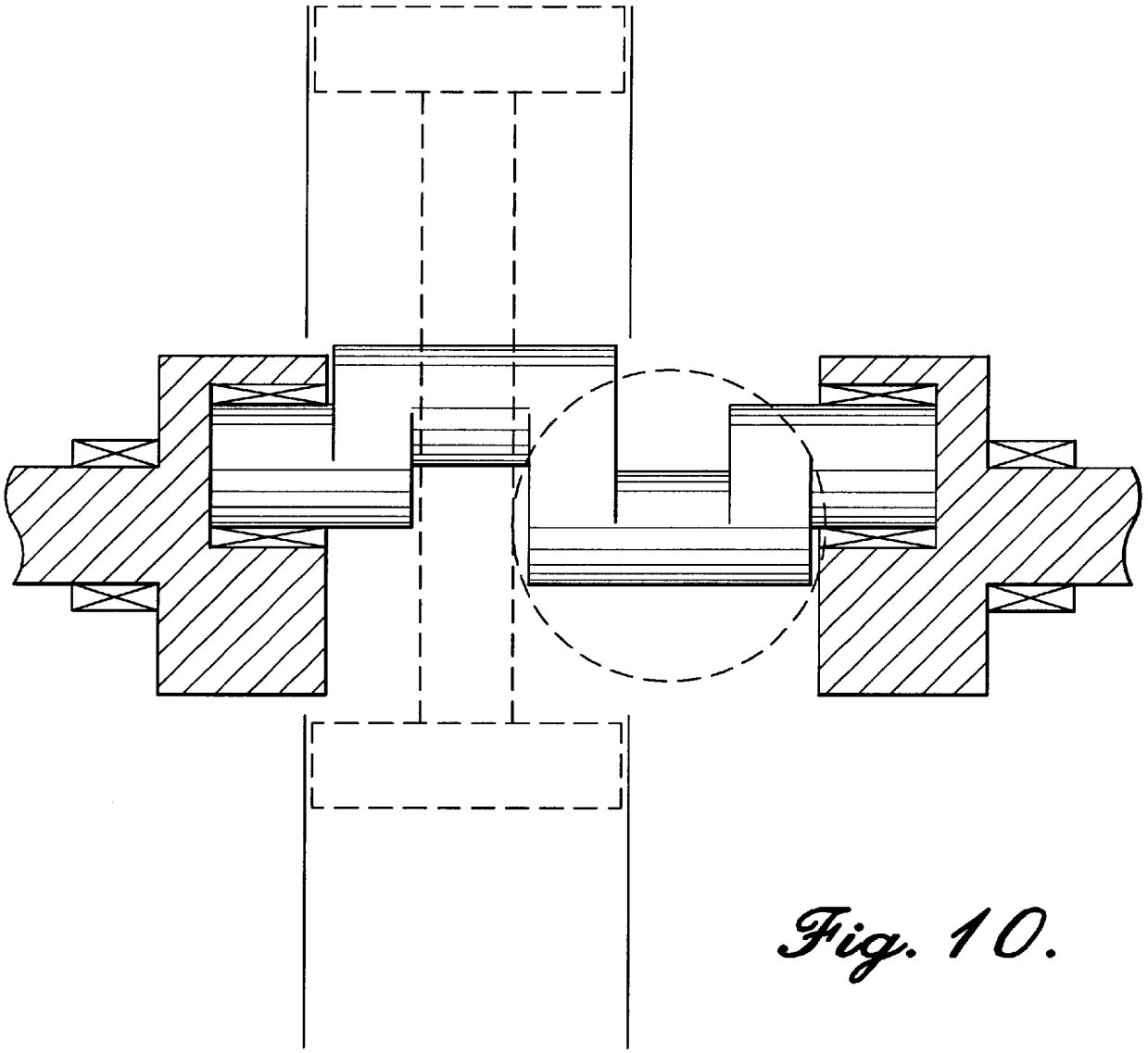
FIG. 10 is a cross-sectional side view of an internal combustion engine formed in accordance with the present invention showing a power take off shaft attached to the ends of the reciprocating and rotating mechanism.

Referring to FIGS. 5 and 8 exhaust ports 3 are located on both sides of the cylinder housing 9. The exhaust ports are centrally located and are alternately shared with the exhaust ports 3 of both the double cylinders when the cylinders are in the bottom dead end position.

The engine also includes pistons 6. The pistons 6 are stationary and are not a moving part of the engine. The pistons 6 can be adjusted for different compression ratios.

The pistons 6 contain a spark plug or injector hole 8 and piston rings 7. The injection hole 8 is suitable for an alternate embodiment of the engine, such as a diesel engine.

Figure 6:
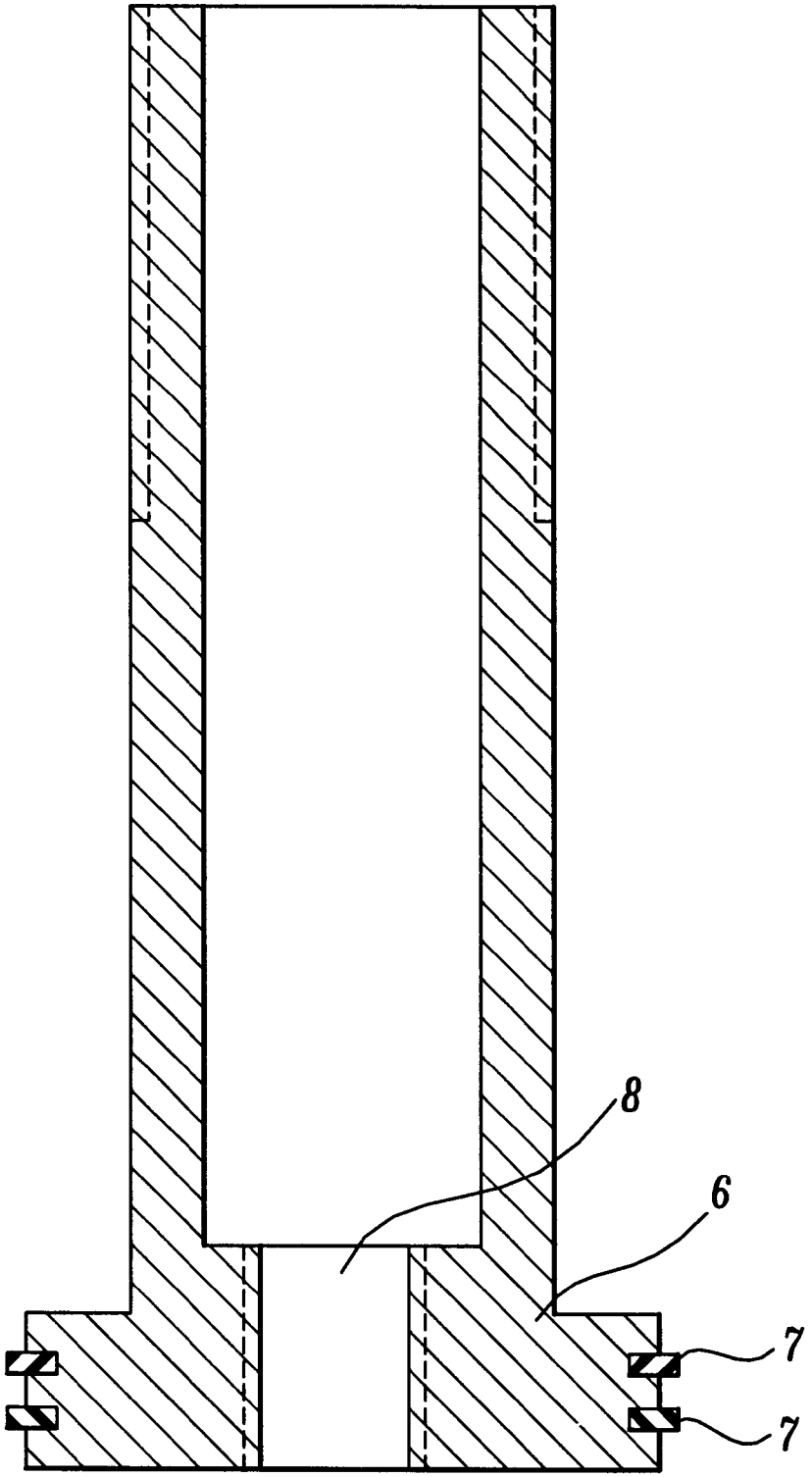
FIG. 6 is a cross-sectional view of a piston for an internal combustion engine formed in accordance with the present invention showing the piston rings and the spark plug or injector hole.
Figure 7:
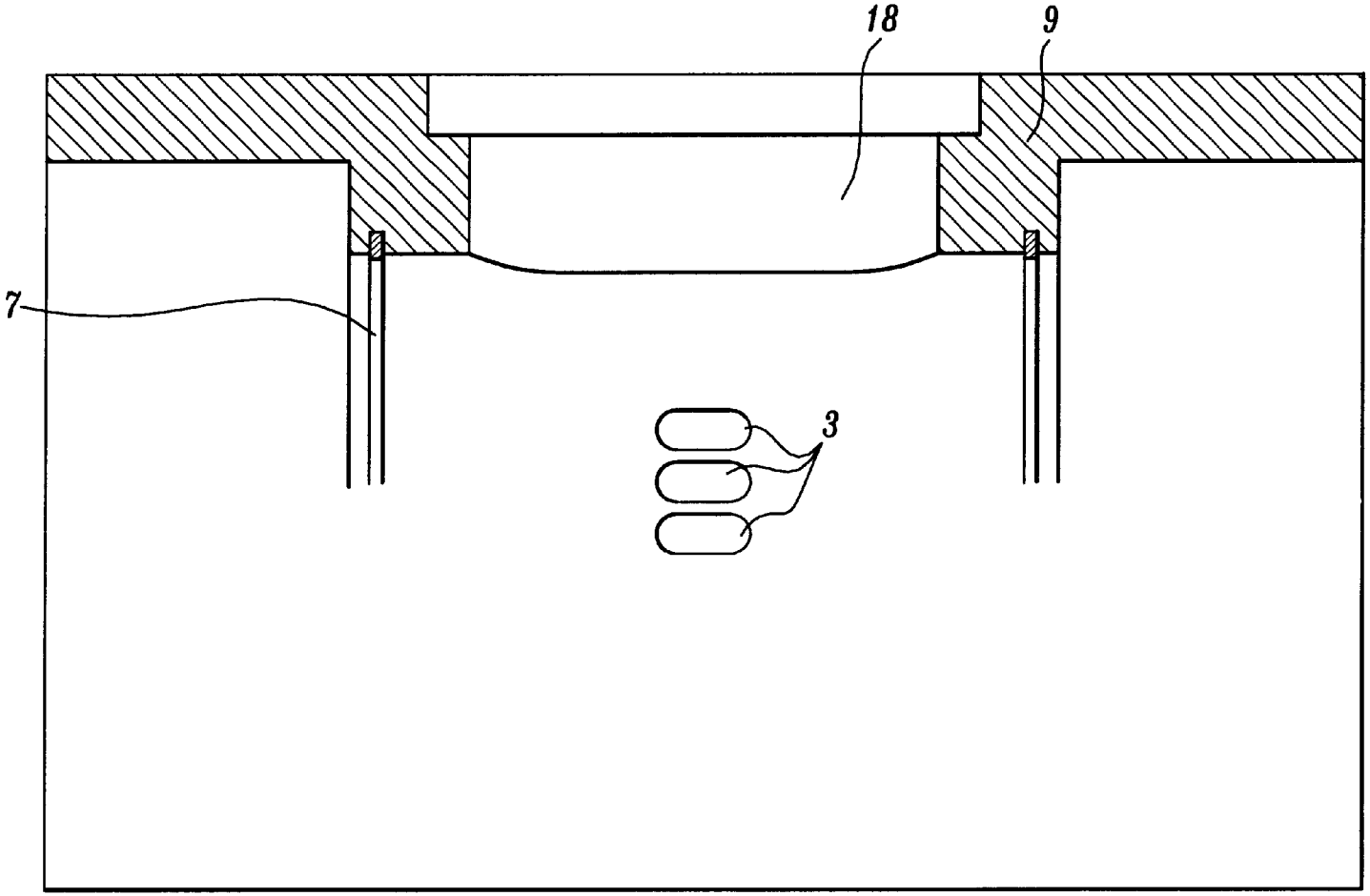
FIG. 7 is a cross-sectional view of an internal combustion engine formed in accordance with the present invention showing the housing, exhaust ports and the cylinder rings.

Referring now to FIG. 6, an end of the pistons 6 includes at least one piston ring 7. The diameter of this end of the piston 6 is substantially equal to the diameter of the cylinder. The rest of its length can favorably have a smaller diameter. The center of the pistons 6 are partly hollow to give access to the spark plug or injector hole 8.

The open end of the double cylinders 8 includes an annular precompression plate 13 attached thereto. The precompression plate 13 and the piston rings 7 engage the walls of the cylinders to define a seal therebetween. Each precompression plate 13 is fastened together to its cylinder and glides over the piston 6 between top dead center and bottom dead center.

The precompression plates 13 are mainly responsible for the different steps of the intake cycle.

Referring now to FIG. 11, the double cylinder housing 9 includes an intake chamber 17. The intake chamber 17 is closed off by a cylinder housing plate 15. The cylinder housing plate 15 holds a primary reed valve assembly 14 and the piston 6.

Each double cylinder housing 9 has a slot 18 located on each side of the cylinder. Each slot 18 is in the center along the line of the cylinder bore. The slots 18 are fashioned in a way, such that the cylinder journal pins 2, extending through the double cylinder housing 9, glide freely throughout its stroke length.

Figure 1B:
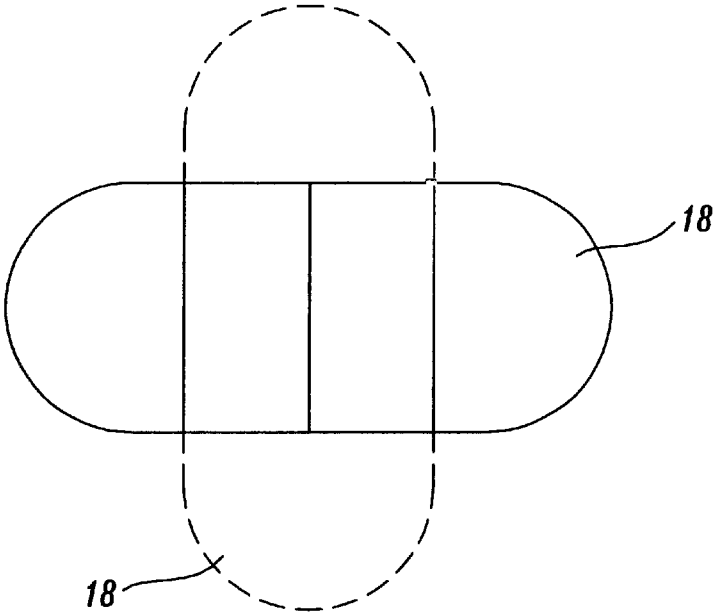
FIG. 1B illustrates the motion and common center point of an internal combustion engine formed in accordance with the present invention.
Figure 1A:
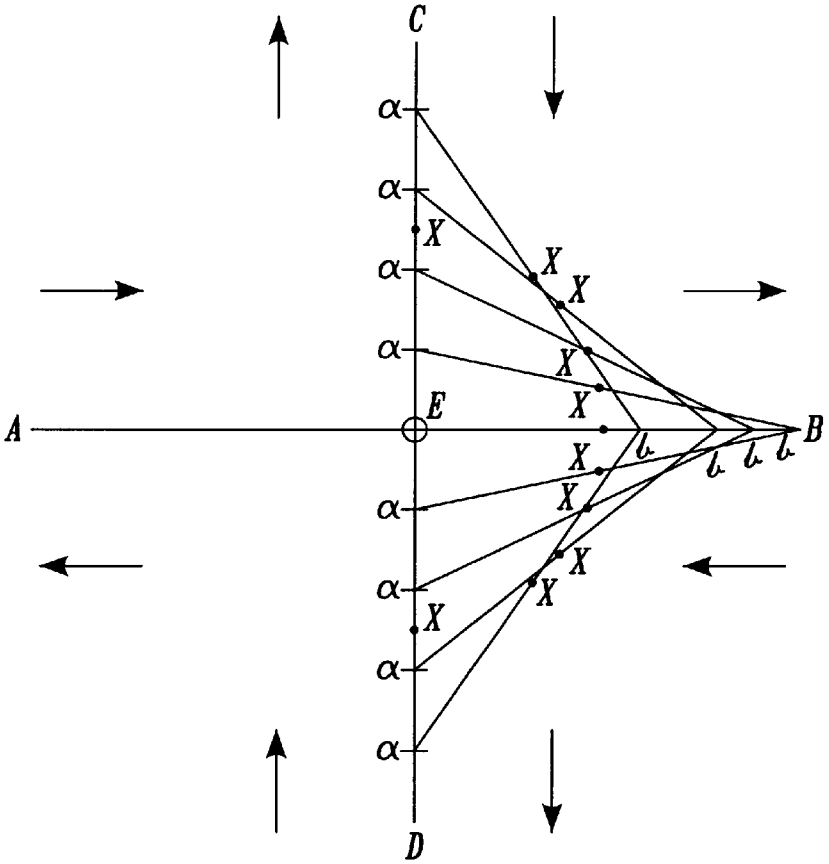
FIG. 1A is a diagrammatic view showing the linear and rotary displacement of an internal combustion engine formed in accordance with the present invention.

Still referring to FIG. 11, two double cylinder housings 9 are connected together at a ninety degree angle. The pair of double cylinder housings 9 are positioned such that the slots 18 face each other in the same angle and have the same centerpoint, as seen in FIG. 1.

Referring back to FIGS. 11 and 12, the two cylinder journal pins 2 are eccentrically connected to each other in a crankshaft type way, such that their centerlines are one-half stroke distance apart. On both ends of the cylinder journal pin 2 is a power takeoff shaft 12 connected to the pin 2 by a power takeoff ("PTO") journal 11. The center of the PTO journal 11 is located on a line located halfway between the centerlines of the connected cylinder journal pin 2.

Figure 2:
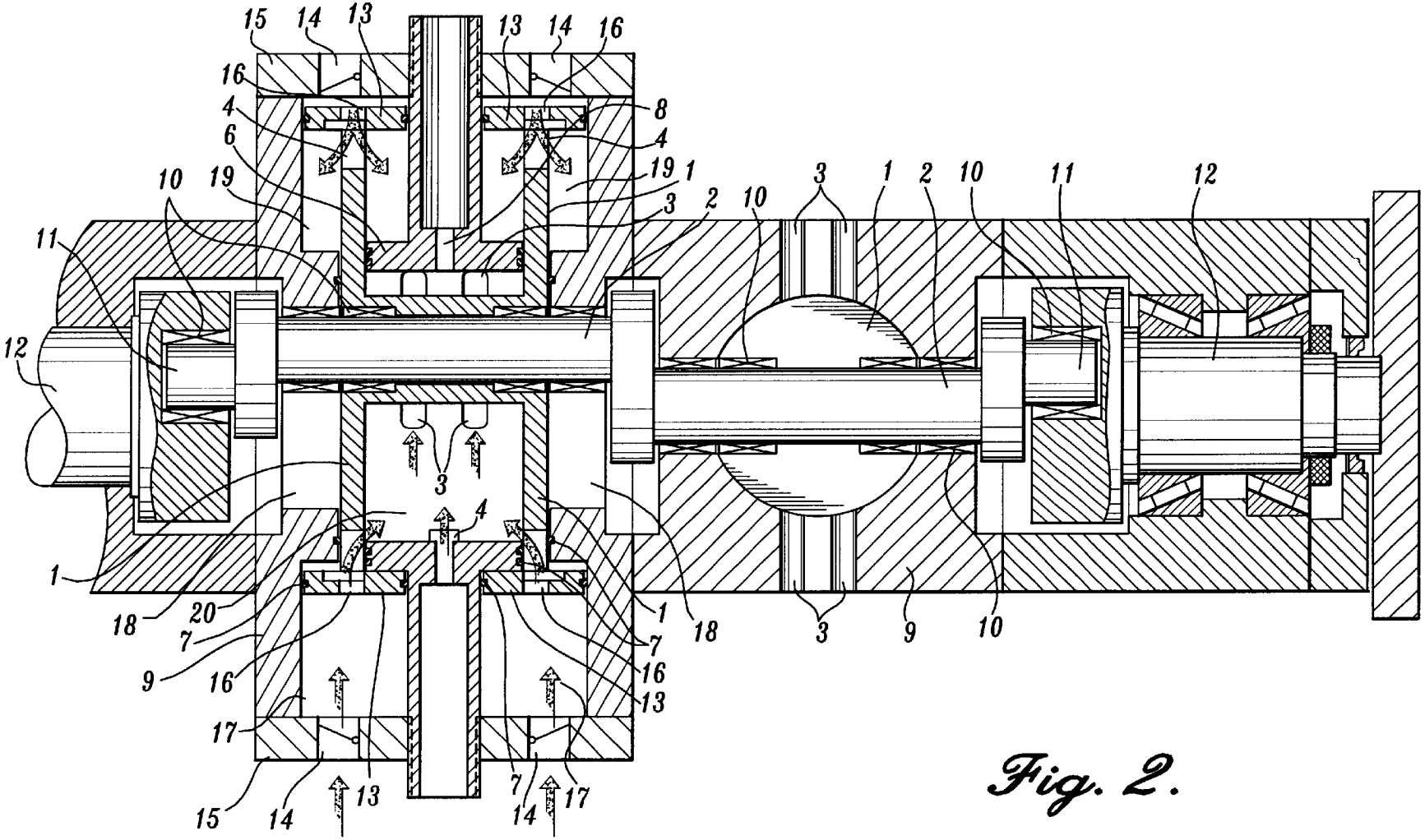
FIG. 2 is a cross-sectional side view of an internal combustion engine formed in accordance with the present invention showing a first set of cylinders extending normal to a second set of cylinders, wherein each set of cylinders are in contact with a reciprocating and rotating mechanism.
Figure 3:
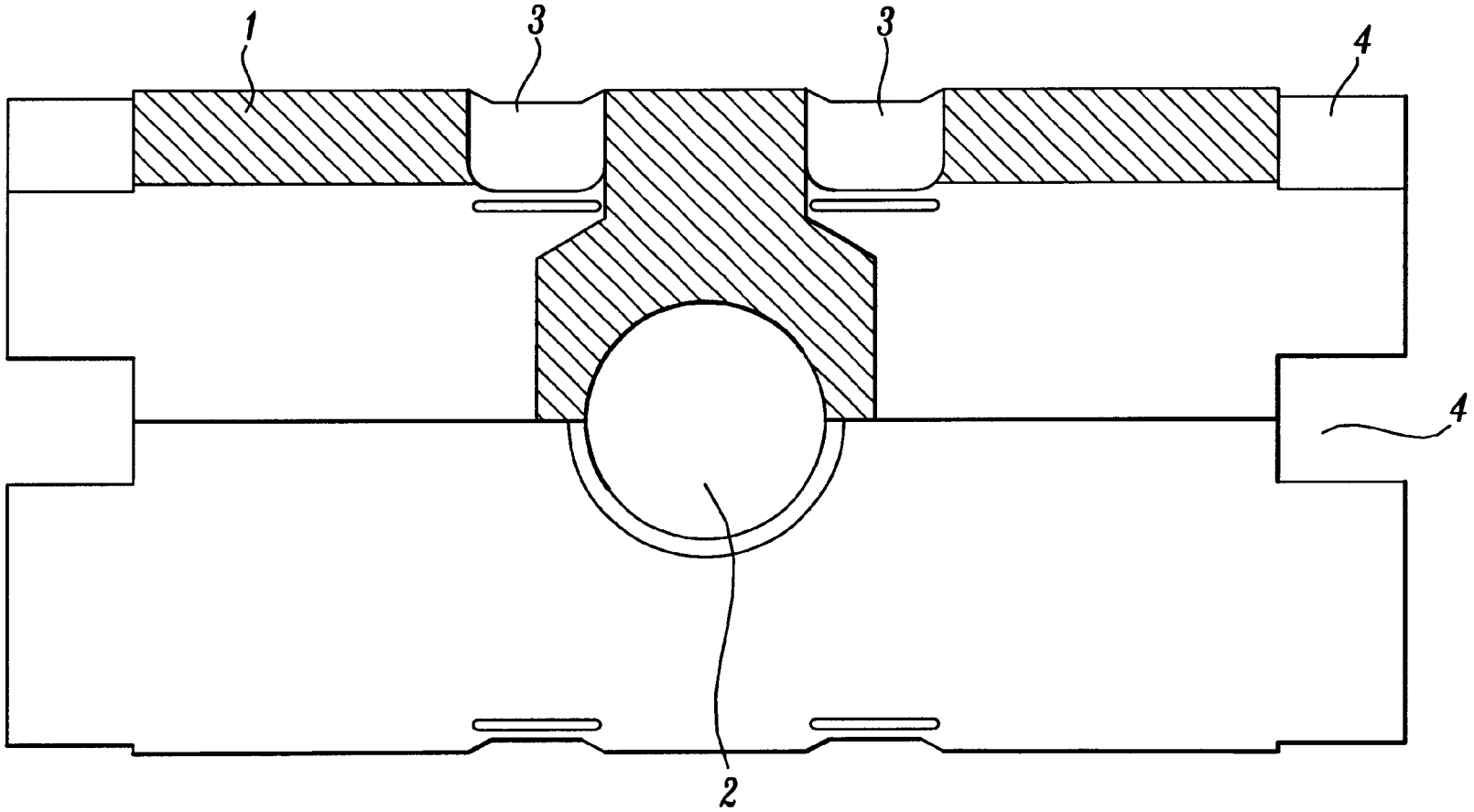
FIG. 3 is a cross-sectional view of a portion of an internal combustion engine formed in accordance with the present invention showing the exhaust ports, intake ports and the reciprocating and rotating mechanism.
Figure 4:
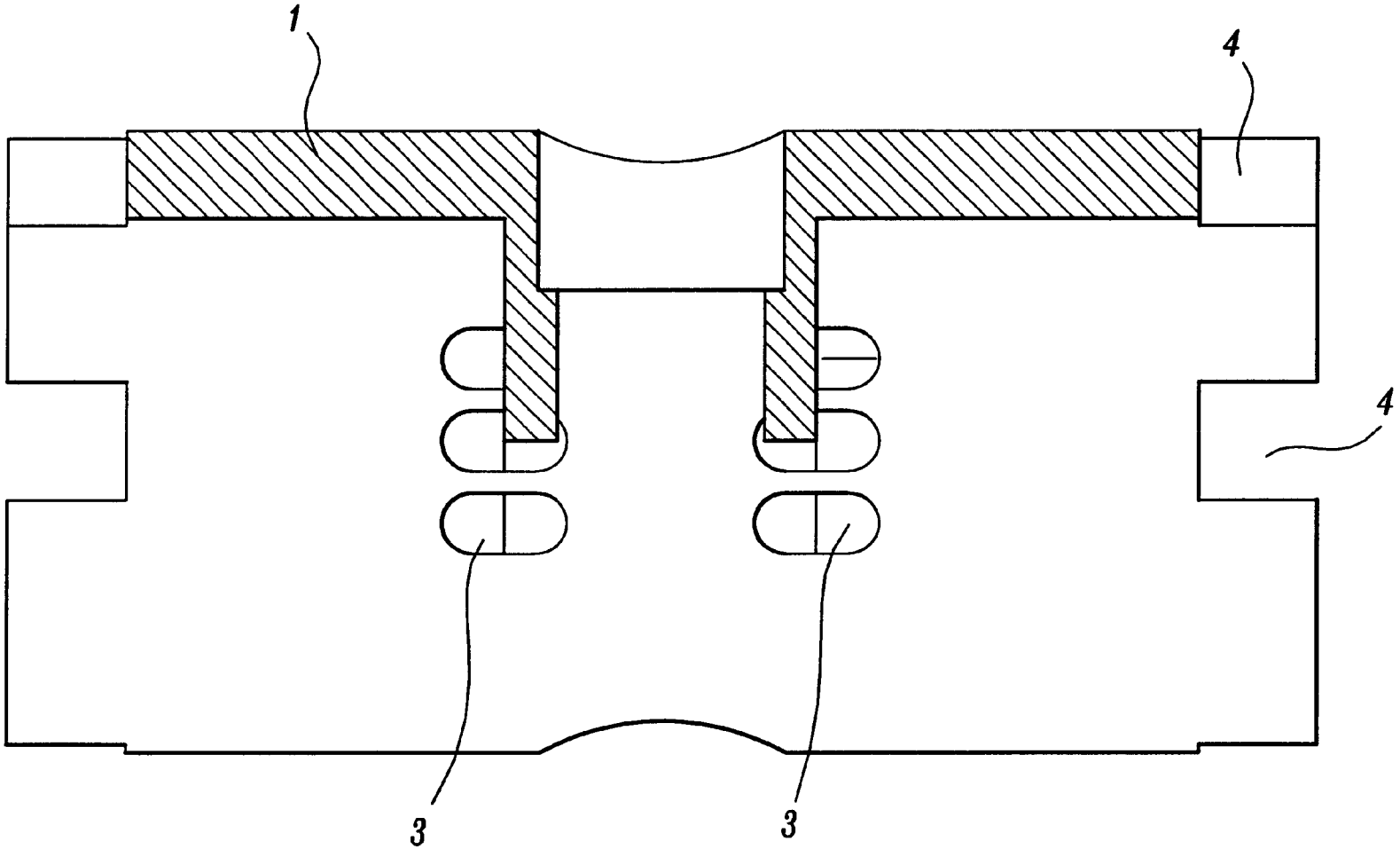
FIG. 4 is a cross-sectional view of an internal combustion engine formed in accordance with the present invention showing a cylinder, intake ports and exhaust ports.

The PTO journals 11 may be set in bearings 10 located in the PTO shafts 12. The centerline of the PTO shafts 12 match the centerline of the motor assembly, as seen in FIG. 2.

The cylinder journal pins 2 move the distance of the stroke in a straight line, and are guided by the double cylinder assembly, the slots 18 and the connection in a ninety degree angle of the cylinder housings 9. The whole cylinder pin assembly rotates at the same time in itself around the PTO shaft 12 centerline. Thus, the cylinder journal pin assembly has two axes of rotation. The first axis of rotation is defined by a longitudinal axis extending through the elongate direction of the cylinder journal pin assembly. The second axis of rotation is defined normal to a point defined midway between the ends of the stroke length of the cylinders.

The transformation of the straight motion into a circular motion is based on the following:

FIG. 1: Two lines AB and CD having the same length cross each other at a right angle (ninety degrees) at the halfway point E of each line. A line ab equal to half the length of AB or CD moves with its point a on the line CD from point C to D and back. At the same time point b moves on line AB from A to B and back. This demonstrates the straight motion of the connected cylinder journal pin 2. As a result, point X located at the halfway point of line ab moves in a circle. This demonstrates the circular motion of the PTO journal 11. The PTO journal 11 rotates the PTO shaft 12.

Air or air/fuel mixture enters the intake chamber 17 through the primary reed valve assembly 14 into the intake chamber 17 during the combustion stroke. The intake chamber 17 is favorably bigger than the actual cylinder displacement.

The precompression plate 13 which is attached to the double cylinder 1 transfers the air or air/fuel mixture during the compression stroke through a secondary reed valve assembly 16 located in the precompression plate 13 into the precompression chamber.

The same can be done over transfer ports 21 located in the cylinder housing and piston shaft, as seen in FIG. 11. At the combustion stroke the air/mixture enters close at the bottom dead center position through the intake ports 4 and into a cylinder chamber 20. It pushes out the rest of the gases from combustion through the already open cylinder exhaust ports 3 which match in this position the exhaust ports located in the cylinder housing 9.

As the cylinder 1 starts the compression stroke, the intake ports 4 close, the exhaust ports 3 stop to match and the cylinder chamber 20 is sealed. As a result of the oversized intake chamber 17 the cylinder chamber 20 gets a charge comparable to that of a super or turbocharged engine. It gets this already at lowest rpm, as soon as the throttle is completely open.

Through the lack of connecting rods and its corresponding movement around the crankshaft, friction on the cylinder walls is reduced. The diagram of the piston speed, in this case cylinder speed, changes favorably at any rpm.

The combustion pressure is also better and there is a more efficient transformation of energy into mechanical power.

Figure 12:
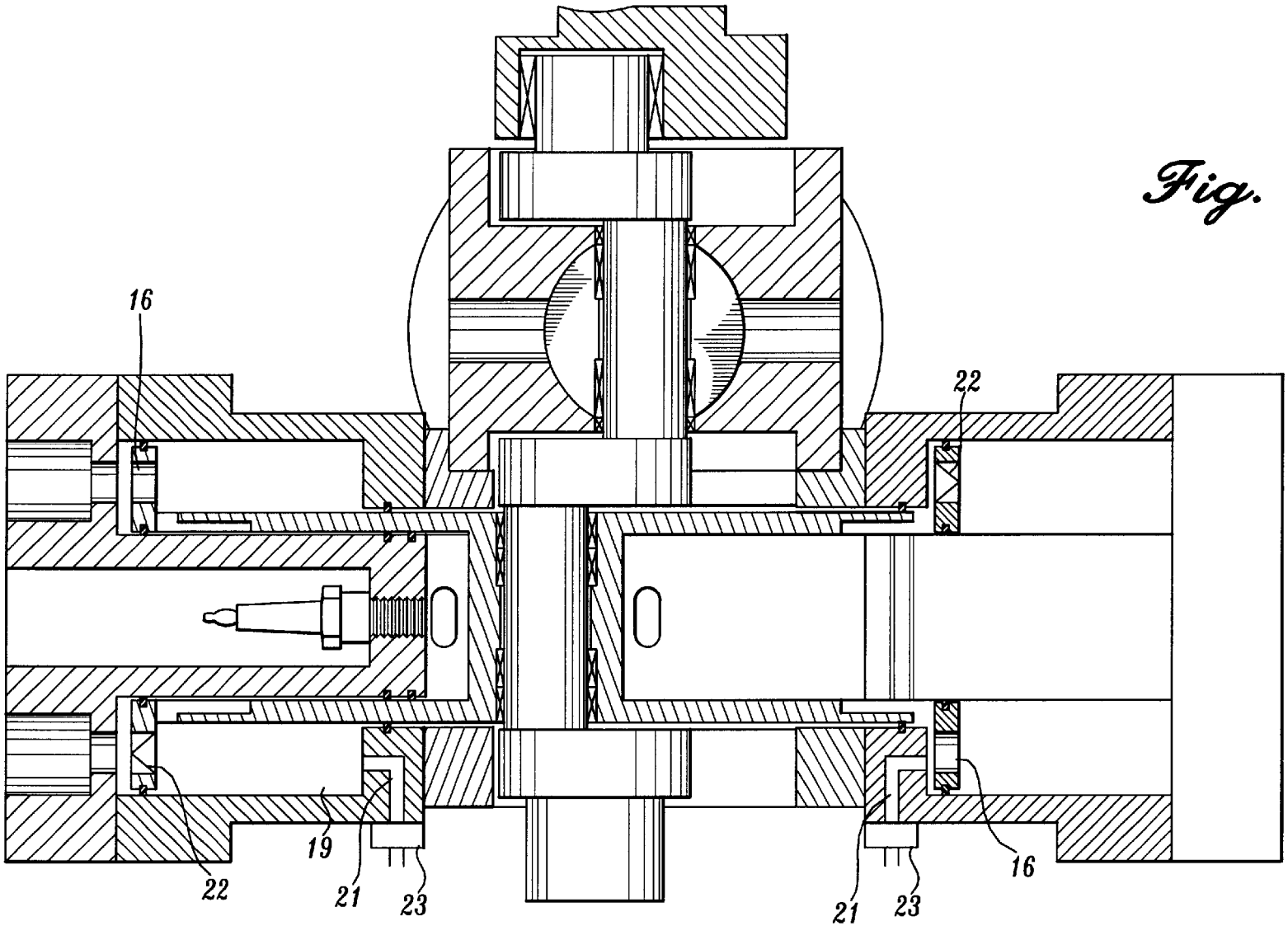
FIG. 12 is a cross-sectional side view of an internal combustion engine formed in accordance with the present invention showing the major components of the engine with an over pressure valve attached to the cylinders.

FIG. 12 illustrates the same principle for a normal piston-cylinder arrangement.

Figure 13:
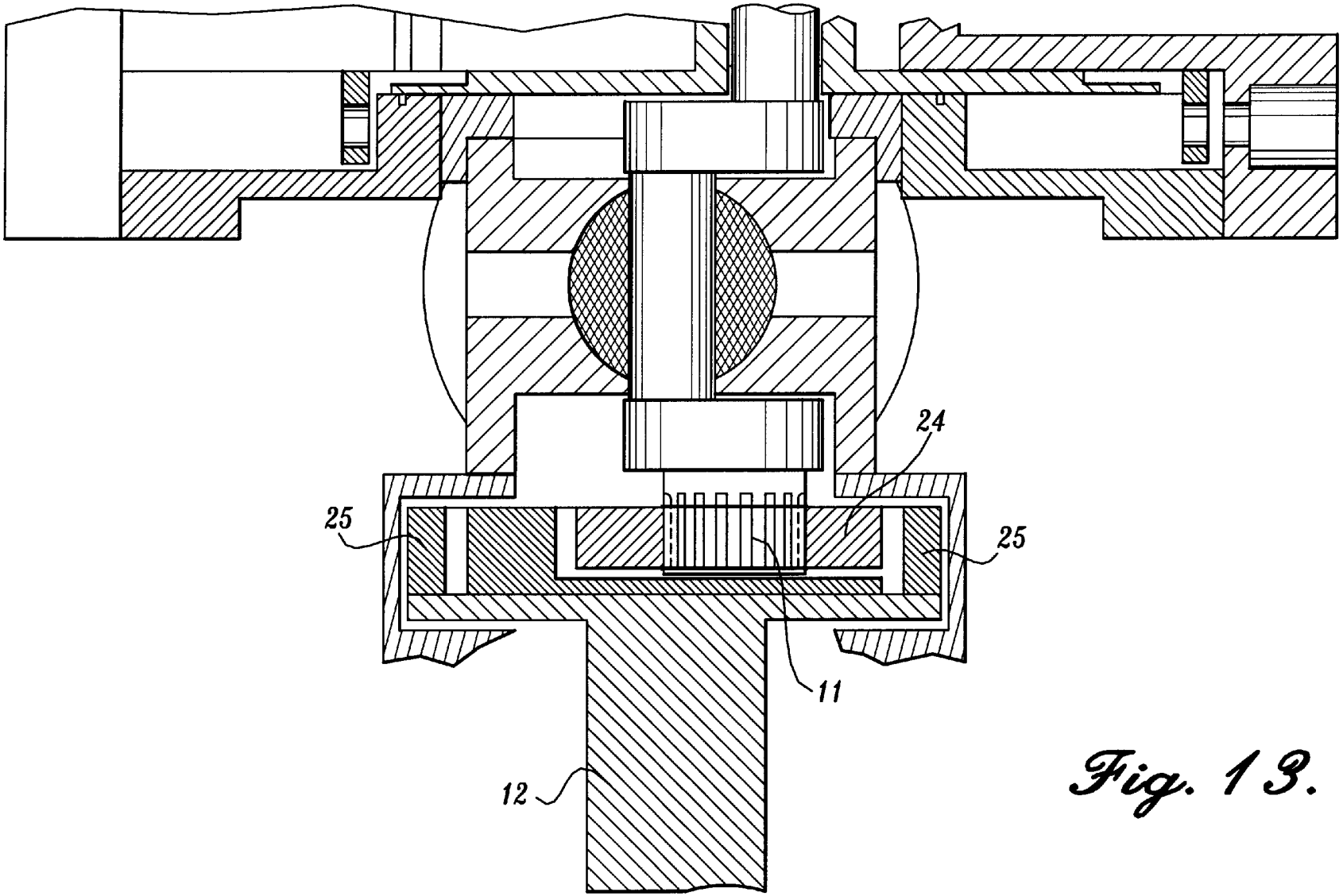
FIG. 13 is a cross-sectional view of an internal combustion engine formed in accordance with the present invention showing a reduction plate attached to one end of the reciprocating and rotating mechanism.

FIG. 13 shows the same as FIG. 2, just with other dimensions.

Figure 14:
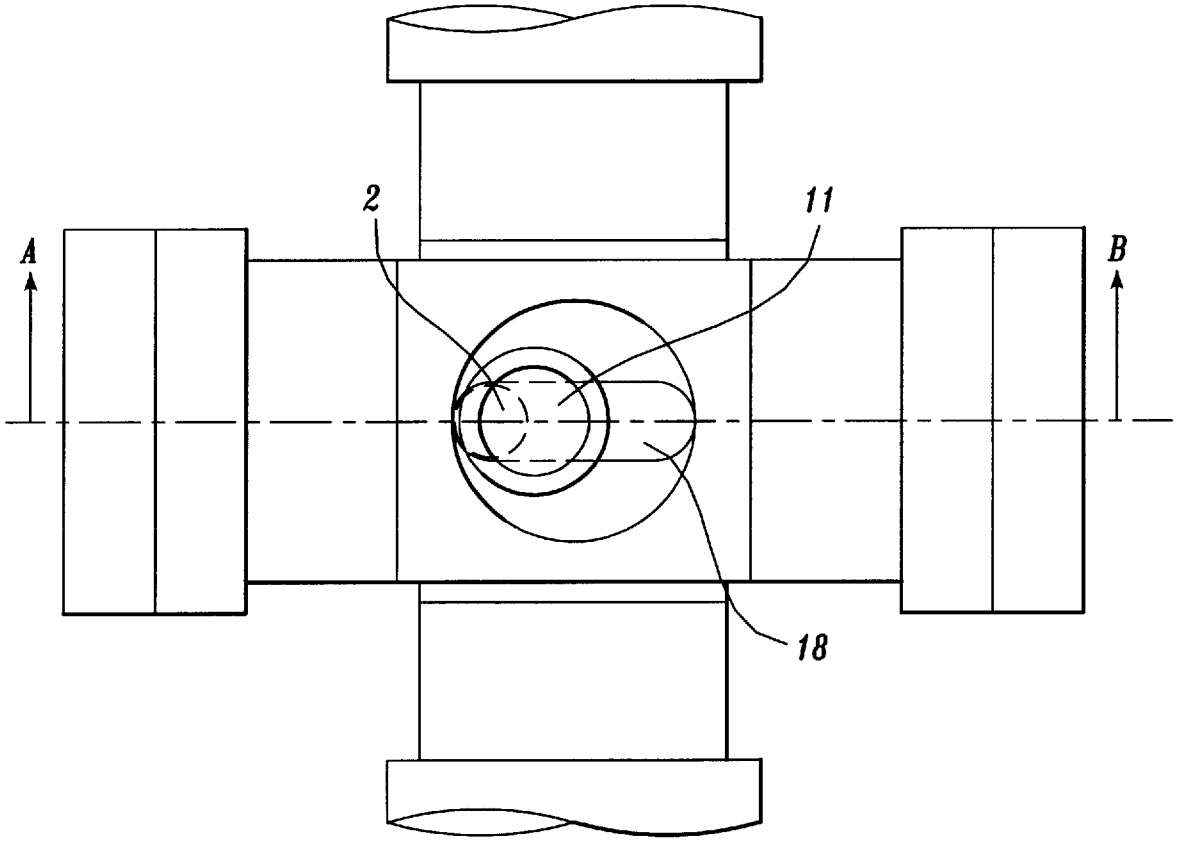
FIG. 14 is a side view of an internal combustion engine formed in accordance with the present invention showing the power take off journal.
Figure 15:
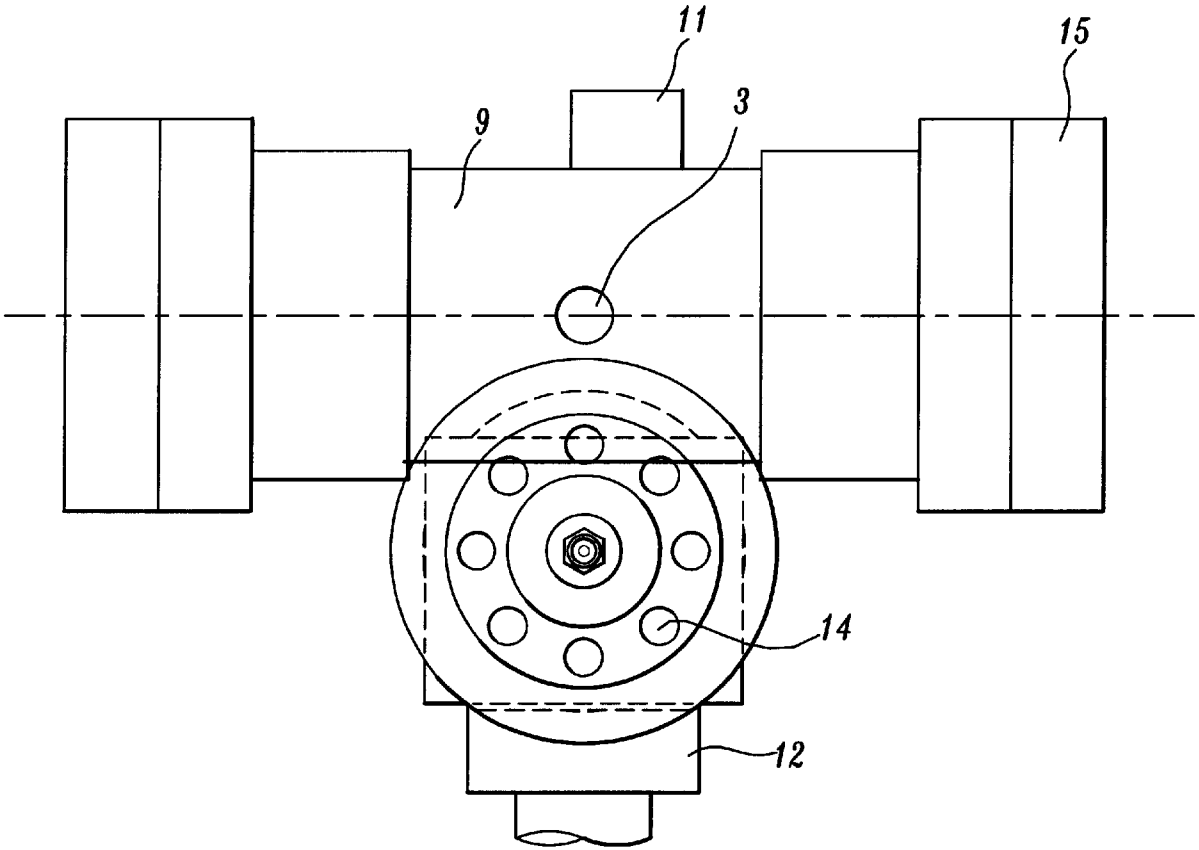
FIG. 15 is an end view of an internal combustion engine formed in accordance with the present invention showing the reed valve assembly.
Figure 17A:
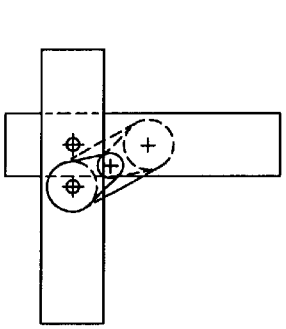
FIG. 17 illustrates the motion of the cylinder assembly for an internal combustion engine formed in accordance with the present invention.
Figure 17B:
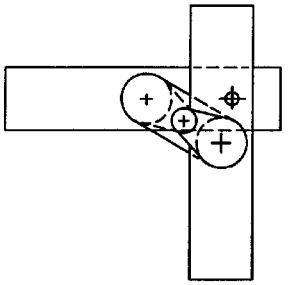
Figure 17C:
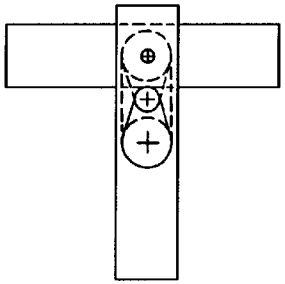
Figure 17D:
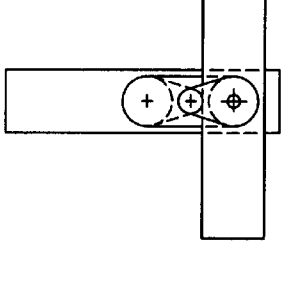
Figure 17E:
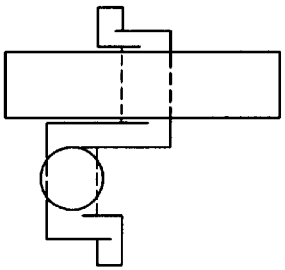
Figure 17F:
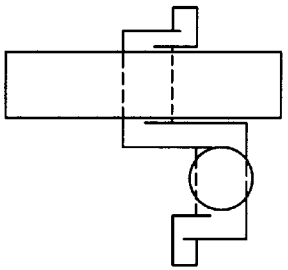
Figure 17G:
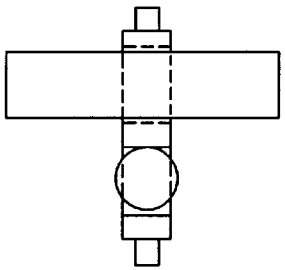
Figure 17H:
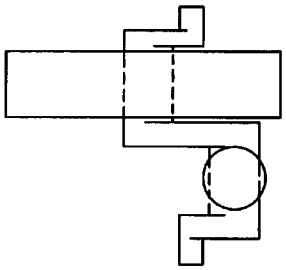

In FIG. 14, over pressure valves 22 are positioned between the reed valves of the secondary reed valve assembly 16. After reaching a certain precompression, depending on adjustment, a surplus of air/fuel mixture at precompression is bleeding back into the intake chamber 17.

Independent from the altitude of operation or the rpm of the engine, as long as the adjusted precompression is reached, the engine will deliver its full horsepower and torque range.

Located at the bottom of the precompression chamber 19 are one or more cylinder housing vent holes 21. The vent holes 21 lead over compressor reed valves 23 to air hose connections located anywhere on the engine or the vehicle in which the engine is installed. In a diesel engine, surplus air might be used for compressor purposes during normal operation of the engine from any one or all cylinders.

In gasoline engines only a part of the cylinders can be used that way on demand. In this situation air for these particular cylinders has to bypass a carburetor.

In fuel injected gas engines, a bypass is not necessary as long as the injectors for the cylinders are shut off.

This guarantees that only air is compressed.

A part of the gas engine keeps operating and powers the compressor part if selected. After the compressor is not needed and the air hose or other appliance is disconnected, the vent holes are automatically closed and the engine is switched back to normal operation on all cylinders.

Referring to FIG. 13, a gear 24 is attached to the PTO journal 1. The gear 24 rotates like the PTO journal 11 and the cylinder journal pin 2 around itself. At the same time it rotates with its centerline around the centerline of the power takeoff shaft 12 to which an inside gear ring 25 is attached.

If the gear 25 rotates 360° it has to cam its teeth twice with the teeth of the gear ring 25.

Through the manipulation of diameters and the possible amount of teeth involved different reduction ratios of the actual engine rpm to a desired PTO shaft 12 rpm is possible. In the example of FIG. 13 the gear 24 on the PTO journal 11 has 30 teeth. The gear ring 25 on the PTO shaft 12 has 40 teeth. At one 360° rotation of the cylinder pin assembly and the gear 24 around its centerline, the gear has to cam 60 teeth at the gear ring 25. The gear ring 25 has only 40 teeth, therefore it has to rotate in the process the distance of 20 teeth, what amounts to a 180° rotation of the PTO shaft 12. A ratio of a 2:1 rpm reduction is accomplished.

FIGS. 16 and 17 show the only three major moving parts of a four cylinder engine. The two double cylinders 1 and the cylinder pin assembly with the two cylinder pins 2 and the PTO journal 11. Steps one to eight demonstrate one 360° rotation in one quarter stroke increments. Engines with more or less than four cylinders can be built.

All known systems of carburetion, fuel injection or additional use of turbochargers, compressors and blowers can be used on this engine, necessary or not. Also, all known types of ignition systems, lubrication systems, cooling systems, emission control systems and other engine related known systems can be adapted and, therefore, are within the scope of the present invention.

FIGS. 18–65 illustrate an alternate embodiment of a reciprocating internal combustion engine 1010 formed in accordance with the present invention. The engine 1010 is unlike conventional reciprocating internal combustion engines, in that the engine 1010 reciprocates two cylinder liners 1014*a* and 1014*b*, orthogonally oriented relative to one another, between opposing pairs of "substantially stationary" pistons 1012*a* and 1012*b*, and 1012*c* and 1012*d* respectively. As used within this detailed description, the phrase "substantially stationary" is intended to mean a part, that although may be capable of some movement, does not move in accordance with a crankshaft or analogous component of an engine, as does a piston, camshaft, connecting rod, or valve of a conventional engine. In other words, a substantially stationary part's movement is separate and independently actuatable relative to the crankshaft or analogous component of an engine.

In the embodiment illustrated in FIGS. 18–65, many of the components are identical to one another, such as the pistons 1012*a*, 1012*b*, 1012*c*, and 1012*d* and each of the two cylinder liners 1014*a* and 1014*b*. Therefore, a numbering scheme has been adopted in which components of identical structure are assigned a common reference numeral followed by a selected letter to distinguish them from their identical counterpart. Where the context permits, reference in the following description to an element of one component having an identical counterpart shall be understood as also referring to the corresponding element of the identical counterpart.

Figure 18:
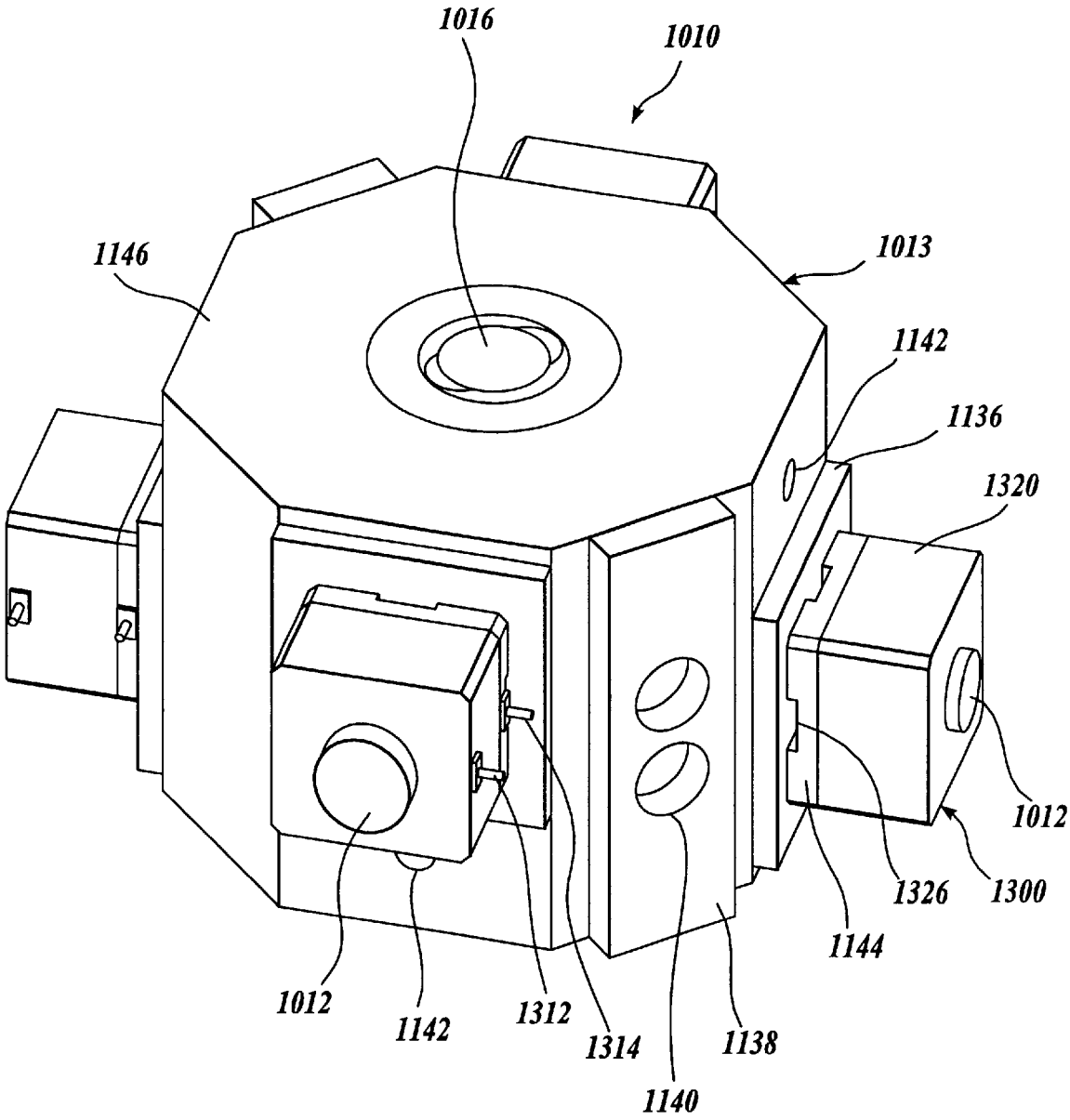
FIG. 18 is a perspective view of an alternate embodiment of a reciprocating internal combustion engine formed in accordance with the present invention, showing an engine block and related components, such as a control plate housing and an intake manifold, attached thereto.
Figure 19:
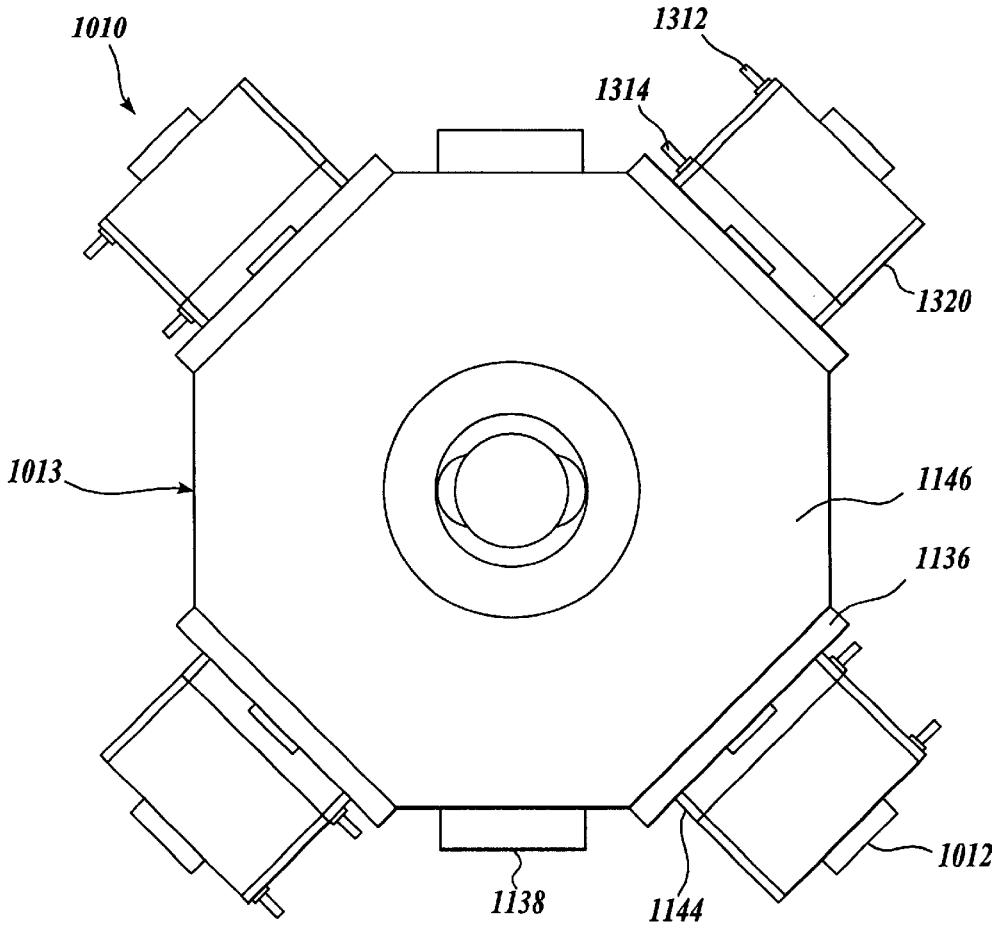
FIG. 19 is a top planar view of the internal combustion engine depicted in FIG. 18.
Figure 20:
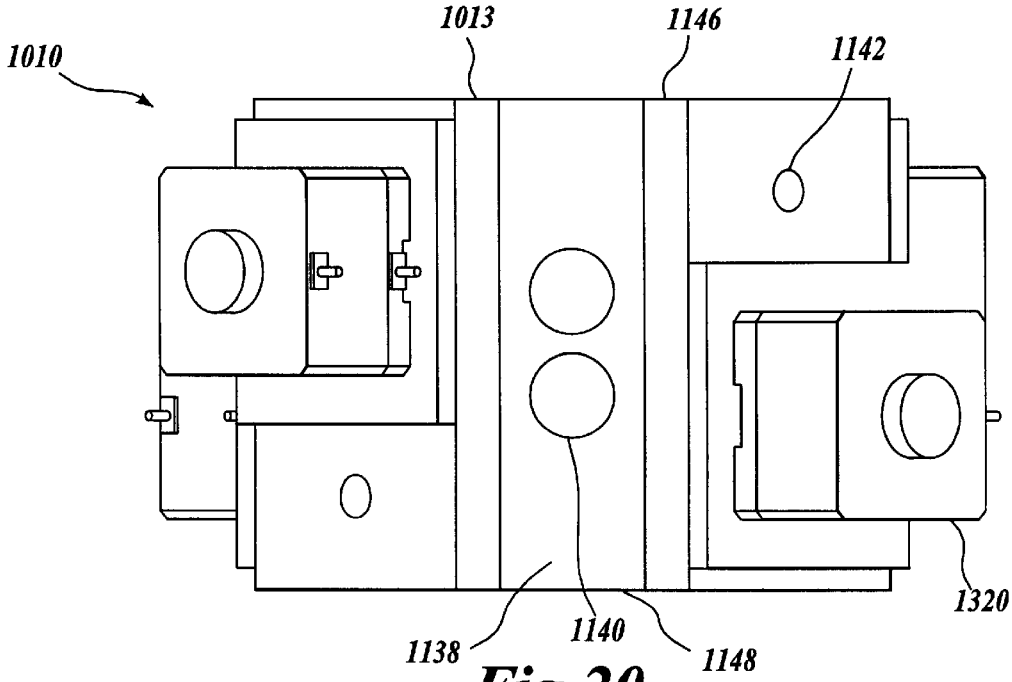
FIG. 20 is a side planar view of the internal combustion engine depicted in FIG. 18.

Referring now to FIGS. 18–20, an engine block 1013 and other related external components of one illustrated embodiment formed in accordance with the present invention will be discussed. The engine block 1013 is suitably an octagonal block structure having an upper planar end surface 1146 opposite a lower planar end surface 1148 with internal cavities for housing the pistons, cylinders, and other related components therebetween. The engine block 1013 is formed from a rigid material, such as steel, cast iron, or aluminum, by techniques well known in the art, such as machining and/or casting. Fastened to the sidewalls of the engine block 1013 are two intake manifolds 1138 and four square mounting plates 1136. Coupled to each of the mounting plates 1136 is a housing mounting plate 1144, upon each of which is coupled a control plate housing 1320.

Figure 21:
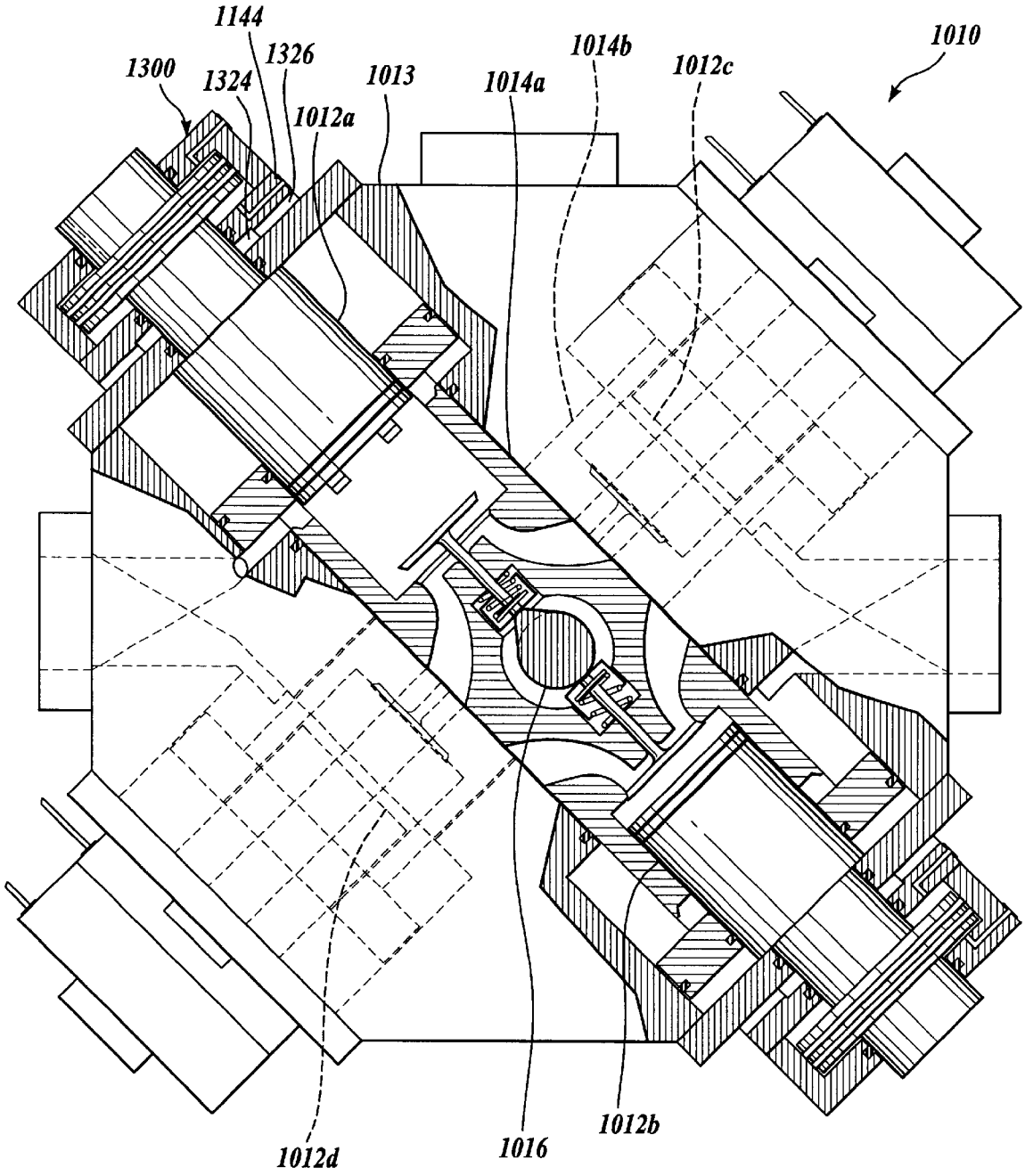
FIG. 21 is a top planar view of the internal combustion engine depicted in FIG. 18, with a portion of the engine block cut-away, showing a cross-sectional view of a reciprocating cylinder liner receiving an opposing pair of substantially stationary pistons.

Referring now to FIGS. 18 and 21, the housing mounting plate 1144 will be described. The housing mounting plate 1144 serves as an insulator, impeding the transfer of heat generated in the engine block 1013 to the various components of a compression ratio and power setting control system 1300, which will be described in further detail below. To impede heat transfer, the housing mounting plate 1144 contains an inner cavity 1324. The inner cavity 1324 impedes heat transfer by limiting the contact between components of the compression ratio and power setting control system 1300 and the mounting plate 1136. Further, the housing mounting plate 1144 includes four cooling ports 1326 in fluid communication with the inner cavity 1324 and the outer environment, to allow heated air to exchange with exterior cool air.

Referring again to FIGS. 18–20, protruding from the control plate housings 1320 are the distal ends of each of the pistons 1012 and upper chamber piping 1312 associated with the compression ratio and power setting control system 1300. Protruding from the housing mating plate 1144 is lower chamber piping 1314 also associated with the compression ratio and power setting control system 1300. Located above or below the control plate housing 1320, as the case may be, is an exhaust port 1142. The exhaust ports 1142 are in fluid communication with the exhaust gas passages 1037 (see FIG. 27) located internally in the engine block 1013, and allow the discharge of products of combustion generated in the combustion chambers of the engine 1010 to the atmosphere. Preferably, well known exhaust gas collection, treatment, and/or muffler systems (not shown) are coupled in fluid communication with the exhaust ports 1142. Each intake manifold 1138 includes two intake ports 1140. Preferably coupled to each intake port 1140 are well-known intake system that may include such components as a carburetor and/or a filter.

Referring to FIG. 21 and focusing mainly now on the internal components of the internal combustion engine 1010, the engine 1010 includes two double cylinder liners 1014*a* and 1014*b*, each of which houses two substantially stationary opposing pistons 1012*a* and 1012*b* and 1012*c* and 1012*d*, respectively, in opposite ends of the cylinder liners 1014*a* and 1014*b*. The cylinder liners 1014*a* and 1014*b* are perpendicularly and offset mounted relative to one another within the engine block 1013. The cylinder liners 1014*a* and 1014*b* alternately reciprocate between a first extended position and a second extended position. More specifically, with reference to cylinder liner 1014*a*, the cylinder liner 1014*a* reciprocates between a first extended position wherein the cylinder liner 1014*a* is at a top-dead-center (TDC) position relative to a first piston 1012*b* and a bottom-dead-center (BDC) position relative to a second piston 1012*a*, as shown in FIG. 21, and a second extended position, where the cylinder liner 1014*a* is at a BDC position relative to the first piston 1012*b* and a TDC position relative to the second opposing piston 1012*a*. The second cylinder liner 1014*b* similarly reciprocates between a first extended position and a second extended position. However, the second cylinder liner 1014*b* reciprocates 180° out of phase of the first cylinder liner 1014*a* so that when the first cylinder liner 1014*a* is in extended position, the second cylinder liner 1014*b* is in a mid-stroke position. The cylinder liners 1014 are coupled to one another by a crank-cam 1016. The crank-cam 1016 converts the linear motion of the cylinder liners 1014 to rotary motion, as will be discussed in further detail below.

Figure 22:
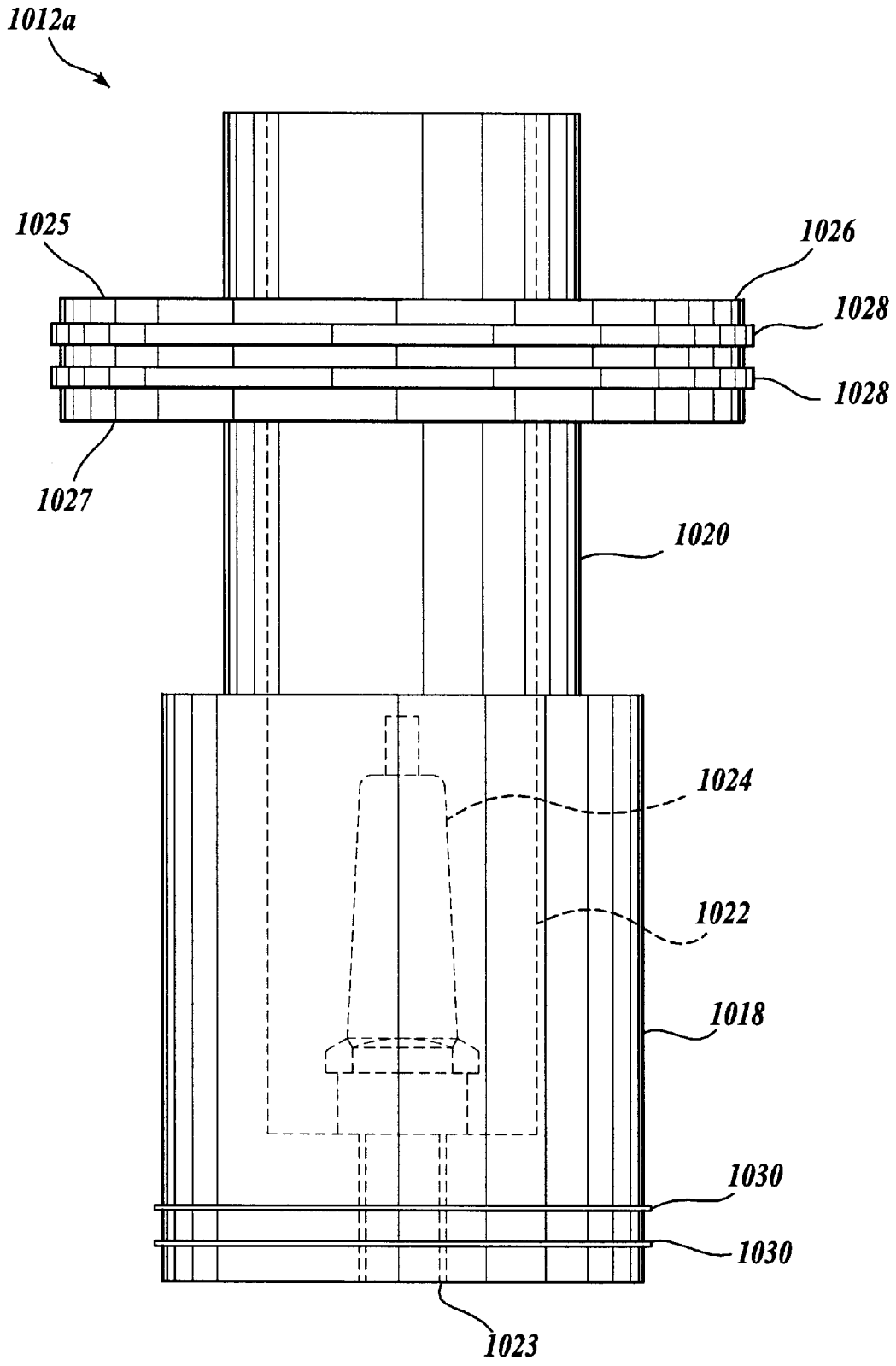
FIG. 22 is an elevation view of one embodiment of one of the substantially stationary pistons shown in FIG. 21.

Referring to FIG. 22, the physical structure of one of the four substantially stationary pistons 1012 formed in accordance with the present invention will now be described. Inasmuch as the pistons 1012 are substantially identical to one another, reference to the piston 1012*a*, illustrated in FIG. 22, shall be understood as also referring to the corresponding other three pistons 1012*b*, 1012*c*, and 1012*d* (see FIG. 21) where context permits. The piston 1012*a* is a hollowed, cylindrical plunger having a piston head 1018 concentrically and perpendicularly mounted to a shaft 1020. Both the piston head 1018 and shaft 1020 have aligned internal bores, forming a channel 1022 running axially through the center of the piston 1012. The channel 1022 allows a substantial reduction in the weight of the piston 1012, while also permitting access to the spark plug 1024 and/or a fuel injector (not shown) disposed within the piston head 1018. The pistons 1012 contain a spark plug or injector hole 1023 for the mounting of a spark plug 1024 and/or fuel injector therein.

Circumferentially mounted on the piston head 1018 are two compression rings 1030. As is well known in the art, the compression rings 1030 prevent the blow-by of combustion gases and products past the piston head 1018, mainly during the compression and expansion portions of the thermodynamic cycle. Although not shown, the piston head 1018 may also include an oil control ring, as is well known in the art. In proximity to the compression rings 1030, the diameter of the piston head 1018 is substantially equal to the diameter of the cylinder liner 1014. The diameter of the piston head 1018 may be tapered thereafter along the length of the piston head 1018, resulting in a portion of the piston head 1018 spaced from the compression rings having a relatively smaller diameter.

Circumferentially mounted on the shaft 1020 is a compression ratio control plate 1026. The compression ratio control plate 1026 is adaptable to receive pressurized control fluid on the upper and lower annular surfaces 1025 and 1027 of the plate 1026. By selectively providing a pressure differential across the annular surfaces 1025 and 1027, the axial position of the piston 1012*a* may be adjusted relative to the engine block to allow the power setting and compression ratio of the engine to be adjusted, as will be described in greater detail below. Two oil control rings 1028 are circumferentially mounted on the compression ratio control plate 1026 to prevent the leakage of any control fluid thereby.

Figure 23:
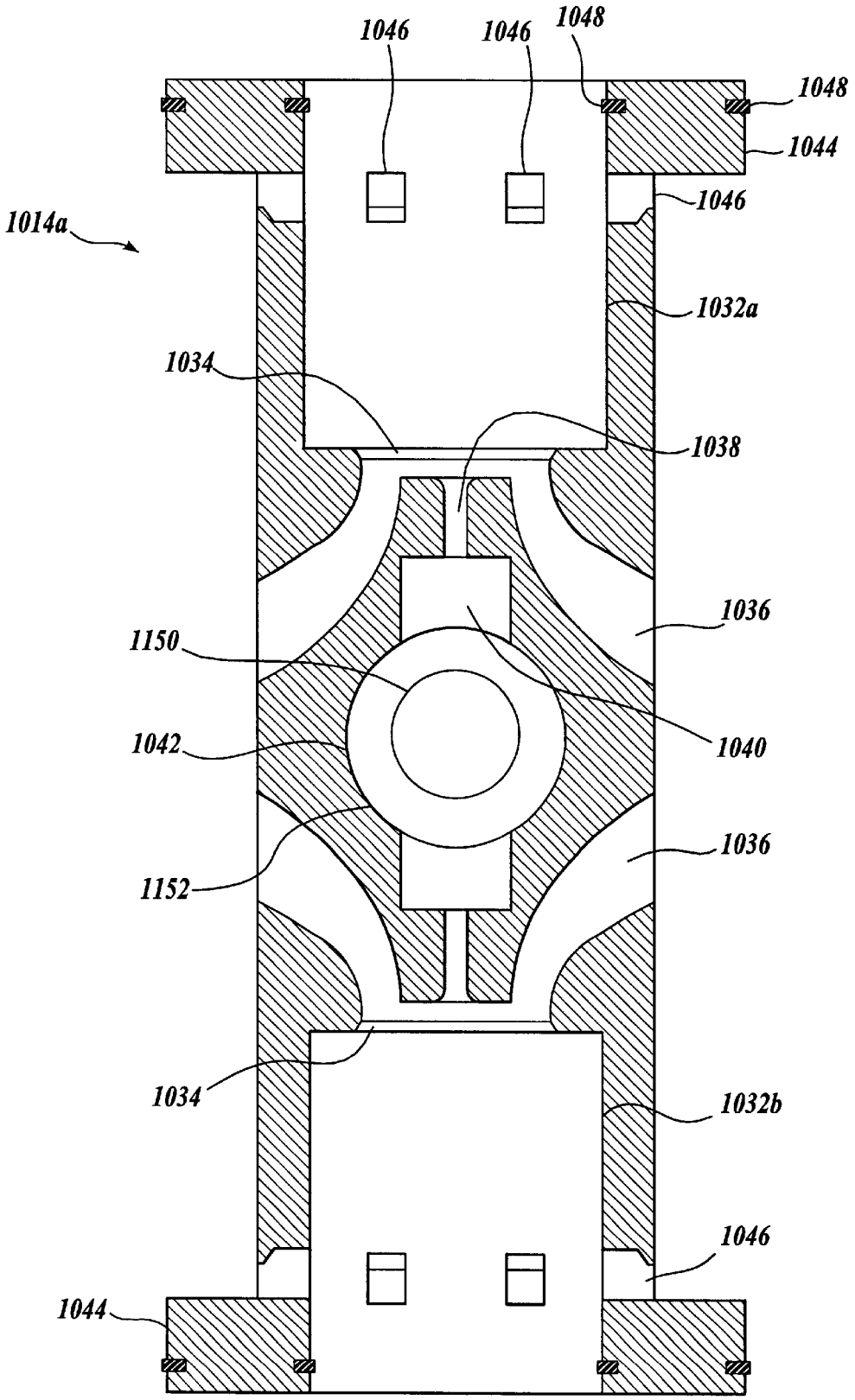
FIG. 23 is a cross-sectional view of one embodiment of the reciprocating cylinder liner shown in FIG. 21.

Referring to FIG. 23, reciprocating double cylinder liner 1014*a*, which operates in conjunction with two of the above-described substantially stationary pistons 1012, will now be described. Inasmuch as the double cylinder liners 1014 are substantially identical to one another, reference to the cylinder liner 1014*a* illustrated in FIG. 23 shall be understood as also referring to the other cylinder liner 1014*b* (see FIG. 21), where context permits. The double cylinder liner 1014*a* is a generally elongate cylindrical structure having a first axially aligned bore concentrically formed in an upper distal end of the cylinder liner 1014*a*, thereby forming a first cylinder 1032*a* for reciprocatingly receiving a piston 1012*a* (see FIG. 21). Located on an opposite lower distal end of the cylinder liner 1014*a* is a second concentrically formed, axially aligned bore in the cylinder liner 1014*a*, thereby forming a second cylinder 1032*b* for reciprocatingly receiving a second piston 1012*b* (see FIG. 21). The cylinders 1032*a* and 1032*b* are shaped and sized to receive the pistons 1012*a* and 1012*b* in a clearance fit relationship, as is well known in the art.

Figure 24:
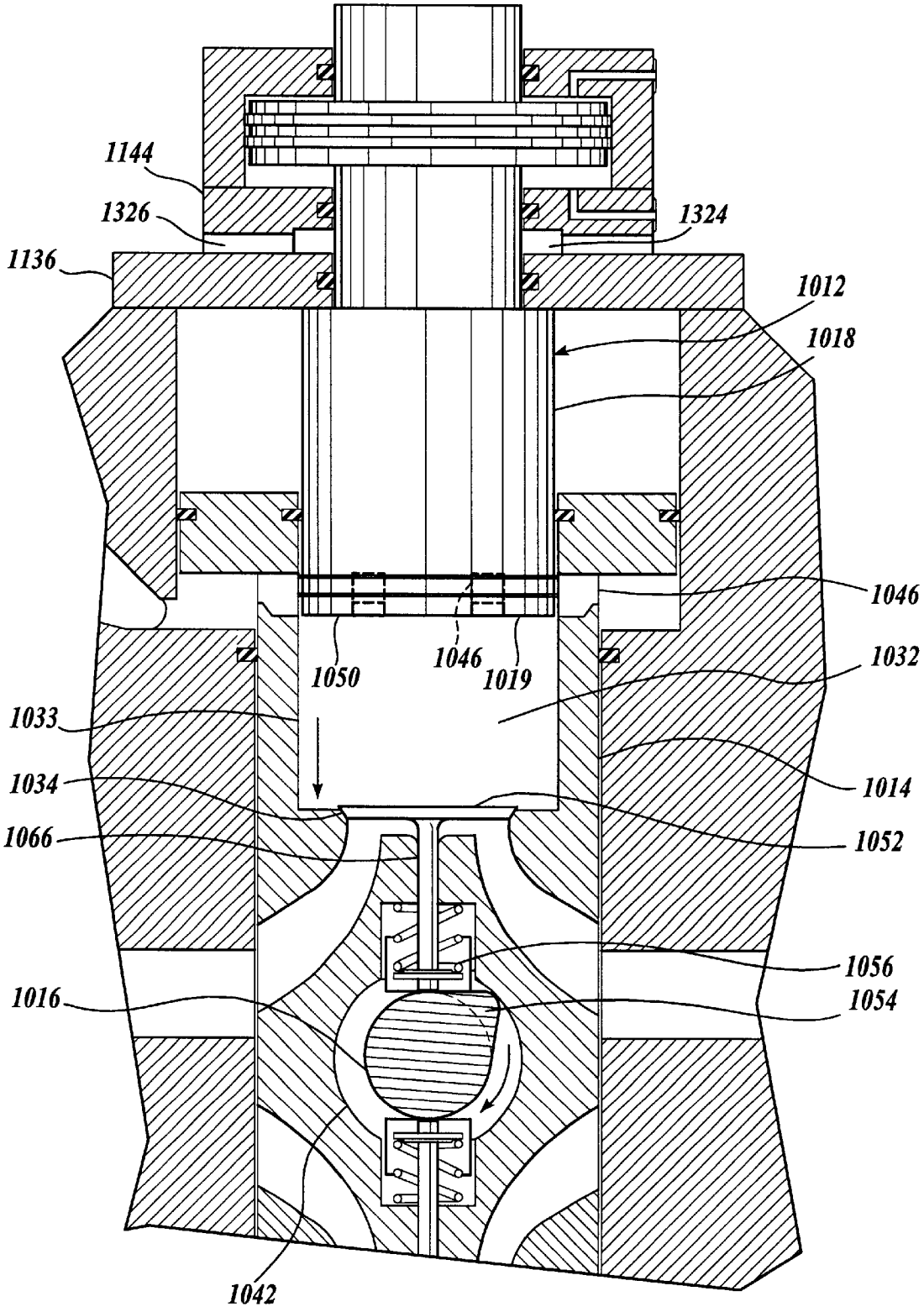
FIG. 24 is a fragmentary cross-sectional view of a portion of the reciprocating cylinder liner and related components shown in FIG. 21, illustrating the reciprocating cylinder liner as a compression portion of a thermodynamic cycle is initiated.

Referring now to FIGS. 21, 23 and 24, at the inner or bottom ends of the cylinders 1032 are exhaust valve seats 1034. The exhaust valve seats 1034 are formed by well-known techniques in the art to receive an exhaust valve therewithin. In fluid communication with the exhaust valve seats 1034 are four exhaust gas passages 1036 for discharging exhaust gases from the cylinders 1032. Centrally bored through the cylinder liner 1014*a* is a valve stem bore 1038. The valve stem bore 1038 is sized to receive a stem of the exhaust valve 1052. In communication with the valve stem bore 1038 is a valve spring housing 1040. The valve stem housing 1040 is sized and configured to house a spring for biasing the exhaust valve in the closed position. In communication with the valve spring housing 1040 is a crank-cam housing 1042. The crank-cam housing 1042 is sized and configured to house the crank-cam 1016 and allow its rotation therewithin.

Figure 28:
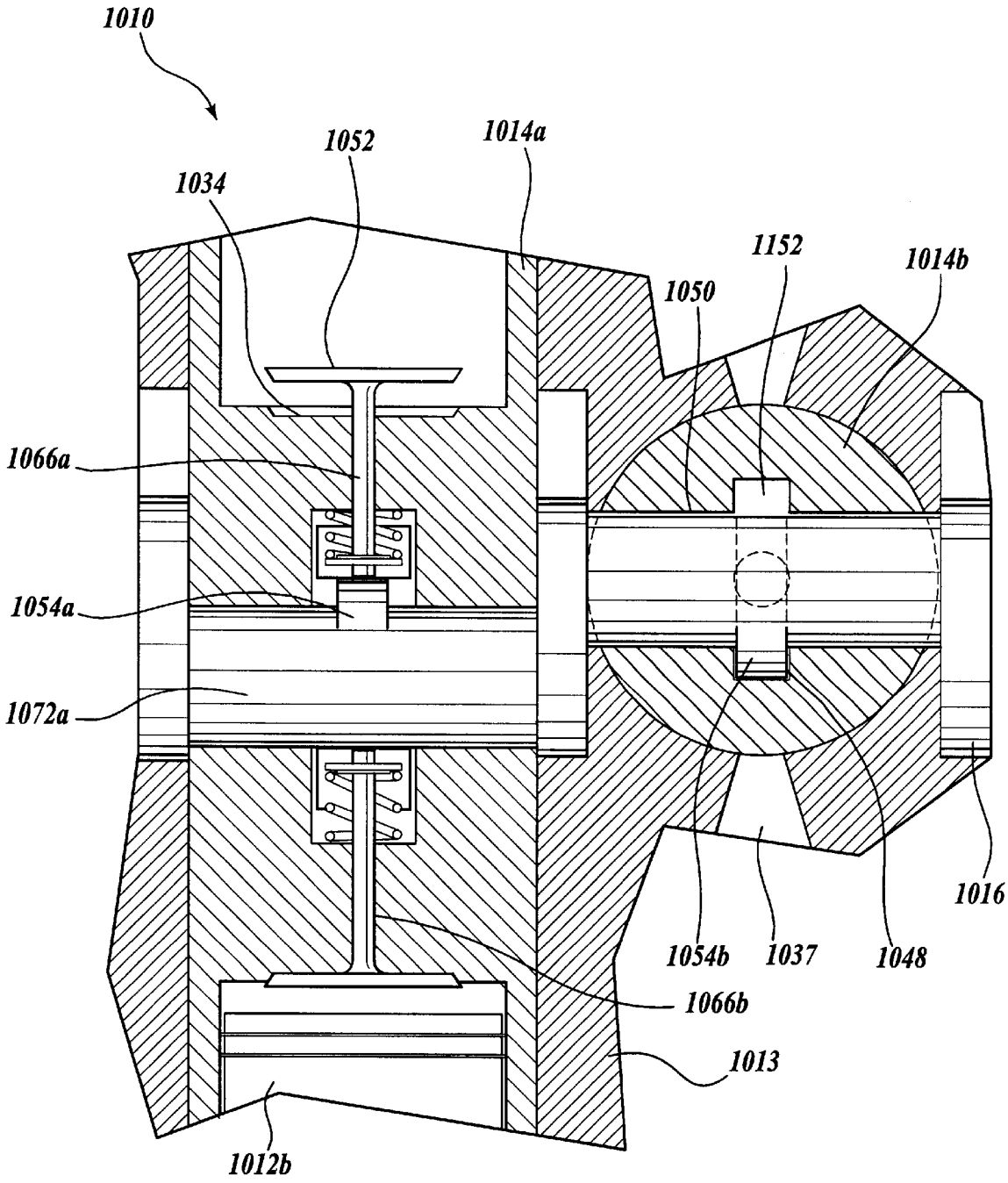
FIG. 28 is a fragmentary cross-sectional view of the reciprocating internal combustion engine of FIG. 18, the cross-sectional cut taken substantially along the centerline of the crank-cam so as to be coplanar with the centerline of a first cylinder liner and pass perpendicularly though the centerline of a second cylinder liner oriented normal to the first cylinder liner.
Figure 29:
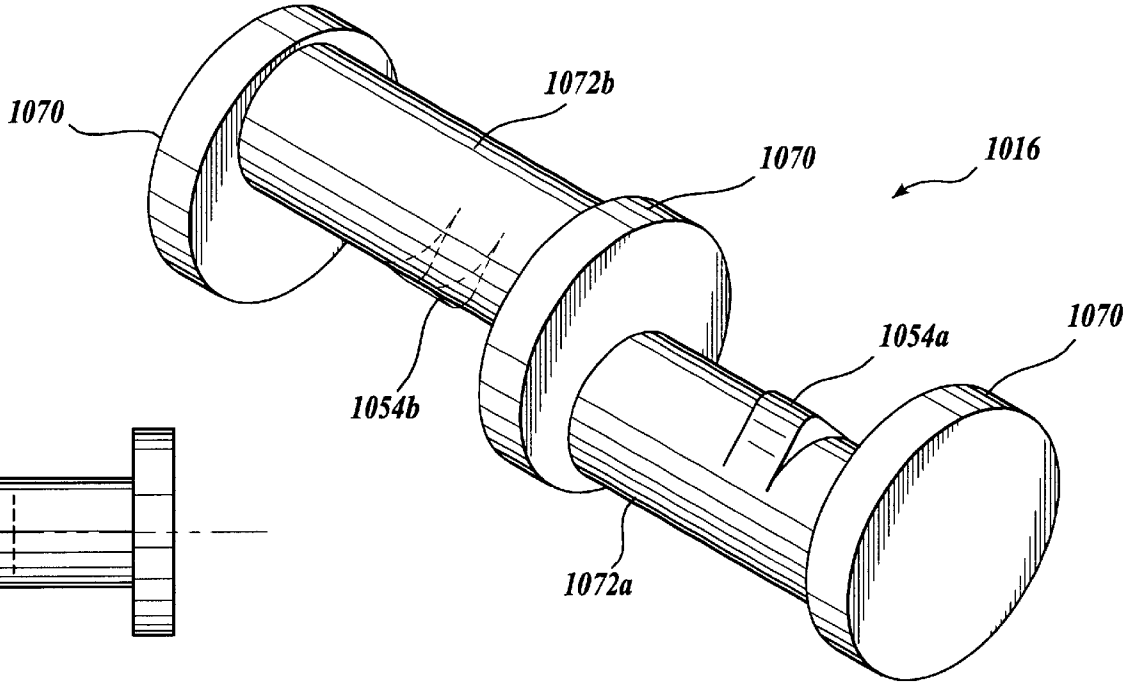
FIG. 29 is a perspective view of one embodiment of the crank-cam shown in FIG. 28 formed in accordance with the present invention.
Figure 30:
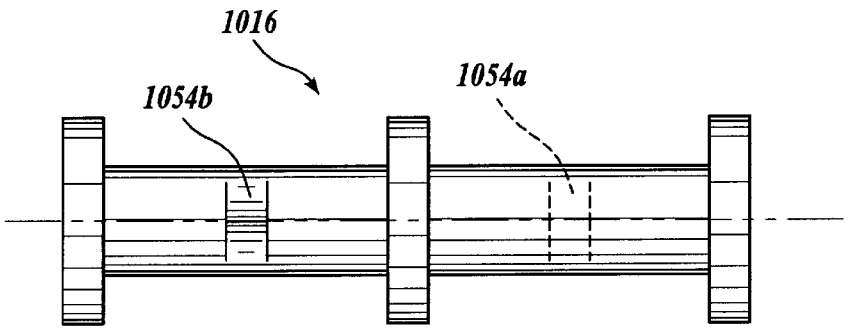
FIG. 30 is a bottom view of the crank-cam shown in FIG. 29.
Figure 31:
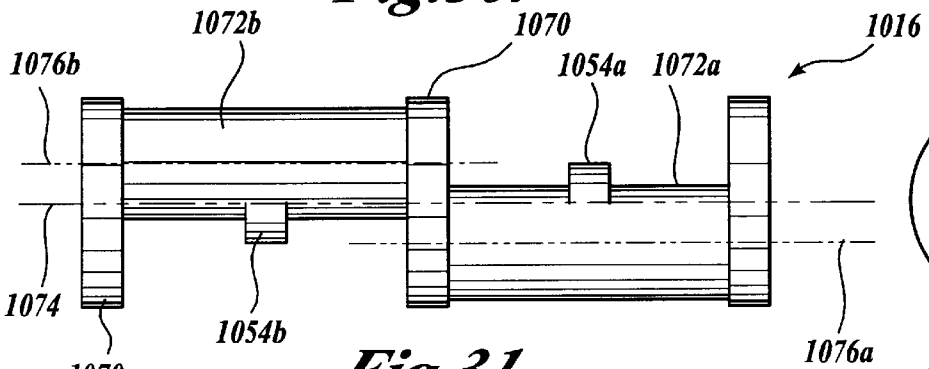
FIG. 31 is an elevation view of the crank-cam shown in FIG. 29.
Figure 32:
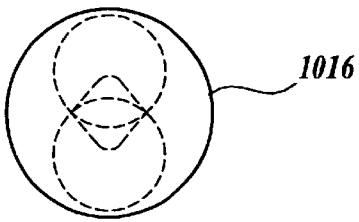
FIG. 32 is a side view of the crank-cam shown in FIG. 31.

Referring now to FIGS. 23 and 28, the crank-cam housing 1042 is formed by a cylindrically shaped bore 1150 perpendicularly passing through the cylinder liner 1014*a* at a location equidistant from the ends of the cylinder liner. The radius of the bore 1150 is substantially equal to the distance measured from the centerline of the crank-cam 1016 to an outer surface of a crank-cam 1016 crank journal 1072. A radius of this dimension allows the crank journal to rotate freely within the bore 1150 of the crank-cam housing 1042 during operation. The diameter of the bore 1150 is stepped suddenly outward in the center of the bore 1150 to form a lobe clearance bore 1152. The radius of the lobe clearance bore 1152 is equal to or greater than a distance measured from a centerline of the crank-cam to the distal end or peak of the lobe 1054 of the crank-cam 1016. A radius of this dimension provides sufficient clearance for the lobe 1054 to rotate freely within the crank-cam housing 1042.

Located on opposite distal ends of the cylinder liner 1014*a* are annular precompression plates 1044. The annular precompression plates 1044 are utilized to compress and deliver pressurized combustion gases to the cylinders 1032, as will be discussed in more detail below. In proximity to the annular precompression plates 1044 are intake ports 1046. In the illustrated embodiment, the intake ports 1046 are spaced circumferentially about the cylinders 1032 at 60° intervals; however, it should be apparent to one skilled in the art that other configurations are suitable. The intake ports 1046 allow the entry of combustion gases into the cylinders 1032 during operation for scavenging and charging of the cylinders 1032. Located on the inner and outer surfaces of the annular precompression plates are inner and outer combustion gas/oil seals 1048. The seals 1048 prevent the passage of fluids thereby as will be described in more detail below.

Referring now to FIG. 24, in light of the above description of the reciprocating double cylinder liners 1014 and the substantially stationary pistons 1012, the relationship of these and related components to one another during significant events in a thermodynamic cycle will now be discussed. The illustrated embodiment of the reciprocating internal combustion engine 1010 of the present invention operates on a two-stroke cycle. Therefore, for every revolution of the crank-cam 1016, each piston 1012 completes the thermodynamic cycle in two strokes, a single stroke defined by movement of the cylinder liner 1014 from a TDC position to a BDC position (or vice versa) relative to the substantially stationary pistons 1012 contained within the cylinder liners 1014. Therefore, every stroke of the cylinder liner 1014 is either a power stroke, also known as an expansion stroke, or a compression stroke relative to each piston 1012. This requires the intake and exhaust functions, i.e., scavenging, to occur rapidly at the end of each power stroke and before the succeeding compression stroke. In the illustrated embodiment, each piston 1012 undergoes one power stroke for each revolution of the crank-cam 1016, resulting in twice as many power strokes as in a similarly designed four-stroke cycle engine for a given RPM.

Still referring to FIG. 24, the cylinder liner 1014 is depicted at the commencement of the compression portion of the thermodynamic cycle. More specifically, the cylinder liner 1014 is depicted as it moves upward from the cylinder liner's BDC position toward the piston 1012. As cylinder liner 1014 moves upward, the piston 1012 completely covers the intake ports 1046, thereby sealing off the cylinder 1032. In the depicted position, an exhaust lobe 1054 on the crank-cam 1016 is oriented just as the valve stem 1066 comes off of the exhaust lobe 1054, thereby allowing a valve spring 1056 to bias an exhaust valve 1052 into a closed position. In the closed position, the exhaust valve 1052 sealingly engages an exhaust valve seat 1034 in the cylinder liner 1014, thereby preventing the discharge of any combustion gases from the cylinder 1032. Configured as described, the combustion gases are sealingly contained within a combustion chamber 1033, defined by the side and bottom peripheral walls of the cylinder 1032 and the end surface, or crown 1019 of the piston head 1018.

Figure 25:
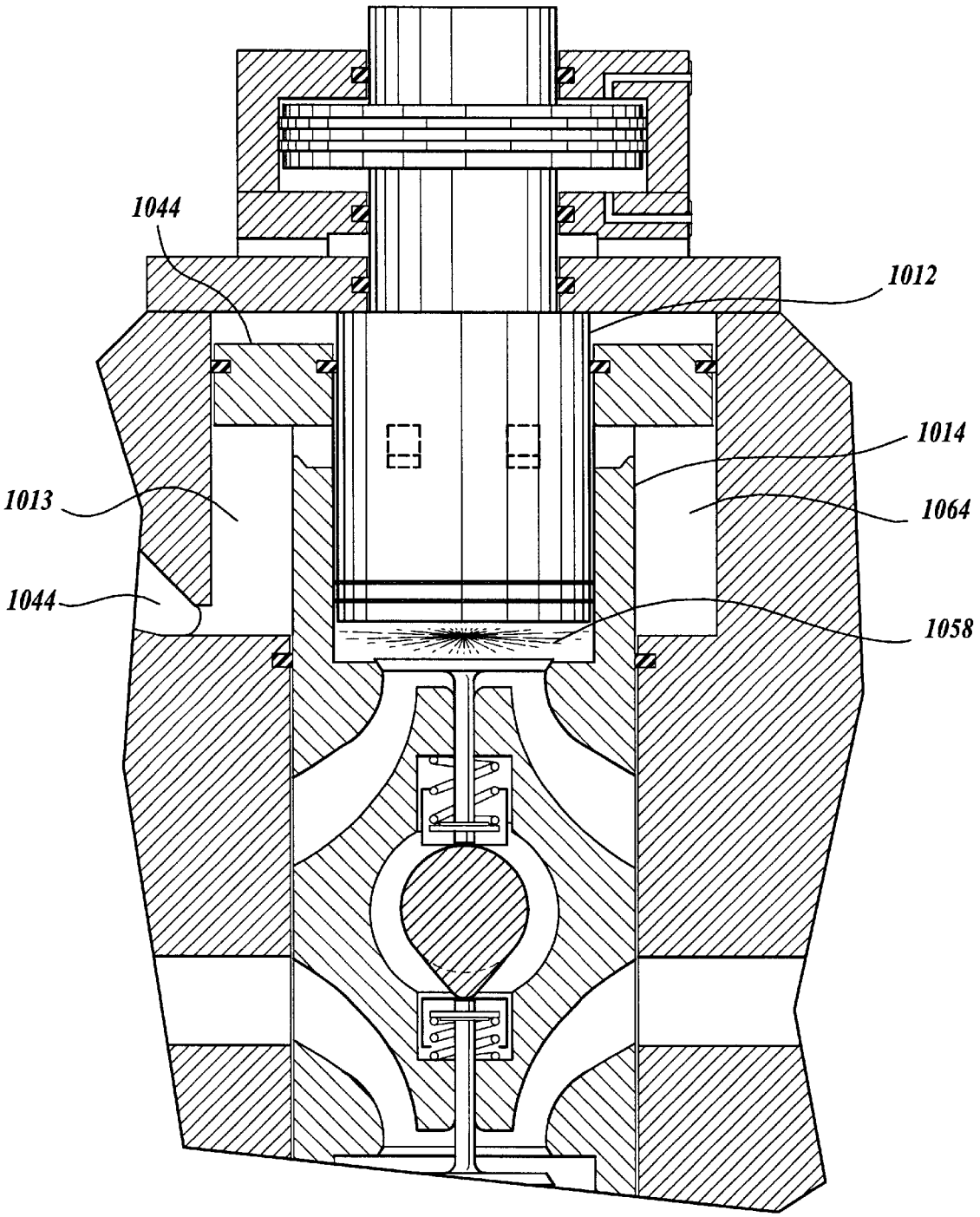
FIG. 25 is a fragmentary cross-sectional view of the reciprocating cylinder liner and related components shown in FIG. 21, illustrating the reciprocating cylinder liner in a top-dead-center (TDC) position with respect to the shown substantially stationary piston as the reciprocating cylinder liner transitions into an expansion portion of the thermodynamic cycle.
Figure 26:
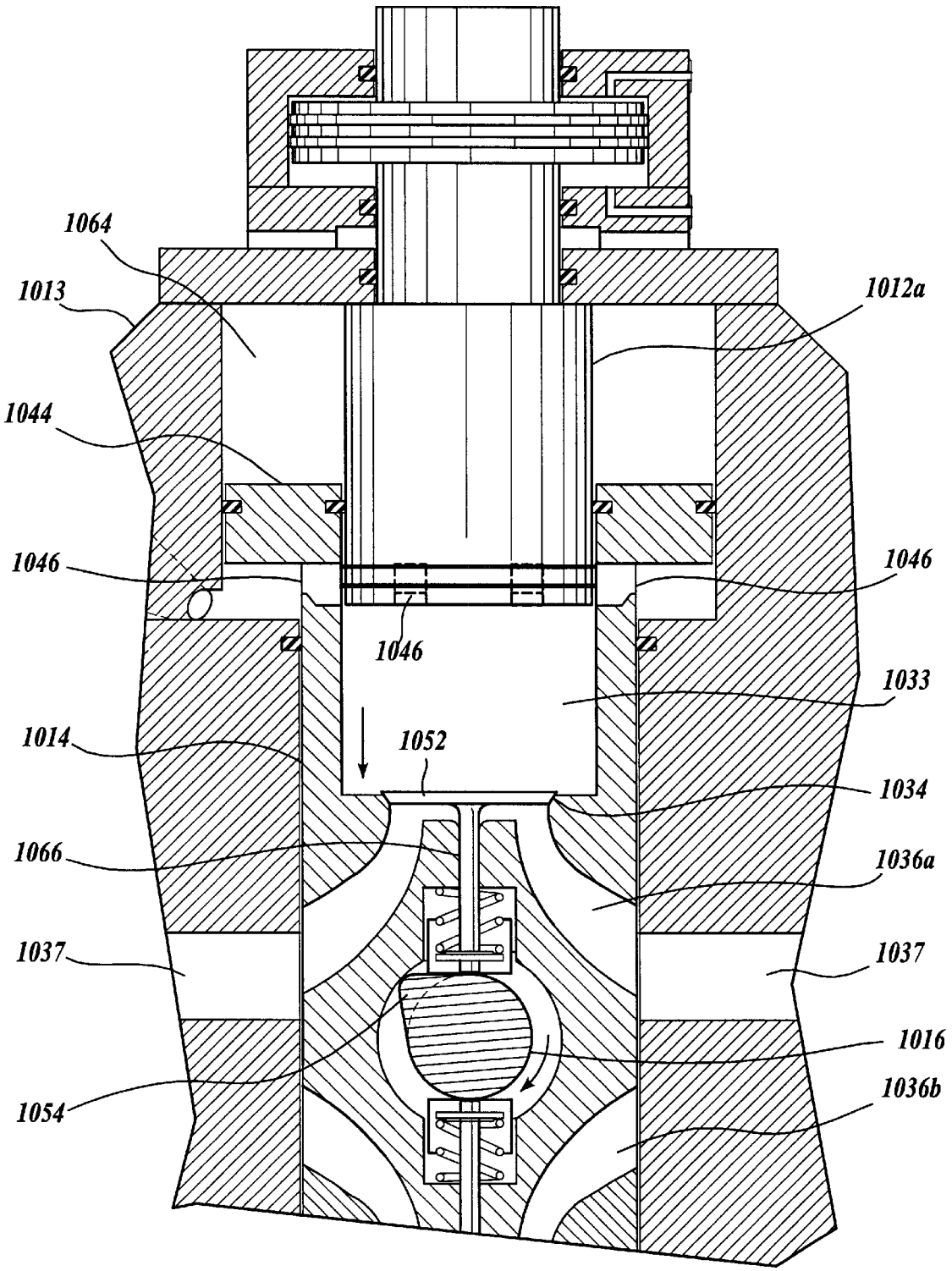
FIG. 26 is a fragmentary cross-sectional view of the reciprocating cylinder liner and related components shown in FIG. 21, illustrating the reciprocating cylinder liner as the cylinder liner transitions into a scavenging portion of the thermodynamic cycle, marked by the opening of a plurality of intake ports near a crown of the substantially stationary piston and the opening of an exhaust valve.

As the cylinder liner continues to approach the piston, departing from its BDC position and approaching its TDC position relative to the piston 1012, the volume of the combustion chamber 1033 is accordingly decreased, thereby compressing the combustion gases contained therewithin. Referring now to FIG. 25, when, or just prior to arrival of the cylinder liner 1014 at its TDC position respective to the piston 1012, a high voltage spark 1058 is discharged from the spark plug 1024 (see FIG. 22) by well-known means, thereby igniting the combustion gases. As the combustion gases bum, the resulting products of combustion expand, driving the cylinder liner 1014 away from the piston 1012. Referring now to FIG. 26, the expansion of the products of combustion continues to drive the cylinder liner 1014 down and away from the piston 1012, until the point in the cycle wherein the exhaust valve 1052 is displaced from its seat 1034 and the intake ports 1046 are uncovered, thus initiating the scavenging of the products of combustion from the combustion chamber 1033.

However, prior to scavenging the products of combustion from the combustion chamber 1033, a new volume of combustion gases is pressurized to aid in scavenging of the combustion chamber 1033. In the illustrated embodiment of the present invention, this is accomplished by the sweeping of the annular precompression plates 1044 through an intake chamber 1064. More specifically, as the cylinder liner 1014 travels upward from the position shown in FIG. 24 to the position shown in FIG. 25, the annular precompression plate 1044 is forced to sweep through the cylindrically-shaped intake chamber 1064. As the precompression plate 1044 sweeps upward through the intake chamber 1064, a vacuum is created within the intake chamber 1064, which draws new combustion gases into the intake chamber 1064. A well-known one-way reed check valve (not shown) allows the flow of the combustion gases into the intake chamber 1064, while preventing the passage of any combustion gases or products of combustion out of the intake chamber 1064.

As the cylinder liner 1014 travels downward from the position shown in FIG. 25 to the position shown in FIG. 26, i.e., from a TDC position to a BDC position, the intake chamber 1064 is a sealed pressure vessel as the intake ports 1046 are sealed off by the piston 1012 and the one-way reed check valves prevent the discharge of combustion gases out the intake chamber 1064. As the precompression plate 1044 sweeps downward through the intake chamber 1064, the combustion gases contained in the intake chamber 1064 are compressed until released into the combustion chamber 1033 by the uncovering of the intake ports 1046.

The intake chamber 1064 preferably contains a volume greater than the maximum displacement of the combustion chamber 1033. In the illustrated embodiment, the intake chamber 1064 is three times larger than the maximum displacement of the combustion chamber, although it should be apparent to one skilled in the art that other ratios of intake chamber volume to maximum combustion chamber volume are suitable for use with the present invention, such as low as 1:1 and up to 3:1 or higher. As a result of the relatively greater volume of the intake chamber 1064 relative to the combustion chamber 1033, combustion gases may be provided at an elevated pressure. Thus, by selecting the relative size of the intake chamber 1064, combustion gases at elevated pressures similar to those reached in a super-charged or turbo-charged conventional engine may be achieved. The pressurization of the combustion gases occurs even at low RPMs, unlike conventional super-charged or turbo-charged engines, which typically are unable to provide sufficient pressurization of the combustion gases at low RPM, resulting in a lag in engine performance as the engine reaches an elevated RPM able to provide sufficiently pressurized combustion gases.

Scavenging of the combustion chamber 1033 commences at the end of the power stroke. The end of the power stroke is marked by the opening of the intake ports 1046 and the exhaust valve 1052. This occurs, as depicted in FIG. 26, as the cylinder liner 1014 moves down and away from the substantially stationary piston 1012 to the point that the intake ports 1046 are initially uncovered and the exhaust valve 1052 is initially lifted from its seat 1034. As the intake ports 1046 are initially uncovered, the pressurized combustion gases contained within the intake chamber 1064 below the precompression plate 1044 are released into the combustion chamber 1033. At approximately the same time, the exhaust valve 1052 is initially lifted off the valve seat 1034 as the lobe 1054 of the crank-cam 1016 engages the valve stem 1066, thereby disposing the exhaust valve 1052 toward the substantially stationary piston 1012. Thus, the products of combustion contained in the combustion chamber 1033 begin to be swept from the combustion chamber 1033 as the pressurized combustion gases contained in the intake chamber 1064 are released from the intake chamber 1064 through the intake ports 1046 and through the combustion chamber 1033. The entrance of the pressurized combustion gases into the combustion chamber 1033 forces the products of combustion out the exhaust gas passageways 1036 in the cylinder liner 1014 as they align with the exhaust gas passageways 1037 located in the engine block 1013.

The exhaust gas passageways 1037 are centrally located in the engine block 1013 and are alternately aligned depending upon the position of the cylinder liner 1014, in fluid communication with a first pair of exhaust gas passageways 1036*a* and a second pair of exhaust gas passageways 1036*b* in the cylinder liners 1014. More specifically, when the cylinder liner 1014 is at a BDC position with respect to a first piston 1012*a*, the first pair of exhaust gas passageways 1036*a* associated with the first piston 1012*a* are in fluid communication with the exhaust gas passageways 1037 in the engine block 1013. When the cylinder liner moves to a BDC position with respect to a second piston opposing the first piston, the second pair of exhaust gas passageways 1036*b* associated with the second piston will be in fluid communication with the exhaust gas passageways 1037 in the engine block 1013.

Figure 27:
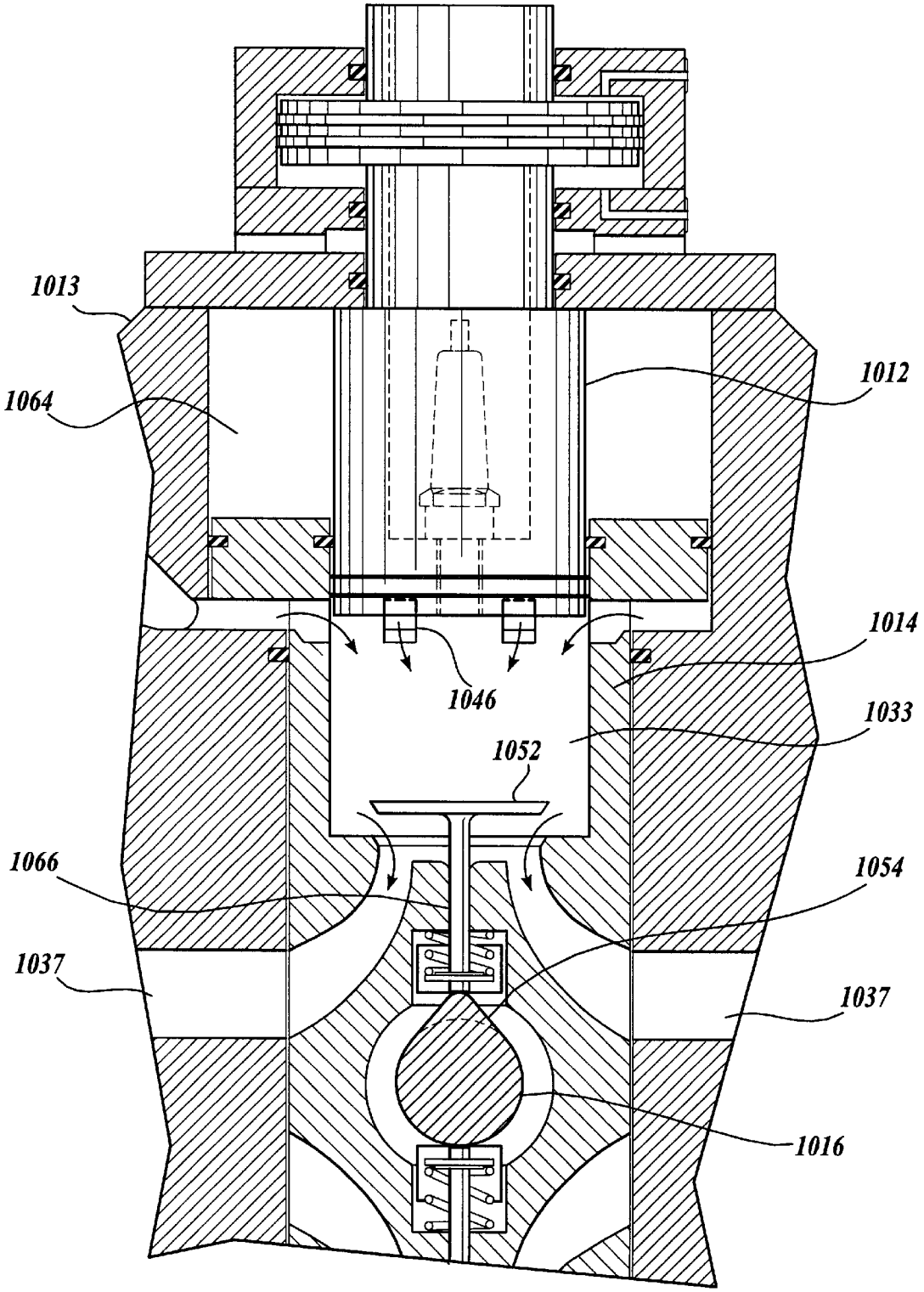
FIG. 27 is a fragmentary cross-sectional view of the reciprocating cylinder liner and related components shown in FIG. 21, illustrating the reciprocating cylinder liner in a bottom-dead-center (BDC) position with respect to the shown substantially stationary piston as the reciprocating cylinder liner undergoes scavenging with the intake ports fully open and the exhaust valve fully open.

Returning now to the operation of the engine, the cylinder liner 1014 continues to move away from the substantially stationary piston 1012*a* until the cylinder liner 1014 reaches BDC. At BDC, as depicted in FIG. 27, the intake ports 1046 and exhaust valve 1052 are fully open. At this point, the pressurized combustion gases are flowing into the combustion chamber 1033 at a high rate, thus purging the combustion chamber 1033 of the products of combustion and recharging the combustion chamber 1033 with fresh combustion gases. As the crank-cam 1016 continues to rotate clockwise past the BDC position, the exhaust valve 1052 retracts into a closed position as the lobe 1054 disengages from the valve stem 1066 and the cylinder liner 1014 moves toward the substantially stationary piston 1012, thereby closing off the intake ports 1046. Thus, the combustion chamber 1033 is completely sealed and the combustion gases contained therewithin begin to be compressed, thus returning the cycle to the position depicted in FIG. 24.

Referring to FIGS. 29–32, a crank-cam 1016 formed in accordance with the present invention will now be described in further detail. The crank-cam 1016 of the illustrated embodiment of the present invention serves both the functions of a crankshaft and a camshaft in a conventional reciprocating internal combustion engine. The crank-cam 16 includes three circular crank webs 1070, two crank journals 1072*a* and 1072*b*, and two crank-cam lobes 1054. The crank-cam 1016 may be of steel or other suitably rigid material, forged in one piece, or may be built up, such as by shrink-fitting separately forged crank journals 1072 to cast crank webs 1070. Although the crank webs 1070 are concentrically aligned relative to one another, the crank journals 1072 are offset relative to one another by a distance equal to one half of the stroke length and are also offset relative to the centerline 1074 of the crank webs 1070.

Referring now to FIGS. 21, and 29–32, the crank journals 1072*a* and 1072*b* are disposed relative to one another so that when a first cylinder liner 1014*a* is in a TDC relationship relative to one piston 1012*b* and at a BDC relationship to a second opposing piston 1012*a*, the second cylinder liner 1014*b* is equidistant from its opposing pistons 1012*c* and 1012*d*. Likewise, the crank-cam lobes 1054 of each respective crank journal 1072 face in opposite directions, so that when the first crank-cam lobe 1054*a* has positioned an exhaust valve 1052 in its fully open position relative to a piston 1012*a*, the other crank-cam lobe 1054*b* is equidistant from the opposing substantially stationary pistons 1012*c* and 1012*d*, and therefore does not engage the valve stems of either exhaust valve, thus placing the respective exhaust valves in a closed position.

As should be apparent to one skilled in the art, the force to compress the combustion gases associated with a first piston 1012*a* is provided by the expansion of the gases related to the opposing piston 1012*b*. Therefore, as should be apparent to one skilled in the art, the force exerted upon the crank journal 1072*a* is a resultant force of an expansion force generated by the expansion of the combustion gases minus a compression force required to compress the combustion gases related to the opposing piston. Further, inasmuch as the compression force and the expansion force are collinear, a moment is not created upon the crank-cam 1016 by the simultaneous application of the expansion and compression forces. Thus, the crank-cam 1016 of the present invention may be reduced in size relative to a crankshaft of a conventional engine that does not counter the expansion force with a collinear compression force.

Figure 33:
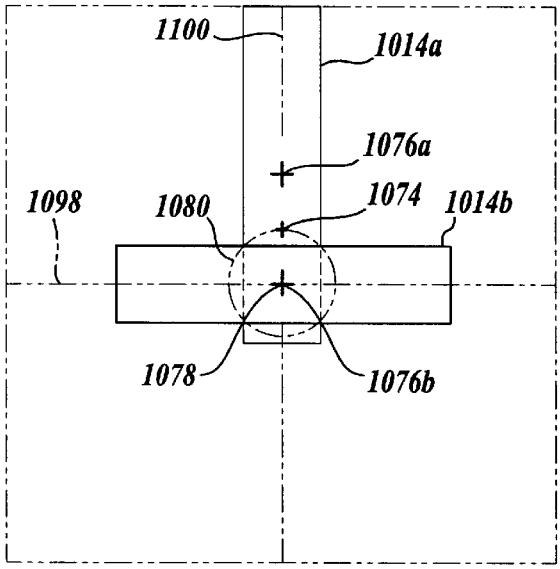
FIG. 33 is a diagrammatic elevation view showing the linear and rotary motion of a crank-cam with attached first and second cylinder liners; showing the first vertically oriented cylinder liner in an fully extended position and the second horizontally oriented cylinder liner in a mid-stroke position, wherein the distance between a pair of crank journals has been exaggerated to better show the movement of the cylinder liners.
Figure 34:
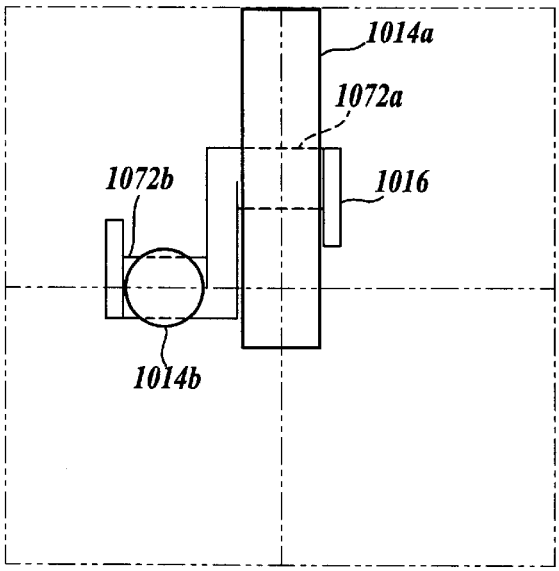
FIG. 34 is a diagrammatic side view of the crank-cam with attached first and second cylinder liners depicted in FIG. 33.

Referring now to FIGS. 29–32 and 33–48, the relationship between the cylinder liners 1014*a* and 1014*b* relative to the crank-cam 1016 during operation will now be described. Referring to FIGS. 33 and 34, wherein FIG. 34 is a side view of the components depicted in FIG. 33, a first cylinder liner 1014*a* is mounted vertically on a first crank journal 1072*a*. A second cylinder liner 1014*b* is perpendicularly, and thus horizontally mounted relative to the first cylinder liner 1014*a* on a second crank journal 1072*b*. The first cylinder liner 1014*a* is restricted to a vertical reciprocating path of travel by the engine block represented by the line identified by the reference numeral 1100. Likewise, the second cylinder liner 1014*b* is restricted by the engine block to a horizontal-reciprocating path of travel represented by the line identified by the reference numeral 1098.

The reciprocating linear motion of the cylinder liners 1014*a* and 1014*b* is translated into rotary motion via the crank-cam 1016. More specifically, the crank-cam 1016 rotates on two axes of rotation. The first axis of rotation 1074 is about the centerline of the crank-cam 1016. More specifically, the first axis of rotation 1074 is defined by a line coplanar, parallel, and equidistant from the centerline 1076*a* and 1076*b* of each crank journal 1072*a* and 1072*b*. During operation, the crank-cam 1016 rotates about the first axis of rotation 1074, while the first axis of rotation 1074 is further rotated in a circular orbit 1080 around a second axis of rotation 1078. The second axis of rotation 1078 is defined as a line normal to both the centerline of the first cylinder liner 1014*a* and the second cylinder liner 1014*b* that bisects the midpoint of the strokes of each cylinder liner 1014*a* and 1014*b*. The radius of the circular orbit 1080 from the second axis of rotation 1078 is equal to one-quarter of the stroke length.

Still referring to FIGS. 33 and 34, cylinder liner 1014*a* is depicted in an extended position, where the cylinder liner 1014*a* is in a TDC and a BDC position relative to its two opposing pistons, while cylinder liner 1014*b* is depicted in a midpoint position, where the cylinder liner 1014*b* is equidistant from its respective opposing pistons. In this configuration, the second axis of rotation 1078 is collinear with the centerline of the crank journal 1072*b* and bisects the midpoint of the stroke length of cylinder liner 1014*b*. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the left along the horizontal path of travel 1098 of the cylinder liner 1014*b*. Likewise, crank-journal 1072*a* and its related cylinder liner 1014*a* move linearly downward along the vertical path of travel 100 of its related cylinder liner 1014*a* to the configuration shown in FIGS. 35 and 36.

Figure 35:
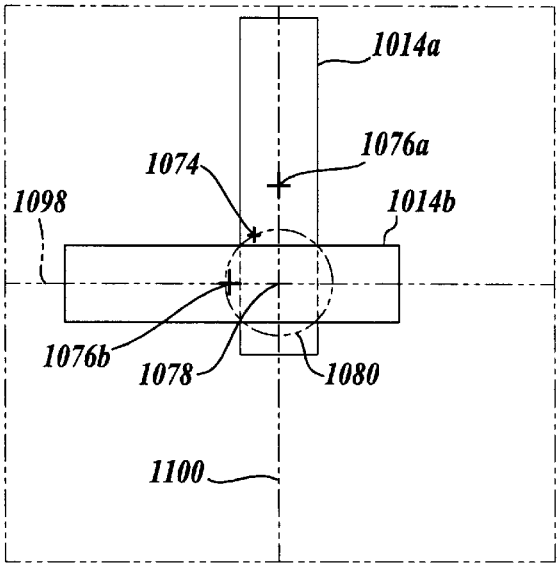
FIG. 35 is a diagrammatic elevation view of the crank-cam with attached first and second cylinder liners of FIG. 33; wherein the crank-cam has rotated 30° about a first axis of rotation from the position depicted in FIG. 33, showing the first vertically oriented cylinder liner as the liner moves linearly downward and the second horizontally oriented cylinder liner as it moves linearly to the left.
Figure 36:
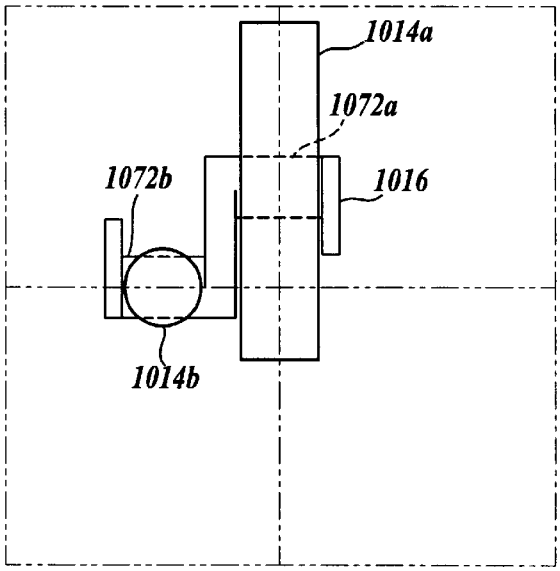
FIG. 36 is a diagrammatic side view of the crank-cam with attached first and second cylinder liners depicted in FIG. 35.

Referring to FIGS. 35 and 36, the crank-cam with attached cylinder liners 1014*a* and 1014*b* are shown after the crank-cam has rotated 30° about the first axis of rotation 1074. Thus, cylinder liner 1014*a* is depicted as it moves linearly downward and away from its extended position depicted in FIGS. 33 and 34 and cylinder liner 1014*b* is depicted as it travels left from the midpoint position depicted in FIGS. 35 and 36. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the left along the horizontal path of travel 1098 of the cylinder liner 1014*b*. Likewise, crank-journal 1072*a* and its related cylinder liner 1014*a* move linearly downward along the vertical path of travel 1100 of its related cylinder liner 1014*a* to the configuration shown in FIGS. 37 and 38.

Figure 37:
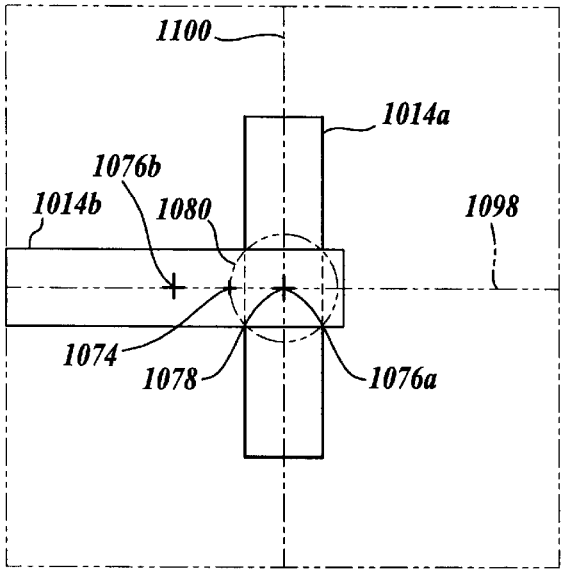
FIG. 37 is a diagrammatic elevation view of the crank-cam with attached first and second cylinder liners of FIG. 33; wherein the crank-cam has rotated 90° about the first axis of rotation from the position depicted in FIG. 33, showing the first vertically oriented cylinder liner in a mid-stroke position and the second horizontally oriented cylinder liner in a fully extended position.
Figure 38:
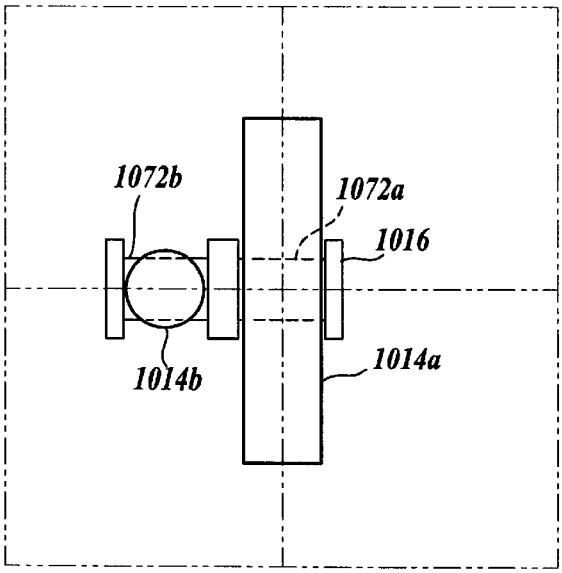
FIG. 38 is a diagrammatic side view of the crank-cam with attached first and second cylinder liners depicted in FIG. 37.

Referring now to FIGS. 37 and 38, the crank-cam with attached cylinder liners 1014*a* and 1014*b* are shown after the crank-cam has rotated 90° about the first axis of rotation 1074. Thus, cylinder liner 1014*b* is depicted in an extended position relative to its two opposing pistons, while cylinder liner 1014*a* is depicted in a midpoint position, where the cylinder liner 1014*a* is equidistant from its respective opposing pistons. In this configuration, the second axis of rotation 1078 is collinear with the centerline 1076*a* of the crank journal 1072*a* and bisects the midpoint of the stroke length of cylinder liner 1014*a*. As the crank-cam continues to rotate clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* change direction and now move linearly to the right along the horizontal path of travel 1098 of the cylinder liner 1014*b*. Crank-journal 1072*a* and its related cylinder liner 1014*a* continue to move linearly downward along the vertical path of travel 1100 of its related cylinder liner 1014*a* to the configuration shown in FIGS. 39 and 40.

Figure 39:
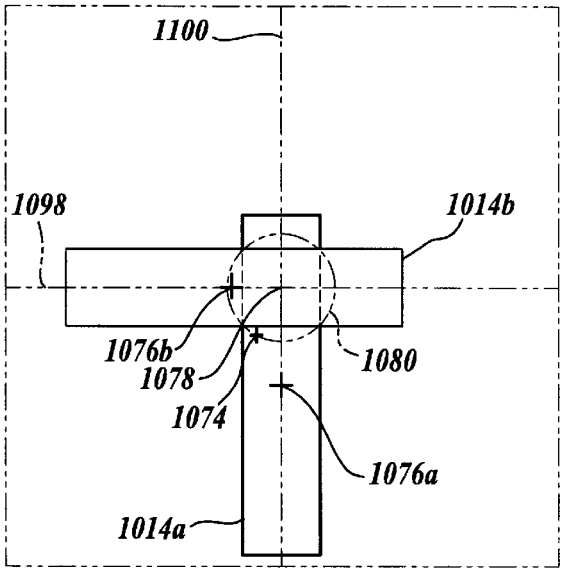
FIG. 39 is a diagrammatic elevation view of the crank-cam with attached first and second cylinder liners of FIG. 33; wherein the crank-cam has rotated 150° about the first axis of rotation from the position depicted in FIG. 33, showing the first vertically oriented cylinder liner as the liner moves linearly downward and the second horizontally oriented cylinder liner as it moves linearly to the right.
Figure 40:
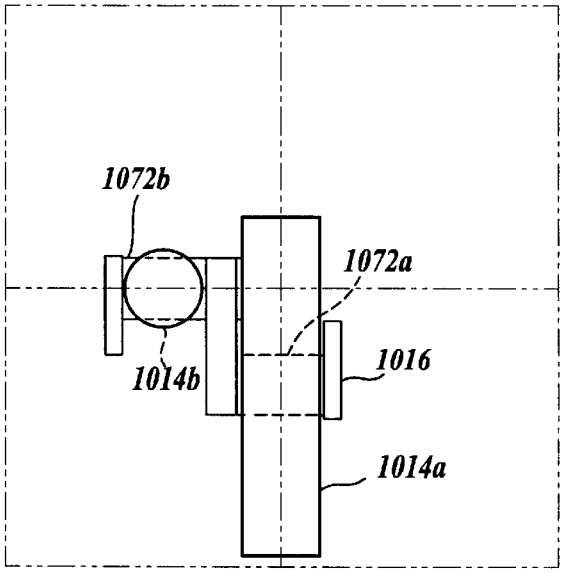
FIG. 40 is a diagrammatic side view of the crank-cam with attached first and second cylinder liners depicted in FIG. 39.

Referring now to FIGS. 39 and 40, the crank-cam with attached cylinder liners 1014*a* and 1014*b* are shown after the crank-cam has rotated 150° about the first axis of rotation 1074. Thus, cylinder liner 1014*a* is depicted as it moves linearly downward from its midway position depicted in FIGS. 37 and 38 and cylinder liner 1014*b* is shown as the cylinder liner 1014*b* travels right from its extended position depicted in FIGS. 37 and 38. As the crank-cam rotates clockwise about the first axis of rotation 1074 while the first axis of rotation 1074 simultaneously rotates counterclockwise along the circular orbit 1080 centered around the second axis of rotation 1078, crank-journal 1072*b* and its related cylinder liner 1014*b* moves linearly to the right along the horizontal path of travel 1098 of the cylinder liner 1014*b* to its midpoint position. Likewise, crank-journal 1072*a* and its related cylinder liner 1014*a* move linearly downward along the vertical path of travel 1100 of its related cylinder liner 1014*a* to the configuration shown in FIGS. 41 and 42.

Figure 41:
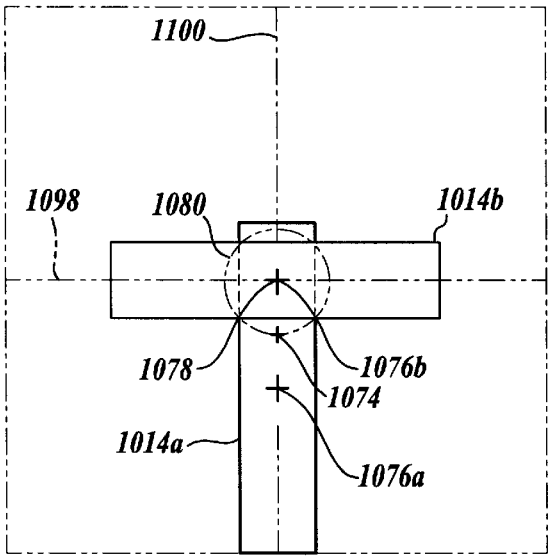
FIG. 41 is a diagrammatic elevation view showing the linear and rotary motion of a crank-cam with attached first and second cylinder liners; wherein the crank-cam has rotated 180° about a first axis of rotation from the position depicted in FIG. 33; showing the first vertically oriented cylinder in a fully extending position and the second horizontally oriented cylinder liner in a mid-stroke position.
Figure 42:
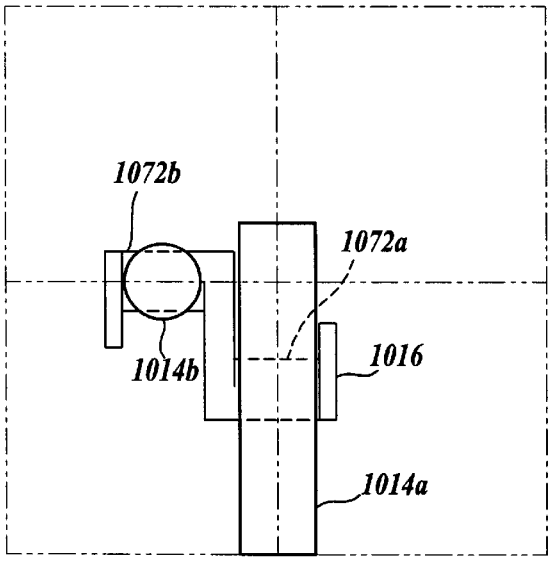
FIG. 42 is a diagrammatic side view of the crank-cam with attached first and second cylinder liners depicted in FIG. 41.

Referring to FIGS. 41 and 42, cylinder liner 1014*a* is depicted in a extended position, where the cylinder liner 1014*a* is in a TDC and BDC position relative to its two opposing pistons, while cylinder liner 1014*b* is depicted in a midpoint position, where the cylinder liner 1014*b* is equidistant from its respective opposing pistons. In this configuration, the second axis of rotation 1078 is collinear with the centerline of the crank journal of the cylinder liner 1014*b* and bisects the midpoint of the stroke length of cylinder liner 1014*b*. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the right along the horizontal path of travel 1098 of the cylinder liner 1014*b*. Likewise, crank-journal 1072*a* and its related cylinder liner 1014*a* move linearly upward along the vertical path of travel 100 of its related cylinder liner 1014*a* to the configuration shown in FIGS. 43 and 44.

Figure 43:
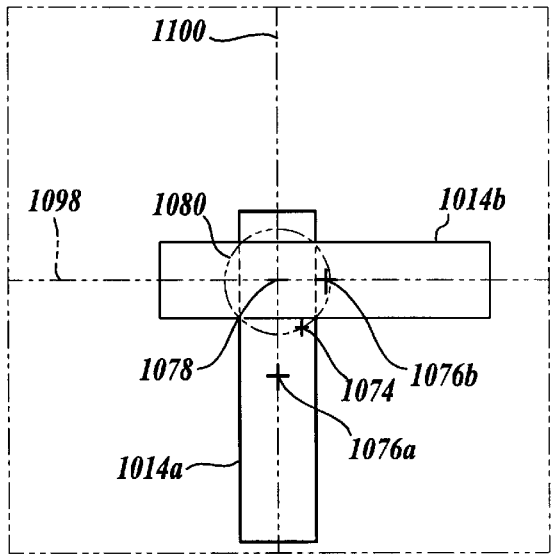
FIG. 43 is a diagrammatic elevation view of the crank-cam with attached first and second cylinder liners of FIG. 33; wherein the crank-cam has rotated 210° about a first axis of rotation from the position depicted in FIG. 33, showing the first vertically oriented cylinder liner as the liner moves linearly upward and the second horizontally oriented cylinder liner as it moves linearly to the right.
Figure 44:
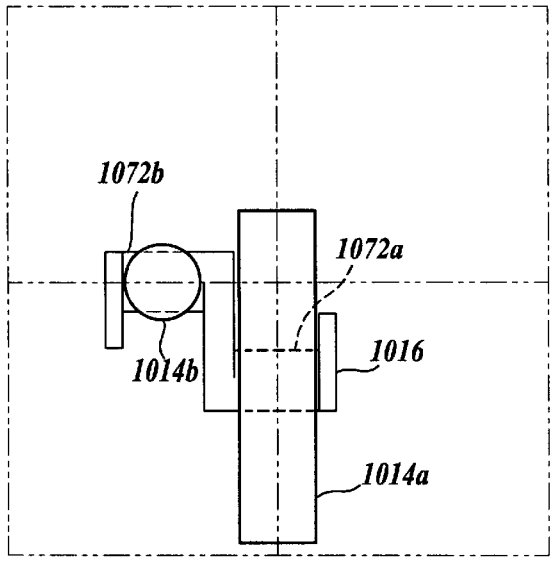
FIG. 44 is a diagrammatic side view of the crank-cam with attached first and second cylinder liners depicted in FIG. 43.

Referring to FIGS. 43 and 44, the crank-cam with attached cylinder liners 1014*a* and 1014*b* are shown after the crank-cam has rotated 210° about the first axis of rotation 1074. Thus, cylinder liner 1014*a* is depicted as it moves linearly upward and away from its extended position depicted in FIGS. 41 and 42 and cylinder liner 1014*b* is depicted as it travels right from the equidistant position depicted in FIGS. 41 and 42. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the right along the horizontal path of travel 1098 of the cylinder liner 1014*b*. Likewise, crank-journal 1072*a* and its related cylinder liner 1014*a* move linearly upward along the vertical path of travel 1100 of its related cylinder liner 1014*a* to the configuration shown in FIGS. 45 and 46.

Figure 45:
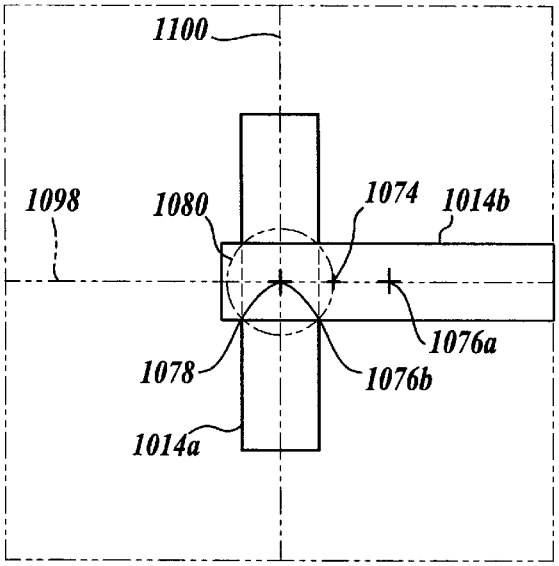
FIG. 45 is a diagrammatic elevation view of the crank-cam with attached first and second cylinder liners of FIG. 33; wherein the crank-cam has rotated 270° about the first axis of rotation from the position depicted in FIG. 33; showing the first vertically oriented cylinder line in a mid-stroke position and the second horizontally oriented cylinder liner in a fully extended position.
Figure 47:
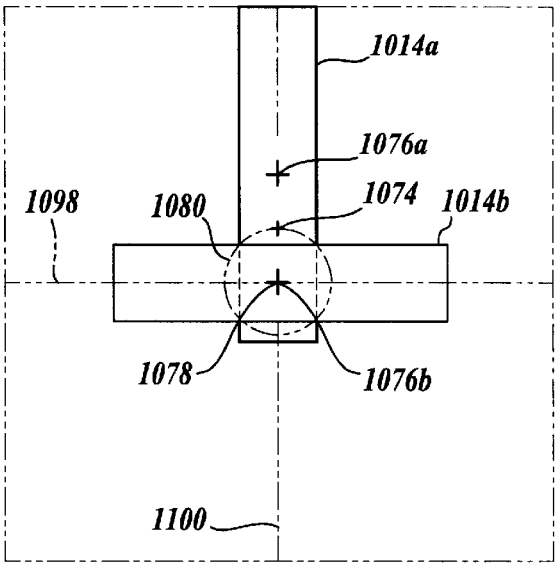
FIG. 47 is a diagrammatic elevation view of the crank-cam with attached first and second cylinder liners of FIG. 33; wherein the crank-cam has rotated 360° about the first axis of rotation from the position depicted in FIG. 33, showing the first vertically oriented cylinder liner in a fully extend position and the second horizontally oriented cylinder liner in a mid-stroke position.
Figure 46:
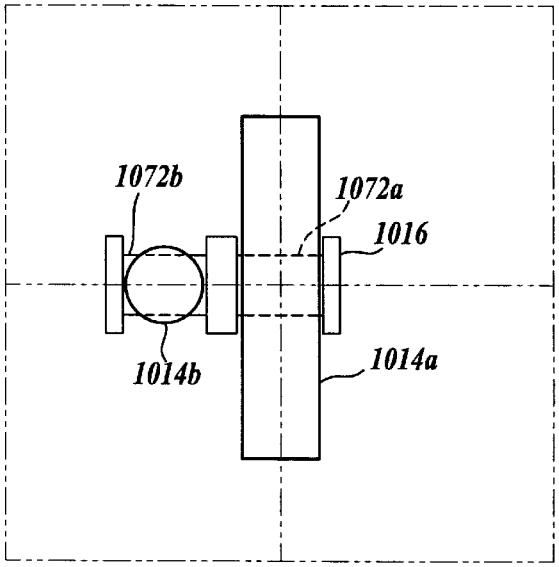
FIG. 46 is a diagrammatic side view of the crank-cam with attached first and second cylinder liners depicted in FIG. 45.
Figure 48:
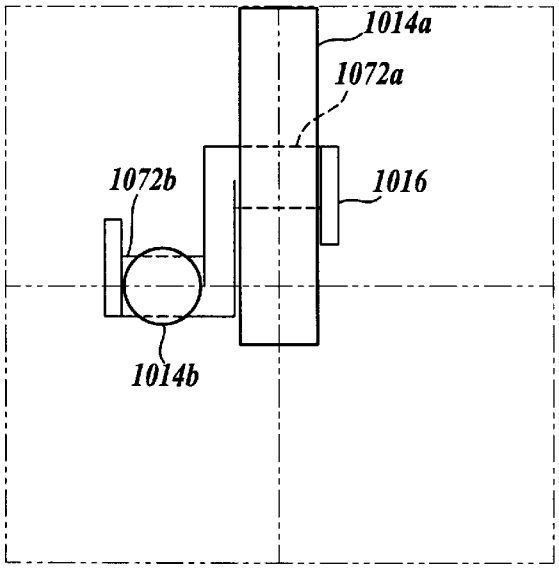
FIG. 48 is a diagrammatic side view of the crank-cam with attached first and second cylinder liners depicted in FIG. 47.

Referring now to FIGS. 45 and 46, the crank-cam with attached cylinder liners 1014*a* and 1014*b* are shown after the crank-cam has rotated 270° about the first axis of rotation 1074. Thus, cylinder liner 1014*b* is depicted in an extended position relative to its two opposing pistons, while cylinder liner 1014*a* is depicted in a midpoint position, where the cylinder liner 1014*b* is equidistant from its respective opposing pistons. In this configuration, the second axis of rotation 1078 is collinear with the centerline of the crank journal 1072*b* and bisects the midpoint of the stroke length of cylinder liner 1014*b*. As the crank-cam continues to rotate clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* change direction and now move linearly to the left along the horizontal path of travel 1098 of the cylinder liner 1014*b*. Crank-journal 1072*a* and its related cylinder liner 1014*a* continue to move linearly upward along the vertical path of travel 1100 of its related cylinder liner 1014*a* to the configuration shown in FIGS. 47 and 48, thus returning the engine to the configuration depicted in FIGS. 33 and 34, marking the completion of a single thermodynamic cycle relative to each piston.

Referring now to FIG. 28, the interrelationship between the crank-cam 1016 and the cylinder liners 1014*a* and 1014*b* will now be described in further detail. FIG. 28 depicts a fragmentary cross-section of a reciprocating internal combustion engine 1010 formed in accordance with the present invention. The cross-section is taken substantially along the longitudinal length of the crank-cam 1016. With the cross-section taken as such, the vertically oriented-cylinder liner 1014*a* is sectioned along the centerline of the cylinder liner 1014*a*. Inasmuch as cylinder liner 1014*b* is orientated normal to cylinder liner 1014*a*, and thus in a horizontal orientation, the cross-section passes laterally through cylinder liner 1014*b* midway between the ends of the cylinder liner 1014*b*. Cylinder liner 1014*a* is shown in a BDC configuration relative to piston 1012*a* (not shown) and in a TDC relationship relative to piston 1012*b*.

Cylinder liner 1014*b* is shown equidistant from its opposing pistons. With the crank-cam 1016 configured as such, the lobe 1054*a* associated with the crank journal 1072*a* has engaged the valve stem 1066*a* of the exhaust valve 1052 associated with piston 1012*a*, lifting the valve 1052 off of its seat 1034. The lobe 1054*b* associated with the crank journal 1072*b* of cylinder liner 1014*b* is shown equidistant between the valve stems of the opposing substantially stationary pistons. Inasmuch as cylinder liner 1014*b* is midpoint between the opposing pistons associated with the cylinder liner 1014*b*, the cylinder liner 1014*b* is not currently undergoing scavenging. Accordingly, the exhaust gas passageways 1037 in the engine block 1013 are not yet configured in fluid communication with the exhaust gas passageways 1036 (see FIG. 23) of the cylinder liner 1014*b*.

Figure 49:
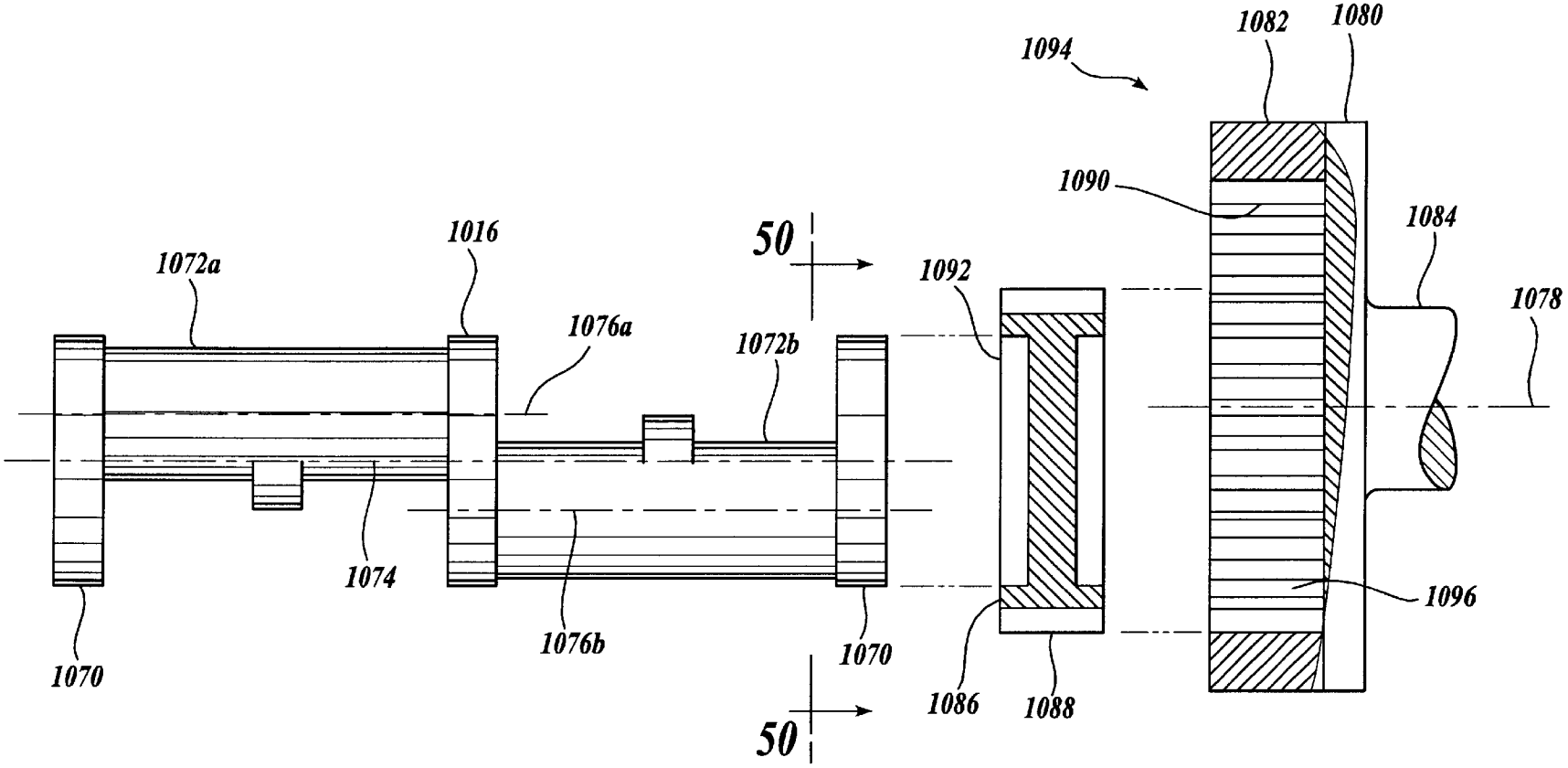
FIG. 49 is an exploded view of a crank-cam, out-drive gear, out-drive reduction gear, and power take-off flange, suitable for use with the illustrated embodiment of the present invention, wherein the out-drive gear is shown in cross-section and the out-drive reduction gear is shown with a partial cut-away.

Referring now to FIG. 49, the components of an out-drive system 1094 will now be described. The out-drive system 1094 translates the reciprocating and rotational motion of the crank-cam 1016 to rotational motion about a centerline of a power take-off shaft 1084. The out-drive system 1094 includes an out-drive reduction gear 1082 and an out-drive gear 1086. The out-drive reduction gear 1082 further includes internal gear teeth 1090 disposed along the peripheral cylindrical wall of an out-drive gear receiving recess 1096. The out-drive reduction gear 1082 is rigidly coupled to a power take-off drive flange 1080 by well-known means, such as fasteners. The power take-off shaft 1084 is perpendicularly and concentrically attached to the power take-off drive flange 1080. The centerline of the power take-off shaft 1084 is collinear with the second axis of rotation 1078. The out-drive gear 1086 has external gear teeth 1088 shaped and dimensioned to communicate with the internal gear teeth 1090 of the out-drive reduction gear 1082. The out-drive gear 1086 has a crank web 1070 receiving recess 1092 shaped and dimensioned to receive the circular shaped crank web 1070. The crank web 1070 is rigidly coupled to the receiving recess 1092 of the out-drive gear 1086 by means well known in the art, such as by fasteners.

In light of the above description of the components of the out-drive system 1094, the operation of the out-drive system 1094 will now be described. Referring to FIGS. 50–55, a letter A is used as an arbitrarily selected reference point on the out-drive gear 1086 and a letter B is used as an arbitrarily selected reference point on the out-drive reduction gear 1082. A reference letter C marks the center point of crank journal 1072*b*, and thus the cylinder liner 1014*b* (not shown), and reference letter D marks the centerpoint of the crank journal 1072*a* and thus the cylinder liner 1014*a* (not shown).

Figure 50:
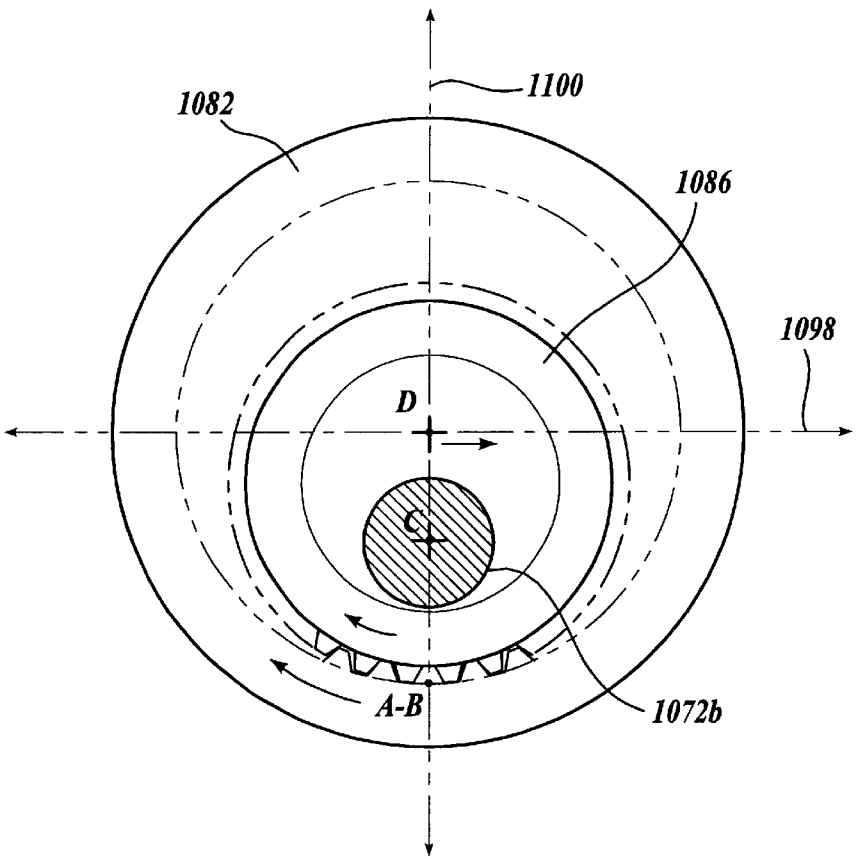
FIG. 50 is a planar cross-sectional end view of the out-drive gear, out-drive reduction gear, power take-off flange, and crank-cam shown in FIG. 49, taken substantially through SECTION 50—50 of FIG. 49.

Referring now to FIG. 50, the out-drive gear 1086 is disposed within the out-drive reduction gear 1082, so that the external gear teeth 1088 of the out-drive gear 1086 intermesh with the internal gear teeth 1090 of the out-drive reduction gear 1082. As the out-drive reduction gear 1082 and the out-drive gear 1086 rotate clockwise while intermeshing, reference point D on the out-drive gear 1086 reciprocates along a horizontal reference line 1098. The reference line 1098 represents the linear path of the cylinder liner 1014*b* (not shown) and is the same reference line depicted in FIGS. 33–48. Likewise, reference point C reciprocates along a vertical reference line 1100. Vertical reference line 1100 represents the linear path of the cylinder liner 1014*a* (not shown) and is the same reference dine depicted in FIGS. 33–48. As the out-drive reduction gear 1082 and out-drive gear 1086 rotate clockwise, reference point D moves to the right and reference point C moves upward, along their reference lines 1098 and 1100, respectively.

Figure 51:
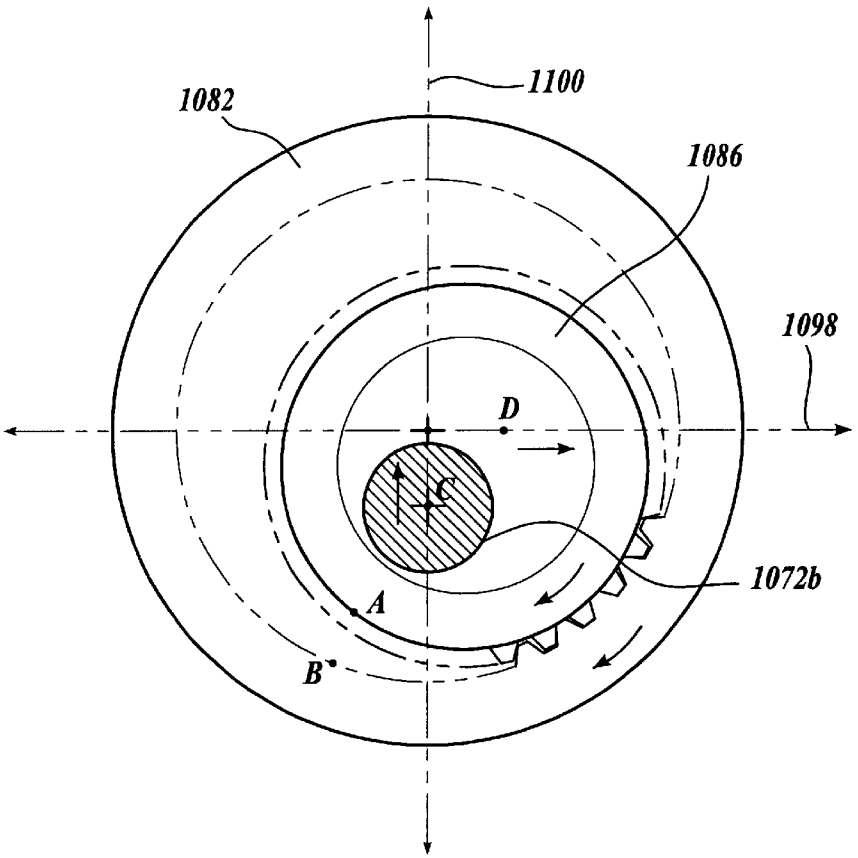
FIG. 51 is a planar end view of the crank-cam, out-drive gear, out-drive reduction gear, and power take-off flange shown in FIG. 49, wherein the out-drive reduction gear has rotated 1/16 of a turn from its position depicted in FIG. 49.

Referring now to FIG. 51, the out-drive gear 1086 has rotated one-eighth of a turn clockwise while the out-drive reduction gear 1082 has rotated one-sixteenth of a turn clockwise from the configuration depicted in FIG. 50. As is apparent from reference to FIG. 51, reference points C and D still lie upon their respective reference lines 1100 and 1098, thereby maintaining the linear path of travel of the centers of the crank journals and, thus, their attached cylinder liners.

Figure 52:
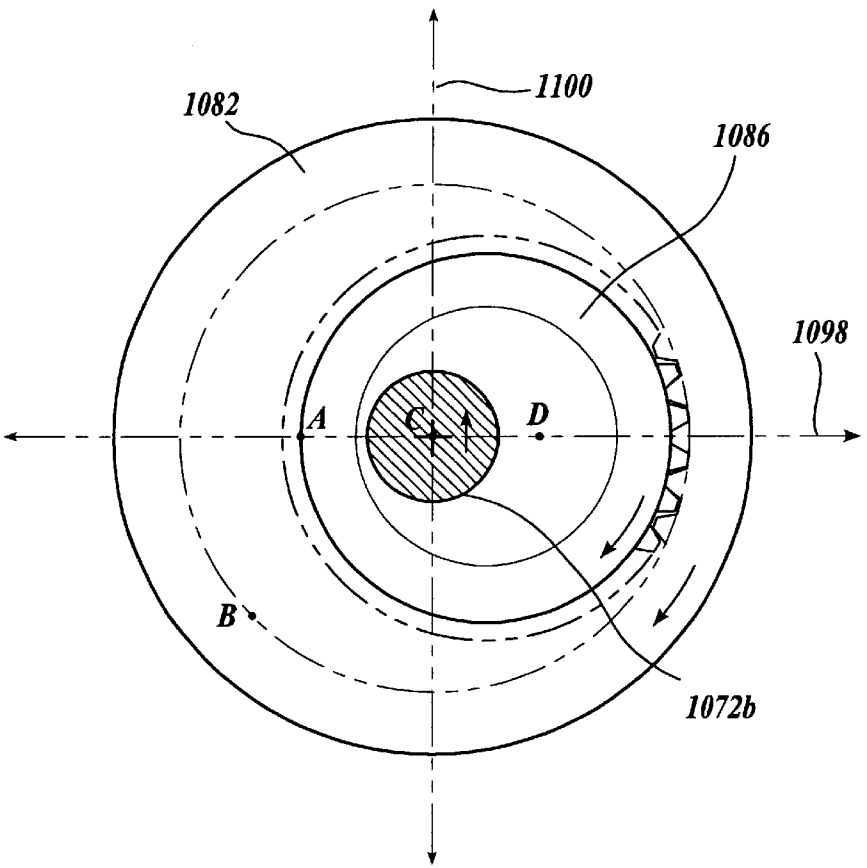
FIG. 52 is a planar end view of the crank-cam, out-drive gear, out-drive reduction gear, and power take-off flange shown in FIG. 49, wherein the out-drive reduction gear has rotated 1/8 of a turn from its position depicted in FIG. 49.

Referring to FIG. 52, the out-drive gear 1086 has now rotated one-quarter of a turn clockwise, while the out-drive reduction gear 1082 has rotated one-eighth of a turn clockwise from the configuration depicted in FIG. 50. By referring to FIG. 52, it is apparent that reference point C has moved vertically upward along the linear reference line 1100, while reference point D has moved horizontally to the right along the horizontal reference line 1098 from their respective positions depicted in FIG. 51. Reference point D is currently at its "zenith"; therefore the respective cylinder liner is in an extended position, with the cylinder liner at a TDC and BDC position with reference to the substantially stationary opposing pistons associated with the cylinder liner. As the out-drive gear 1082 is rotated further clockwise, reference point D transitions from a rightward direction of travel to a leftward direction of travel along the reference line 1098.

Figure 53:
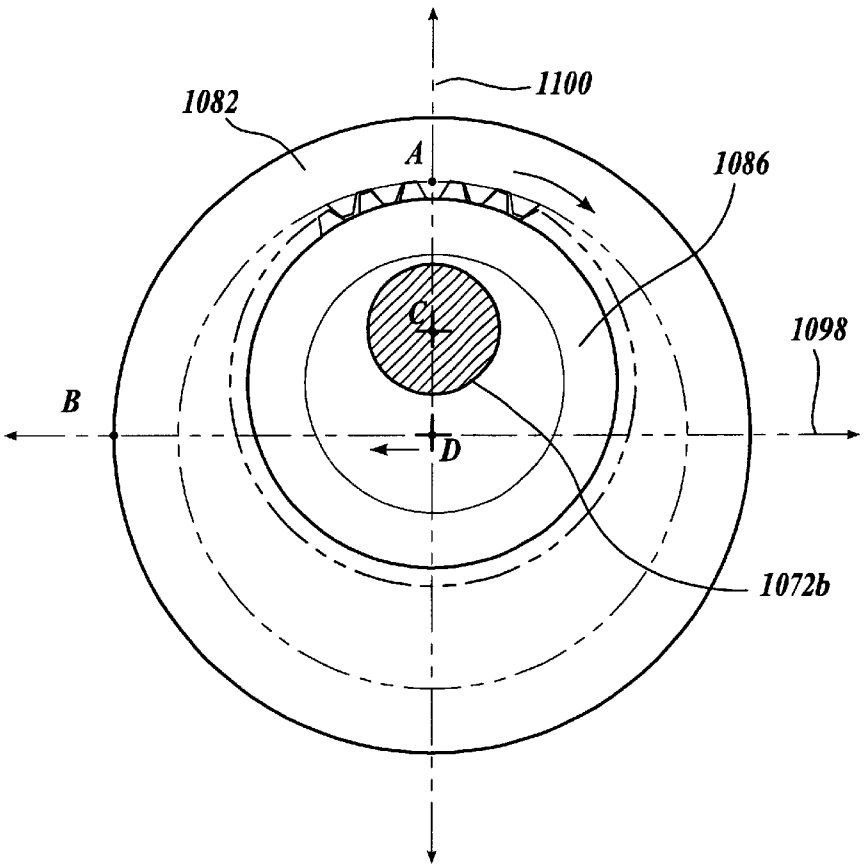
FIG. 53 is a planar end view of the crank-cam, out-drive gear, out-drive reduction gear, and power take-off flange shown in FIG. 49, wherein the out-drive reduction gear has rotated 1/4 of a turn from its position depicted in FIG. 49.

Referring now to FIG. 53, the out-drive gear 1086 has rotated one-half turn and the out-drive reduction gear 1082 has rotated one-quarter turn. Reference point C is now at its zenith; therefore the corresponding cylinder liner is in an extended position with the cylinder liner at its TDC and BDC position with respect to the two substantially stationary opposing pistons associated with the cylinder liner. As the out-drive gear 1082 is rotated further clockwise, reference point C transitions from a upward direction of travel to a downward direction of travel along the reference line 1100.

Figure 54:
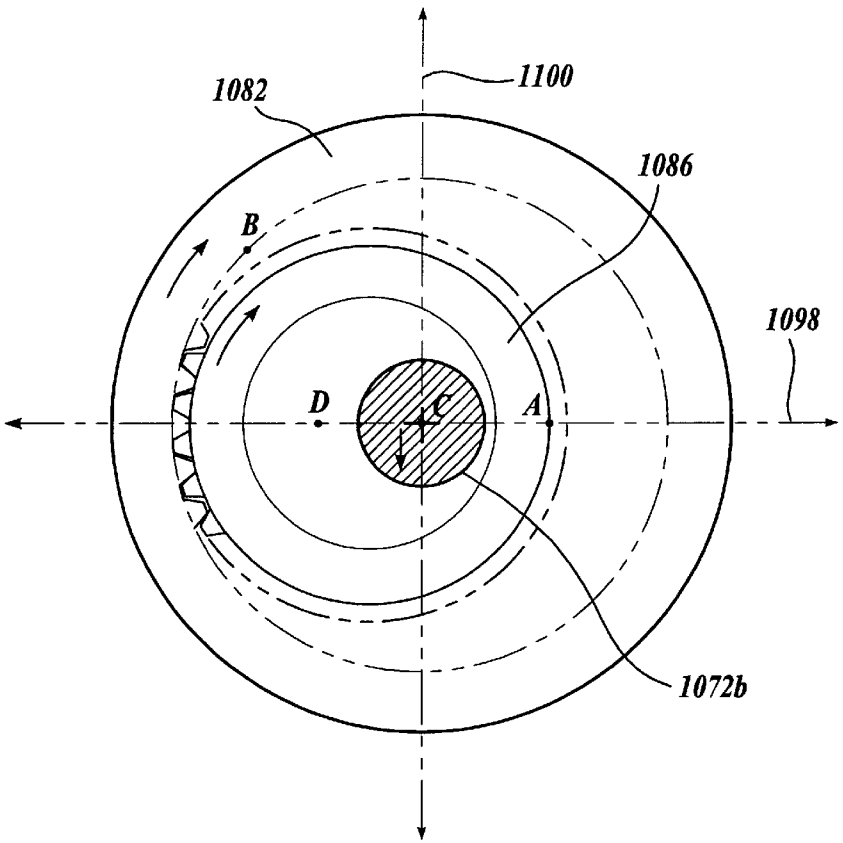
FIG. 54 is a planar end view of the crank-cam, out-drive gear, out-drive reduction gear, and power take-off flange shown in FIG. 49, wherein the out-drive reduction gear has rotated 3/8 of a turn from its position depicted in FIG. 49.

Referring now to FIG. 54, the out-drive gear 1086 has rotated three-quarters of a turn. The out-drive reduction gear 1082 has rotated three-eighths of a turn. Reference point C is now at the center of the reference path 1100. This center position indicates that the cylinder liner associated with reference point C is now equidistant from the substantially stationary pistons associated with the cylinder liner. Correspondingly, reference point D is now at a zenith. Therefore, the cylinder liner associated with reference point D is at an extended position and thus, at a TDC and BDC position with regard to the substantially stationary opposing pistons associated with the cylinder liner.

Figure 55:
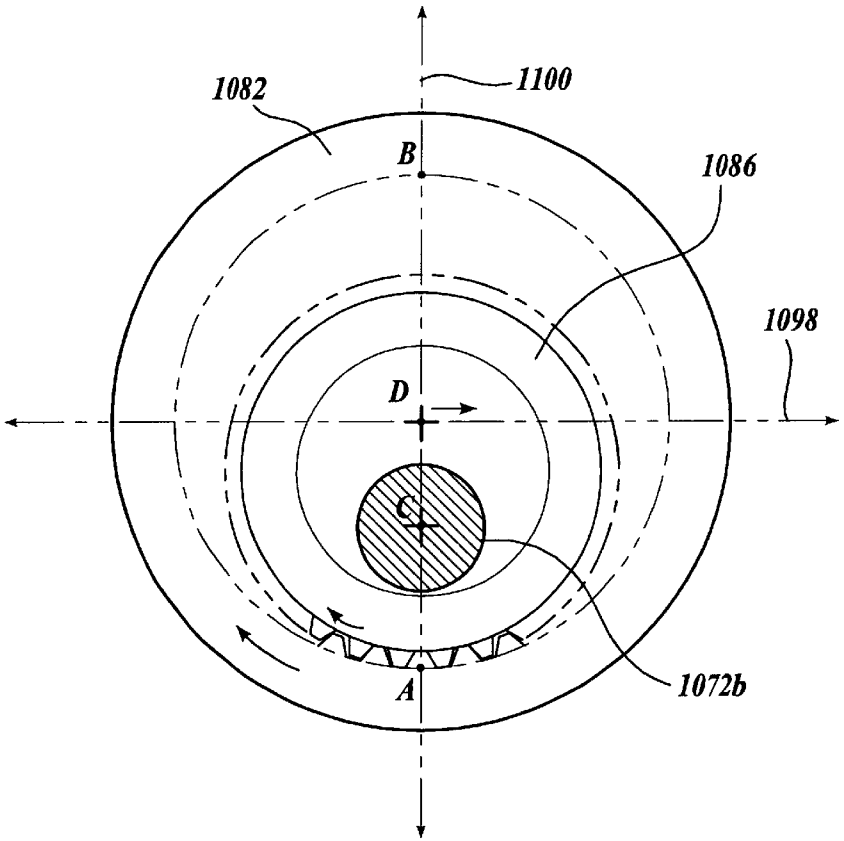
FIG. 55 is a planar end view of the crank-cam, out-drive gear, out-drive reduction gear, and power take-off flange shown in FIG. 49, wherein the out-drive reduction gear has rotated 1/2 of a turn from its position depicted in FIG. 49.

Referring now to FIG. 55, the out-drive gear 1086 has rotated one full turn while the out-drive reduction gear 1082 has rotated one-half turn, as indicated by the relative positions of the reference points A and B. In one full rotation of the out-drive gear 1086, each individual piston has gone through one complete thermodynamic cycle. Through the manipulation of diameters and the possible amount of gear teeth involved, different reduction ratios of engine RPM to power take-off shaft 1084 RPM are possible as should be apparent to one skilled in the art. In the illustrated embodiment depicted in FIGS. 50–55, the out-drive gear 1086 has 30 teeth and the out-drive reduction gear 1082 has 40 teeth. In one 360° rotation of the out-drive gear 1086, the out-drive gear 1086 cams 60 teeth of the out-drive reduction gear 1082. The out-drive reduction gear 1082 has 40 teeth, therefore it rotates in the process the distance of 20 teeth, which results in a 180° rotation of the out-drive reduction gear 1082 and attached shaft. Thereby a ratio of 2:1 reduction in RPM is accomplished.

Figure 58:
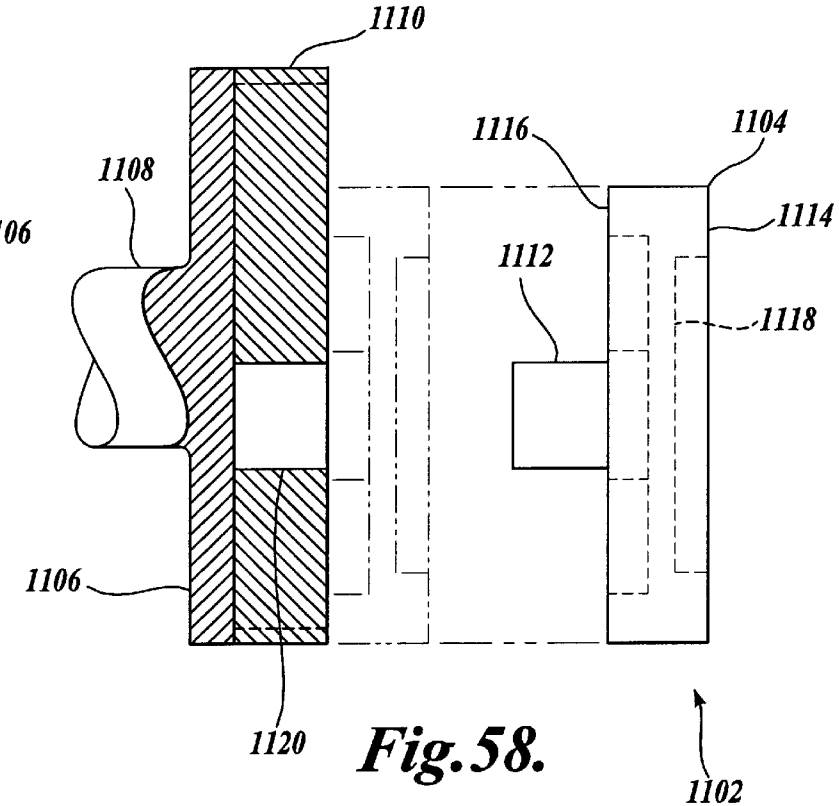
FIG. 58 is an exploded side view of the direct out-drive and the gliding block shown in FIG. 56, and in addition showing a direct out-drive adapter.
Figure 56:
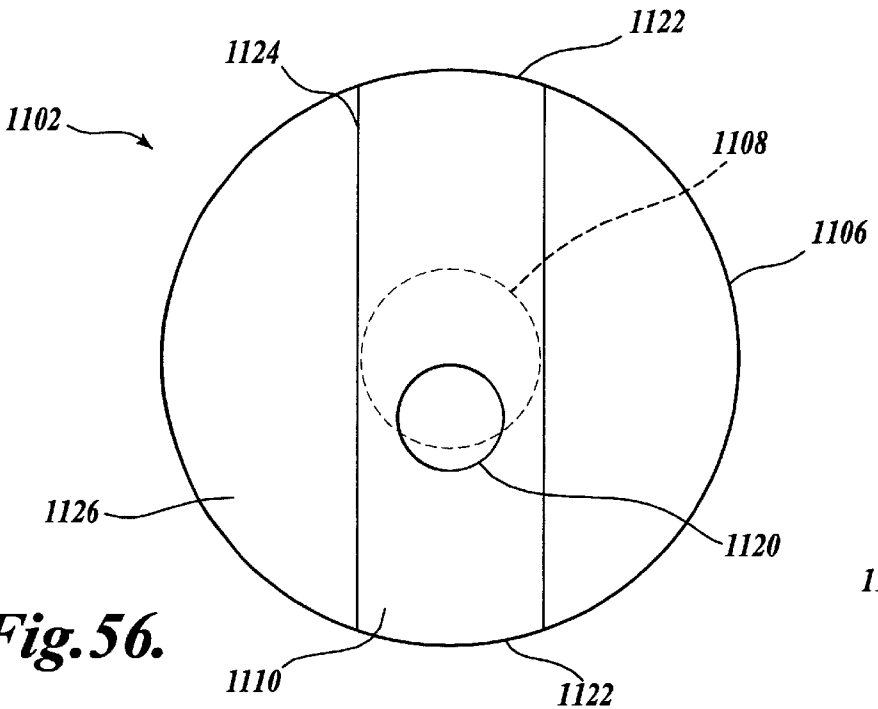
FIG. 56 is a planar end view of a direct out-drive and a gliding block formed in accordance with the present invention.
Figure 57:
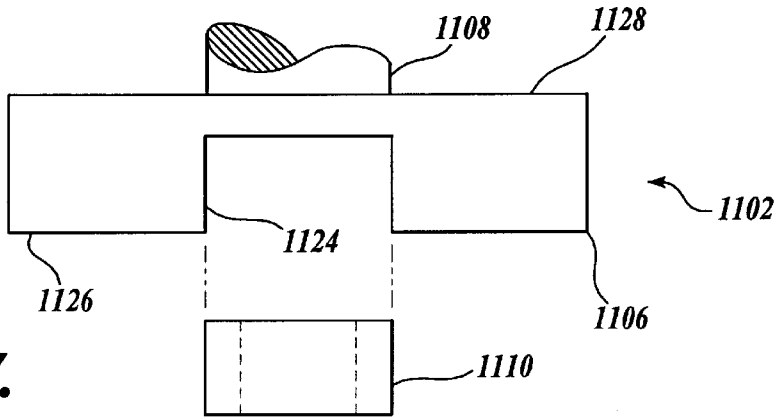
FIG. 57 is an exploded top view of the direct out-drive and the gliding block shown in FIG. 56.

Often it is desirable to have a direct out-drive shaft that rotates at the same RPM as the engine or more specifically, at the crank-cam RPM. The direct out-drive shaft may be used to drive accessories, such as a distributor. Referring to FIGS. 56–58, a direct out-drive system 1102 formed in accordance with and suitable for use with the present invention is illustrated. The direct out-drive system 1102 includes a direct out-drive adapter 1104, a direct out-drive 1106, a direct out-drive shaft 1108, and a gliding block 1110. These components work in combination to convert the rotating and reciprocating motion of the crank-cam to a rotational movement in the direct out-drive output shaft 1108.

The configuration of the direct out-drive adapter 1104 will now be discussed. The direct out-drive adapter 1104 is a disk-shaped member having inner (facing the engine) and outer (facing away from the engine) annular surfaces 1114 and 1116, respectively. Formed adjacent to the inner annular surface 1114 is a crank web receiving recess 1118 where one of the crank webs 1070 (see FIG. 31) is received and rigidly fastened therewithin. Perpendicularly and concentrically mounted relative to the outer annular surface 1116 is a drive shaft 1112. The drive shaft 1112 is received within a bore 1120 located within the gliding block 1110.

The configuration of the gliding block 1110 will now be discussed. The gliding block 1110 is generally a rectangular-shaped block structure having arcuate ends 1122 formed to match the outer circular circumference of the direct out-drive 1106. The length and width of the gliding block 1110 is selected to match the length and width of a channel 1124 formed in the direct out-drive 1106, thereby allowing the gliding block 1110 to be received within the channel 1124. Preferably, a polished finish is applied to the contact surfaces of both the gliding block 1110 and the channel 1124 of the direct out-drive 1116 of which it rides within, to reduce friction and wear.

The direct out-drive 1106 is a disk-shaped member having inner (facing the engine) and outer (facing away from the engine) circular planar surfaces 1126 and 1128, respectively. The channel 1124 for receiving the gliding block 1110 is formed on the inner planar surface 1126. A direct drive output shaft 1108 is perpendicularly and concentrically mounted on the outer planar surface 1128.

Figure 59:
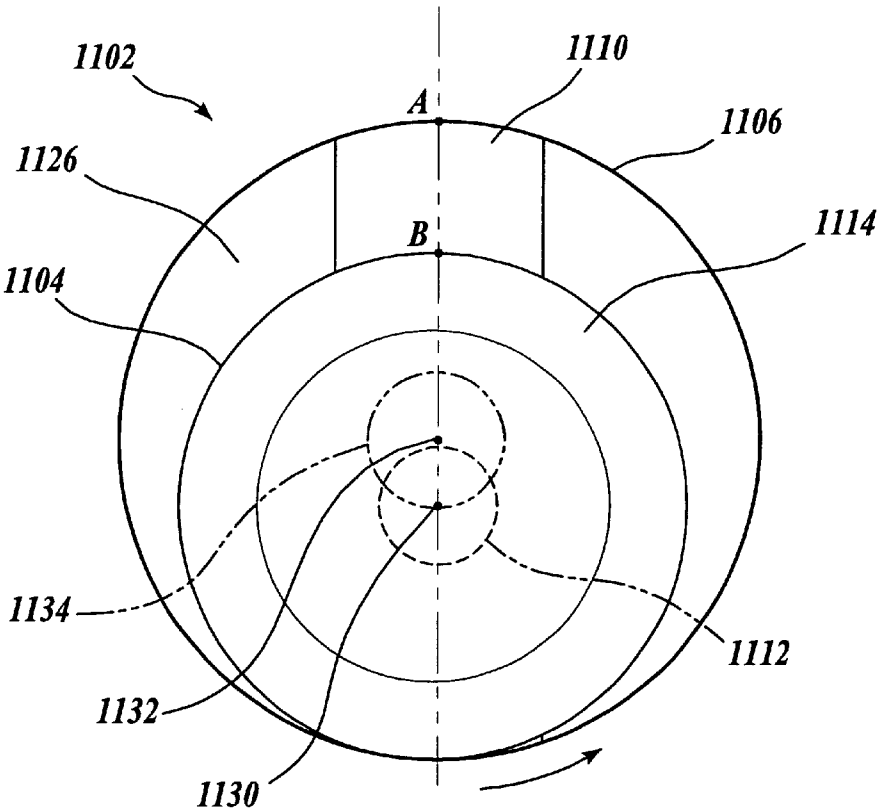
FIG. 59 is a planar end view of the direct out-drive, gliding block, and direct out-drive adapter shown in FIG. 58.

The operation of the direct out-drive system 1102 will now be described in reference to FIGS. 59–62. Referring now to FIG. 59, a planar end view of the direct out-drive system 1102 is shown, depicting the inner planar surface 1114 of the direct out-drive adapter 1104 with the crank-cam removed and the inner circular planar surface 1126 of the direct out-drive 1106. The drive shaft 1112 of the adapter 1104 is shown in phantom. The gliding block 1110 is shown; however the majority of the gliding block 1110 is obscured by the adapter 1104. The letter A is an arbitrarily selected reference point on the outer circumference of the direct out-drive 1106, and the letter B is an arbitrarily selected reference point on the direct out-drive adapter 1104.

Still referring to FIG. 59, the center of the direct out-drive adapter 1104 is indicated by reference numeral 1130. The center of the direct out-drive 1106 is indicated by reference numeral 1132. The direct out-drive adapter 1104 rotates about its center 1130, while also revolving around the center 1132 of the direct out-drive 1106 along a circular orbit 1134, the circular orbit 1134 having a radius equal to ¼ of the stroke length.

Figure 60:
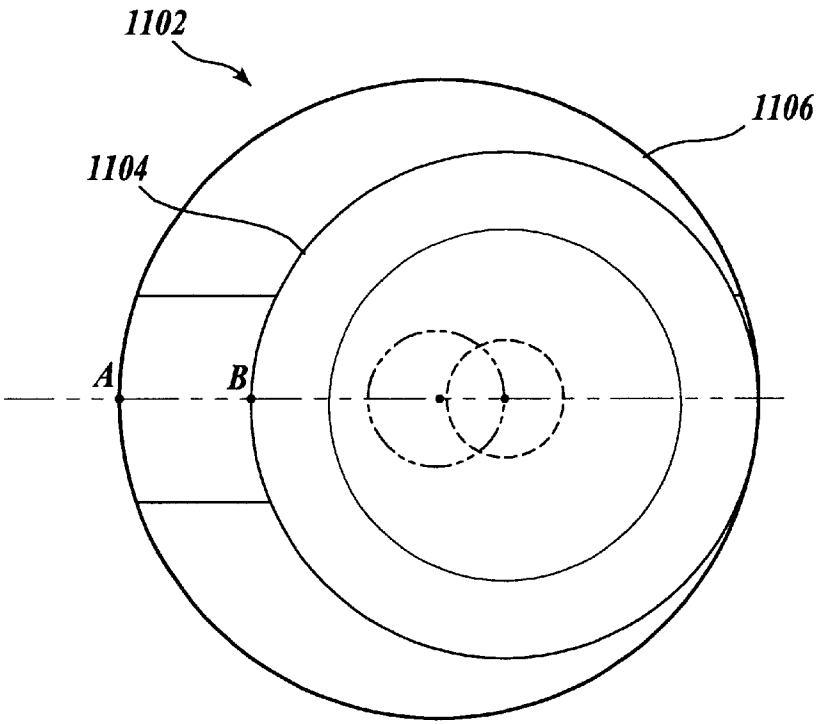
FIG. 60 is a planar end view of the direct out-drive, gliding block, and out-drive adapter shown in FIG. 59, where the direct out-drive has rotated 90° from its position depicted in FIG. 59.
Figure 62:
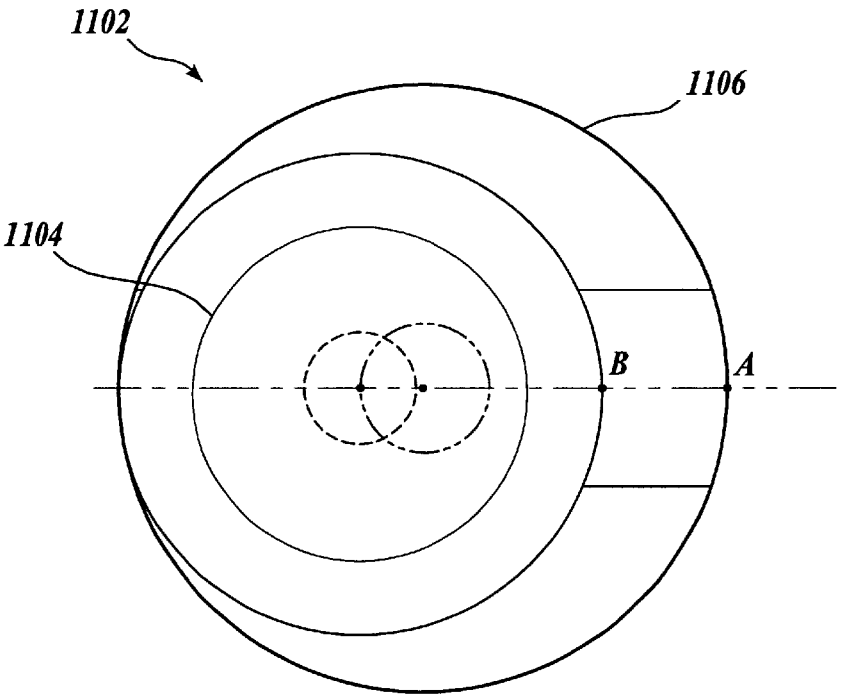
FIG. 62 is a planar end view of the direct out-drive, gliding block, and out-drive adapter shown in FIG. 59, where the direct out-drive has rotated 270° from its position depicted in FIG. 59.
Figure 61:
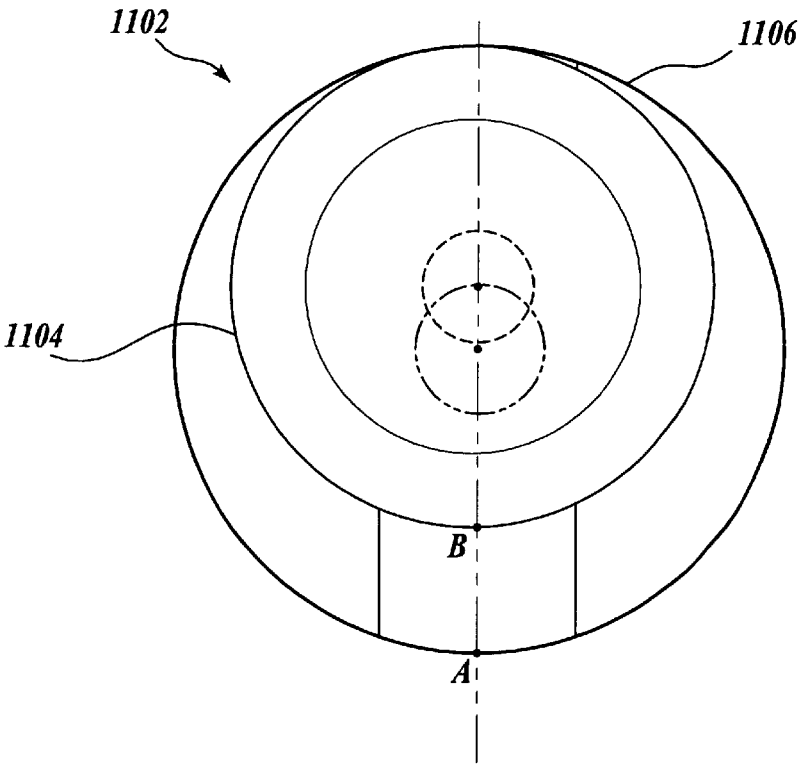
FIG. 61 is a planar end view of the direct out-drive, gliding block, and out-drive adapter shown in FIG. 59, where the direct out-drive has rotated 180° from its position depicted in FIG. 59.

FIG. 60 shows the direct out-drive system 1102 rotated ¼ of a turn counterclockwise from that depicted in FIG. 59. FIG. 61 shows the direct out-drive system 1102 rotated ½ of a turn counterclockwise from that depicted in FIG. 59. FIG. 62 shows the direct out-drive system 1102 rotated ¾ of a turn counterclockwise from that depicted in FIG. 59. Inasmuch as the reference letters A and B remain radially aligned during the rotation of the direct out-drive adapter 1104 and direct out-drive 1106, as shown in FIGS. 59–62, it should be apparent to one skilled in the art that both the adapter 1104 and the direct out-drive 1106 rotate at the same rate. Therefore, the direct out-drive output shaft 1108 (see FIG. 58) may be used to drive components requiring rotary input rotating at engine RPM.

From examination of FIGS. 59–62, it appears that the sliding block 1110 does not move during operation. This would be true if the parts of the engine were constructed so as to have zero tolerances. However, in the event the ports are constructed so as to be within selected tolerances, as is typically the case, the sliding block 1110 would undergo slight movements within the channel 1124, thereby "absorbing" the tolerances of the parts, mitigating vibration and reducing the potential of the parts' binding.

Figure 63:
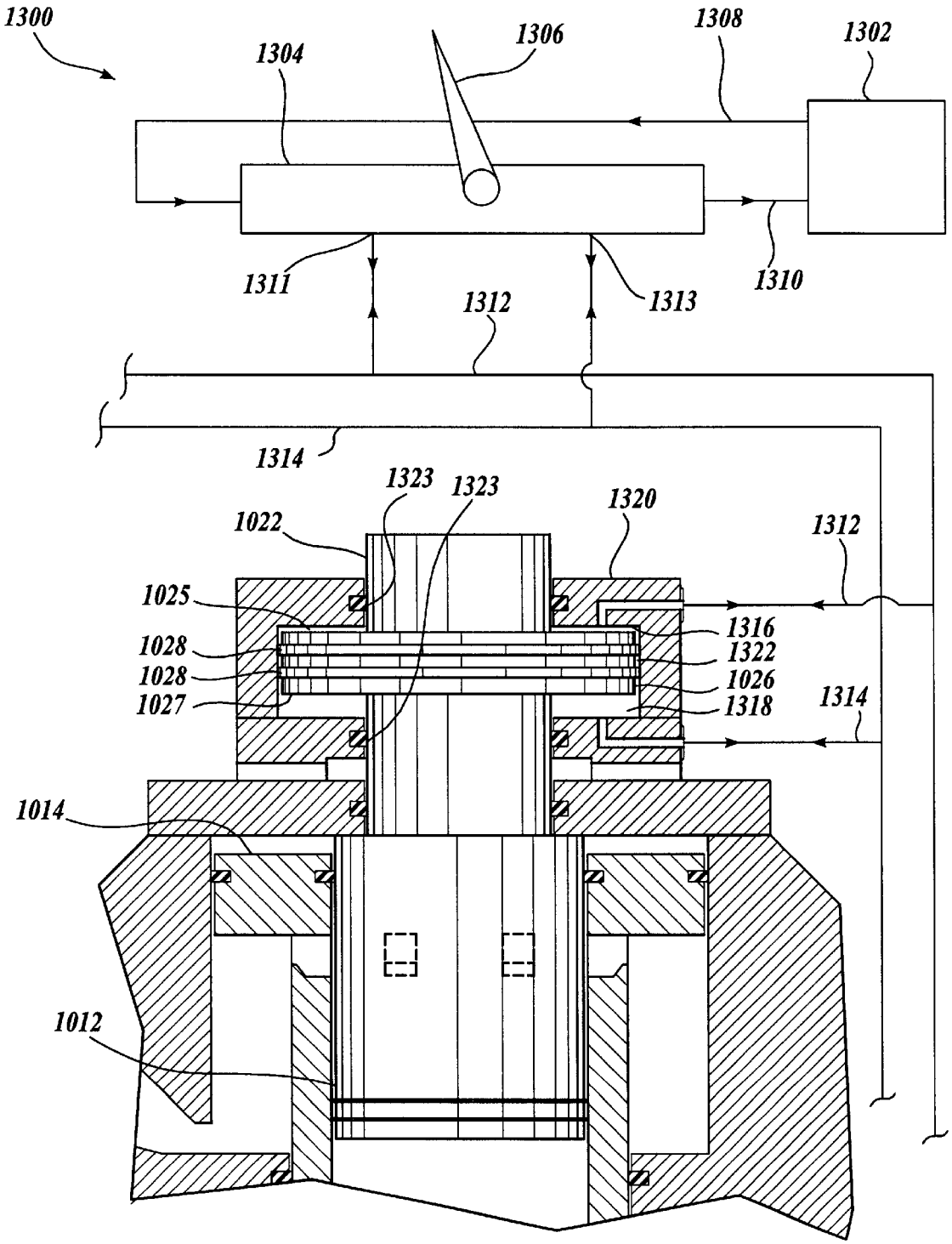
FIG. 63 is a diagrammatic fragmentary view of one embodiment of a compression ratio and power setting control system formed in accordance with the present invention.
Figure 64:
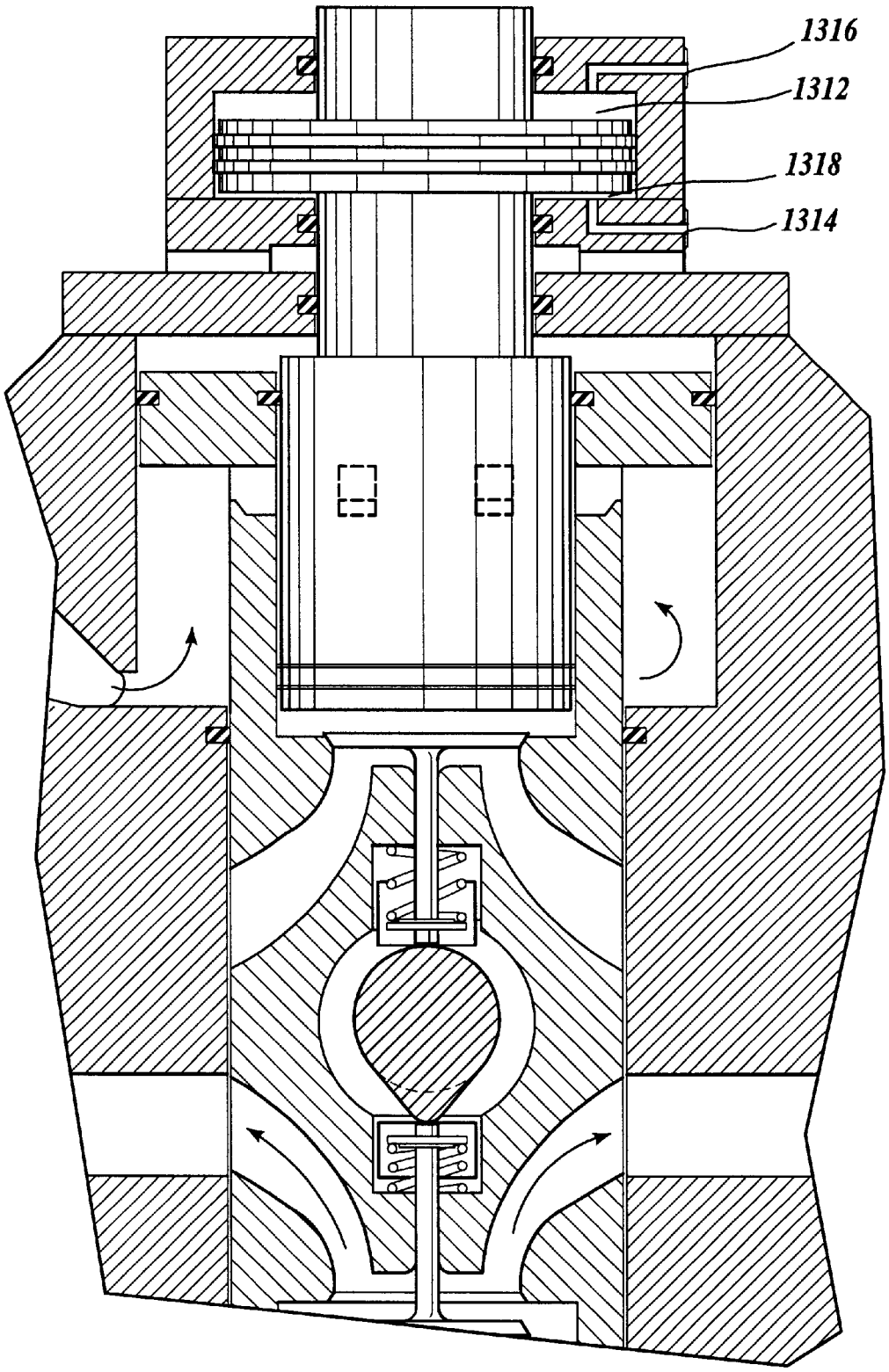
FIG. 64 is a fragmentary cross-sectional view of one of the reciprocating cylinder liners and related components shown in FIG. 21, illustrating the reciprocating cylinder liner at a TDC position with respect to a substantially stationary piston configured in its high compression ratio, low power setting position.

Referring now to FIG. 63, the compression ratio and power setting control system 1300 of the illustrated embodiment of the present invention will now be described. The control system 1300 allows the compression ratio and power setting of the engine to be simultaneously adjusted during operation. More specifically, under low boost conditions, the control system 1300 allows the engine to be selectively configured to have a low compression ratio, such as 10:1 at a high power setting (full throttle), and a high compression ratio, such as 15:1 at a low power setting (idle). Under high boost conditions, the control system 1300 allows the engine to be selectively configured to have a low compression ratio, such as 5.6:1 at a high power setting (full throttle), and a high compression ratio, such as 15:1 at a low power setting (idle). The control system 1300 controls the compression ratio and power setting of the engine by selectively manipulating the axial position of the substantially stationary pistons 1012 of the engine, as will be described more fully below. In the illustrated embodiment, the axial position of the pistons is adjusted by selectively providing pressurized fluid to either the upper or lower annular surfaces 1025 and 1027 of the control plate 1026 circumferentially attached to the piston 1012, thereby forcing the piston 1012 to move axially along its axis.

The major components of the control system 1300 include a hydraulic pump 1302, a control valve 1304, the control plate 1026, and a control plate housing 1320. The hydraulic pump 1302 is coupled in fluid flow communication with the control valve 1304 by a feed line 1308 and a return line 1310. The hydraulic pump 1302 may be any suitable device known in the art for providing a pressurized control fluid. In operation, the hydraulic pump 1302 discharges pressurized control fluid, such as a hydraulic oil, through the feed line 1308 to the control valve 1304. Likewise, the return line 1310 returns spent control fluid back to the hydraulic pump 1302 for re-pressurization.

The control valve 1304 selectively controls the flow of control fluid to the control plate housing 1320, thereby allowing the selective manipulation of the axial position of the substantially stationary piston 1012. The control valve 1304 is actuatable between three positions. In a first position, the pressurized control fluid obtained from the hydraulic pump 1302 via the feed line 1308 is delivered to a first port 1311, while a second port 1313 is configured to be in fluid communication with the return line 1310 of the hydraulic pump 1302. In a second position, the flow is reversed, and the pressurized control fluid obtained from the hydraulic pump 1302 via the feed line 1308 is delivered to the second port 1313, while the first port 1311 is configured to be in fluid communication with the return line 1310 of the hydraulic pump 1302. In a third position, the control valve 1304 is placed in a no flow position, wherein the control fluid is blocked from being received or discharged from the ports 1311 and 1313. The control valve is actuated among the three positions by any suitable means known in the art, such as a lever 1306. Preferably, the position of the lever 1306 is controlled in direct relationship to a position of a power setting device, such a throttle or a gas pedal.

The control plate housing 1320 includes a cylindrical cavity 1322 that houses the control plate 1026. The control plate bisects the cavity 1322 into an upper chamber 1316 and a lower chamber 1318, wherein oil control rings 1028 circumferentially disposed on the edge of the control plate 1026 allow the upper and lower chambers 1316 and 1318 to be independently pressurized. Additional oil control rings 1323 prevent any pressurized fluid contained within the cavity 1322 from escaping therefrom. Upper chamber piping 1312 couples the upper chamber 1316 associated with each piston 1012 in fluid communication with the first port 1311 of the control valve 1304. Lower chamber piping 1314 couples the lower chamber 1316 associated with each piston 1012 in fluid communication with the second port 1313 of the control valve 1304.

In light of the above description of the elements of the compression ratio and power setting control system 1300, the operation will now be described. Still referring to FIG. 63, when the control valve 1304 is placed in the first position, pressurized fluid obtained from the hydraulic pump 1302 is directed into the upper chamber 1316. The pressurized fluid acts upon the upper annular surface 1025 of the control plate 1026, thereby forcing the control plate 1026 and rigidly attached piston 1012 downward along the axis of the piston 1012 and into the position depicted in FIG. 64. Conversely, when the control valve 1304 is placed in the second position, pressurized fluid obtained from the hydraulic pump 1302 is directed into the lower chamber 1318. The pressurized fluid acts upon the lower annular surface 1027 of the control plate 1026, thereby forcing the control plate 1026 and rigidly attached piston 1012 upward along the axis of the piston 1012, transferring the piston from the configuration depicted in FIG. 64 to that depicted in FIG. 63.

Manipulation of the axial position of the piston 1012 adjusts the compression ratio of the engine. More specifically, the stroke length of the cylinder liner 1014 remains constant. Therefore, by adjusting the axial position of the piston 1012, the distance between the crown of the piston 1012 and the opposing inner surface of the cylinder liner 1014 is reduced at TDC. Therefore, substantially the same volume of combustion gases is compressed into a relatively smaller final volume when the cylinder liner reaches a TDC position relative to the piston, thereby raising the compression ratio as should be apparent to one skilled in the art. For example, referring to FIG. 64 in comparison to FIG. 25, both of which are depicted at a TDC position relative to the shown piston 1012, it should be apparent to one skilled in the art that the final volume of combustion chamber is substantially reduced in FIG. 64, as compared to FIG. 25, thereby resulting in a high compression ratio in FIG. 64 and a relatively lower compression ratio in FIG. 25.

Figure 65:
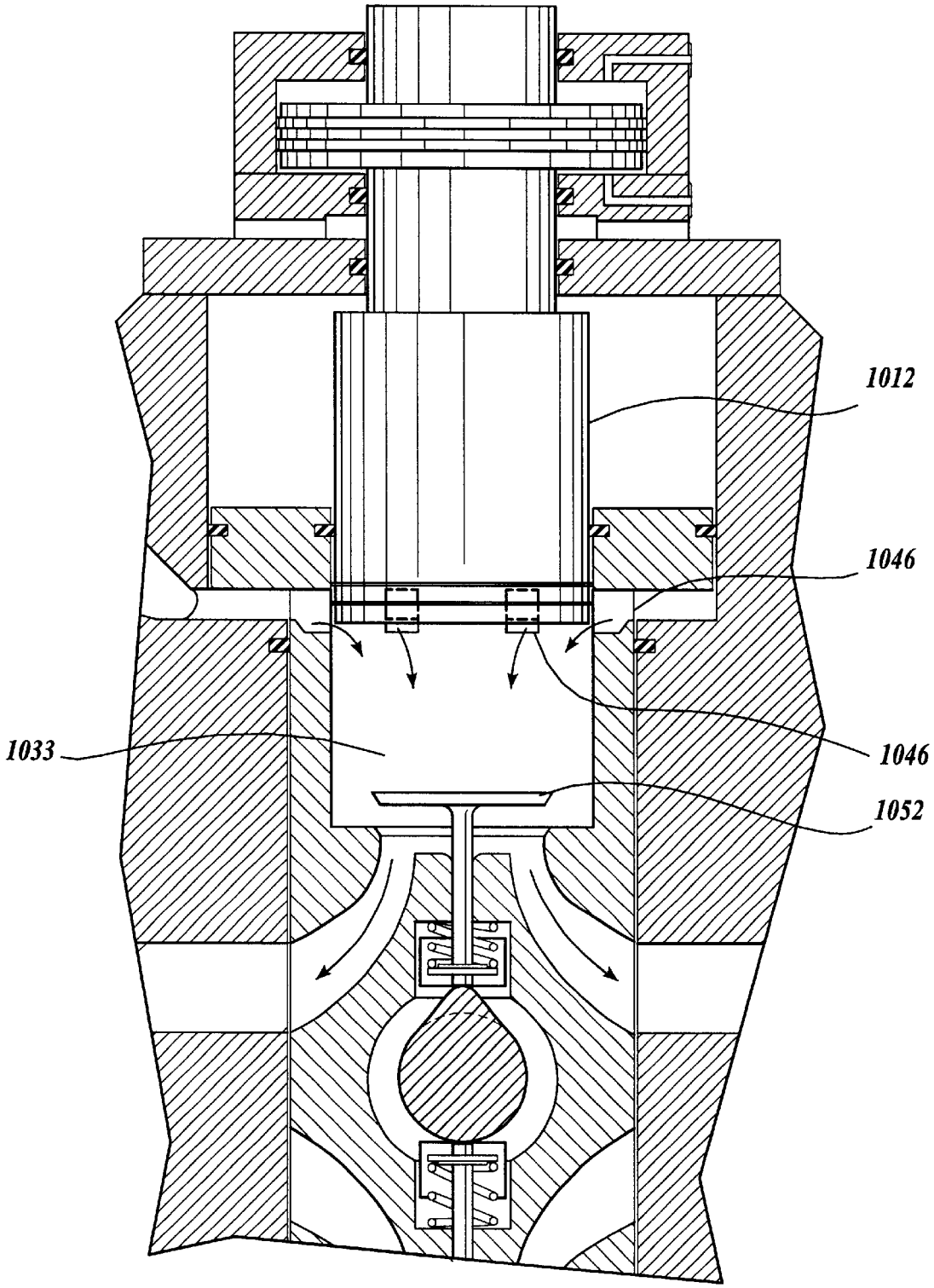
FIG. 65 is a fragmentary cross-sectional view of one of the reciprocating cylinder liners and related components shown in FIG. 21, illustrating the reciprocating cylinder liner at a BDC position with respect to a substantially stationary piston configured in its high compression ratio, low power setting position.

Referring to FIG. 65, manipulation of the axial position of the piston 1012 also simultaneously adjusts the power setting of the engine. More specifically, by adjusting the axial position of the piston 1012, the degree to which the intake ports 1046 are in fluid communication with the combustion chamber 1033 is selectively controlled in both duration and surface area. By controlling the degree to which the intake ports 1046 are in fluid communication with the combustion chamber 1033, the volume of combustion gases delivered to the combustion chamber 1033 is controlled, in an analogous manner to a butterfly valve in a carburetor of a conventional naturally aspirated engine.

Referring to FIG. 65 in comparison to FIG. 27, the power setting or throttle effect realized by the manipulation of the axial position of the piston 1012 can be readily understood by one skilled in the art. Referring to FIG. 65, the piston 1012 is shown in a high compression, low power setting configuration with the cylinder liner 1014 depicted in a BDC position. As shown in FIG. 65, the intake ports 1046 are partially blocked by the piston 1012 when the liner is at BDC. Referring now to FIG. 27, the cylinder liner 1014 is also at BDC. However, the intake ports 1046 are now fully exposed, since the piston 1012 has been moved axially away from the cylinder liner 1014 relative to the piston 1012 position depicted in FIG. 65. By moving the piston 1012 downward to partially block the intake ports 1046, both the surface area of the intake ports 1046 and the duration of which the intake ports 1046 are in fluid communication with the combustion chamber 1033 is substantially reduced. By reducing the degree of which the intake ports 1046 are in fluid communication with the combustion chamber 1033, the volume of combustion gases drawn into the combustion chamber 1033 is thereby reduced, thus throttling the engine to a lower power setting. As should be apparent to one skilled in the art, the engine may be shut down by fully blocking the intake ports 1046. As should also be apparent to one skilled in the art, adjustment of the axial position of the piston also manipulates the timing of the intake process.

Although the above detailed description of the control system 1300 describes a hydraulic system for initiating piston 1012 movement, it should be apparent to one skilled in the art that other methods of actuating the pistons 1012 are suitable for use with the present invention. For example, the pistons 1012 may be actuated by an electromagnetic system or by mechanical means, such as where a cam is rotated to selectively position the pistons 1012.

Like all internal combustion engines, the illustrated reciprocating internal combustion engine 1010 produces large amounts of heat during operation, most of it as a result of the combustion process, additional heat being generated by the compression of the gases within the cylinder liners and the friction between the moving parts of the engine 1010. Temperatures within the engine 1010 are kept under control by a cooling system that circulates coolant through passages in the engine block and around critical parts to remove excess heat and to equalize stresses produced by heating. Inasmuch as the design and components of internal combustion engine cooling systems are well known in the art, the cooling passages in the engine and cooling system components are not shown for the purpose of clarity.

The illustrated embodiment of the reciprocating internal combustion engine of the present invention also contains a lubricating system. The lubricating system reduces the friction and wear between the moving parts of the engine. Inasmuch as the design and components of internal combustion engine lubricating systems are well known in the art, the oil passages in the engine and lubricating system components are not shown for the purpose of clarity.

Although the illustrated embodiment is described for use with a gasoline-based fuel source, it should be apparent to one skilled in the art that the engine is also suitable for use with other combustible fuel sources, such as diesel. For example, for use with diesel, the engine may be modified in a manner well known in the art, such as replacing the spark plug with fuel injectors and increasing the compression ratio of the engine to raise the temperature of the compressed combustion gases to that above the ignition temperature of the diesel fuel contemplated for use.

It should be apparent to one skilled in the art that all known systems of carburetion, fuel injection, or additional use of turbochargers, compressors, and blowers can be used on this engine, necessary or not. Also, all known types of ignition systems, lubrication systems, cooling systems, emission control systems, and other engine-related systems known in the art are suitable for use with the engine of the present invention and, therefore, are within the scope of the present invention.

It should also be apparent to one skilled in the art that although the illustrated embodiment depicts a four-cylinder variant of the present invention, engines having other quantities of cylinders are suitable for use with the present invention and therefore within the scope of the present invention.

While the illustrated embodiment of the invention has been illustrated and described, it will be appreciated that various changes can be made therein without departing from the spirit and scope of the invention.

The embodiments of the invention in which an exclusive property or privilege is claimed are defined as follows:

1. An internal combustion engine having an adjustable compression ratio comprising:

(a) a housing;

(b) a first piston assembly adjustably coupled to the housing;

(c) a first cylinder reciprocatingly disposed within the housing, wherein the first cylinder reciprocates relative to the first piston assembly during operation of the internal combustion engine; and (d) a compression ratio adjustment mechanism in communication with the first piston assembly and adaptable to adjust the compression ratio of the internal combustion engine during operation.

2. The internal combustion engine of claim 1, wherein the compression ratio adjustment mechanism communicates with the first piston assembly to adjust a spacing of the first piston assembly relative the first cylinder to adjust the compression ratio of the internal combustion engine.

3. The internal combustion engine of claim 1, further comprising:

(a) an exhaust valve in fluid communication with the first cylinder; and (b) a crankshaft coupled to the first cylinder, wherein the crankshaft comprises a lobe for actuating the exhaust valve between an open position and a closed position.

4. The internal combustion engine of claim 1, further comprising a first intake port located in the first cylinder and operable to deliver a gas into the first cylinder, wherein the compression ratio adjustment mechanism is adaptable to adjust the first piston assembly to position the first piston assembly to selectively impede passage of the gas through the first intake port.

5. The internal combustion engine of claim 1, further comprising:

(a) a second piston assembly coupled to the housing so as to oppose the first piston assembly; and (b) a second cylinder coupled to the first cylinder, wherein the first and second cylinders reciprocate relative to the first and second piston assemblies during operation of the internal combustion engine.

6. The internal combustion engine of claim 5, further comprising:

(a) a third piston assembly coupled to the housing so as to oppose a fourth piston assembly coupled to the housing; and (b) a third cylinder coupled to a fourth cylinder, wherein the third and fourth cylinders reciprocate relative to the third and fourth piston assemblies during operation of the internal combustion engine and reciprocate substantially orthogonally relative to the first and second cylinders.

7. The internal combustion engine of claim 1, further comprising a crankshaft at least partially disposed within the housing and coupled to the first cylinder for transferring energy from the internal combustion engine to a power take-off assembly attachable to the crankshaft.

8. The internal combustion engine of claim 7, further comprising a sliding member that slidingly engages the power take-off assembly and interconnects the power take-off assembly to the crankshaft.

9. The internal combustion engine of claim 7, wherein the crankshaft rotates about a first axis of rotation and a second axis of rotation.

10. The internal combustion engine of claim 1, further comprising a crankshaft at least partially disposed within the housing and coupled to the first cylinder and a reduction for transferring energy from a component of the internal combustion engine to the reduction system.

11. The internal combustion engine of claim 10, wherein the reduction system adjusts a first rotation rate of the crankshaft to a second rotation rate of an output member coupled to the reduction system.

12. The internal combustion engine of claim 10, wherein the reduction system further comprises a first power transfer device coupled to the crankshaft and a second power transfer device coupled to the output member, wherein the first power transfer device rotates within the second power transfer device.

13. The internal combustion engine of claim 1, further comprising:

(a) an intake chamber; and (b) a gas compression apparatus coupled to the first cylinder, wherein when the first cylinder reciprocates in a first direction, the gas compression apparatus passes through the intake chamber, thereby compressing a gas contained therewithin.

14. The internal combustion engine of claim 13, the first cylinder further comprising a combustion chamber defined by an inner cavity of the first cylinder and the first piston assembly, wherein a maximum volume of the intake chamber is equal to or greater than a maximum volume of the combustion chamber.

15. The internal combustion engine of claim 13, further comprising an intake port in fluid communication with the intake chamber and the first cylinder for allowing a gas compressed by the gas compression apparatus to be released into the first cylinder.

16. The internal combustion engine of claim 1, further comprising a first intake port located in the first cylinder, wherein the first intake port is operable to deliver a gas into the first cylinder for an adjustable duration of time, wherein the compression ratio adjustment mechanism communicates with the first piston assembly to adjust the duration of time.

17. The internal combustion engine of claim 1, wherein the compression ratio adjustment mechanism actuates the first piston assembly between a first position, arranging the internal combustion engine in a high compression ratio and a low power setting configuration, and a second position, arranging the internal combustion engine in a low compression ratio and a high power setting configuration.

18. The internal combustion engine of claim 1, wherein the internal combustion engine is a two-stroke cycle internal combustion engine.

19. An internal combustion engine having a compression ratio comprising:

(a) a housing;

(b) a first piston assembly adjustably coupled to the housing;

(c) a first cylinder reciprocatingly disposed within the housing, wherein the first cylinder reciprocates relative to the first piston assembly during operation of the internal combustion engine;

(d) an exhaust valve in fluid communication with the first cylinder; and (e) a reciprocating and rotating mechanism coupled to the first cylinder, wherein the reciprocating and rotating mechanism comprises a lobe for actuating the exhaust valve between an open position and a closed position.

20. The internal combustion engine of claim 19, further comprising a compression ratio adjustment mechanism in communication with the first piston assembly and adaptable to adjust the compression ratio of the internal combustion engine during operation.

21. The internal combustion engine of claim 19, wherein the compression ratio adjustment mechanism communicates with the first piston assembly to adjust a spacing of the first piston assembly from the first cylinder.

22. The internal combustion engine of claim 21, wherein the compression ratio adjustment mechanism communicates with the first piston assembly to adjust the compression ratio of the internal combustion engine in response to a position of a throttle.

23. The internal combustion engine of claim 19, wherein the compression ratio adjustment mechanism actuates the first piston assembly between a first position, arranging the internal combustion engine in a high compression ratio and a low power setting configuration, and a second position, arranging the internal combustion engine in a low compression ratio and a high power setting configuration.

24. The internal combustion engine of claim 19, further comprising a first intake port located in the first cylinder and operable to deliver a gas into the first cylinder, wherein the compression ratio adjustment mechanism communicates with the first piston assembly to position the first piston assembly to selectively impede passage of the gas through the first intake port.

25. The internal combustion engine of claim 19, further comprising:

(a) a second piston assembly coupled to the housing so as to oppose the first piston assembly; and (b) a second cylinder coupled to the first cylinder, wherein the first and second cylinders reciprocate relative to the first and second piston assemblies during operation of the internal combustion engine.

26. The internal combustion engine of claim 25, further comprising:

(a) a third piston assembly coupled to the housing so as to oppose a fourth piston assembly coupled to the housing; and (b) a third cylinder coupled to a fourth cylinder, wherein the third and fourth cylinders reciprocate relative to the third and fourth piston assemblies and substantially orthogonally relative to the first and second cylinders during operation of the internal combustion engine.

27. The internal combustion engine of claim 19, further comprising a reciprocating and rotating mechanism at least partially disposed within the housing and coupled to the first cylinder for transferring energy from the internal combustion engine to a power take-off assembly in communication with the reciprocating and rotating mechanism.

28. The internal combustion engine of claim 27, further comprising a sliding member that slidingly engages the power take-off assembly and interconnects the power take-off assembly to the reciprocating and rotating mechanism.

29. The internal combustion engine of claim 27, wherein the reciprocating and rotating mechanism rotates about two axes of rotation.

30. The internal combustion engine of claim 19, further comprising a reciprocating and rotating mechanism at least partially disposed within the housing and coupled to the first cylinder and a reduction system for transferring energy from a component of the internal combustion engine to the reduction system.

31. The internal combustion engine of claim 30, wherein the reduction system adjusts a first rotation rate of the reciprocating and rotating mechanism to a second rotation rate of an output member of the reduction system.

32. The internal combustion engine of claim 30, wherein the reduction system further comprises a drive device coupled to the reciprocating and rotating mechanism and a driven device coupled to the output member, wherein the drive device rotates within the driven device.

33. The internal combustion engine of claim 19, further comprising:

(a) an intake chamber; and (b) a gas compression apparatus coupled to the first cylinder, wherein when the first cylinder reciprocates in a first direction, the gas compression apparatus passes through the intake chamber compressing a gas contained therewithin.

34. The internal combustion engine of claim 33, further comprising an intake port in fluid communication with the intake chamber and the first cylinder for allowing the gas compressed by the gas compression apparatus to be released into the first cylinder.

35. The internal combustion engine of claim 19, further comprising a first intake port located in the first cylinder, wherein the first intake port is operable to deliver a gas into the first cylinder for an adjustable duration of time, wherein the compression ratio adjustment mechanism communicates with the first piston assembly to selectively adjust the duration of time that the first intake port is operable to deliver the gas into the first cylinder.

36. The internal combustion engine of claim 19, wherein the internal combustion engine is a two-stroke cycle internal combustion engine.

37. An internal combustion engine having an adjustable compression ratio comprising:

(a) a housing;

(b) a first piston assembly and a second piston assembly, wherein the first and second piston assemblies are adjustably coupled to the housing to permit adjustment of the compression ratio during operation of the internal combustion engine; and (c) a first cylinder liner mounted within the housing, wherein the first cylinder liner is operable to be reciprocated between the first and second piston assemblies.

38. The internal combustion engine of claim 37, wherein the cylinder liner is disposed within the housing such that a portion of the first piston assembly is received within a first end of the cylinder liner and a portion of the second piston assembly is received within a second end of the cylinder liner.

39. The internal combustion engine of claim 37, further comprising a compression ratio adjustment mechanism in communication with the first piston assembly and adaptable to adjust the compression ratio of the internal combustion engine during operation.

40. The internal combustion engine of claim 39, wherein the compression ratio adjustment mechanism communicates with the first piston assembly to adjust a spacing of the first piston assembly relative to the first cylinder liner to adjust the compression ratio of the internal combustion engine.

41. The internal combustion engine of claim 37, further comprising:

(a) an exhaust valve in fluid communication with the first cylinder liner; and (b) a reciprocating and rotating mechanism coupled to the first cylinder liner, wherein the reciprocating and rotating mechanism comprises a lobe for actuating the exhaust valve between an open position and a closed position.

42. The internal combustion engine of claim 37, further comprising a first intake port located in the first cylinder liner and operable to deliver a gas into the first cylinder liner, wherein the compression ratio adjustment mechanism is adaptable to adjust the first piston assembly to selectively impede passage of the gas through the first intake port.

43. The internal combustion engine of claim 37, further comprising:

(a) a third piston assembly coupled to the housing so as to oppose a fourth piston assembly coupled to the housing; and (b) a second cylinder liner, wherein the second cylinder liner reciprocates relative to the third and fourth piston assemblies and substantially orthogonally relative to the second cylinder liner during operation of the internal combustion engine.

44. The internal combustion engine of claim 37, further comprising a reciprocating and rotating mechanism at least partially disposed within the housing and coupled to the first cylinder liner for transferring energy from the internal combustion engine to a power take-off assembly in communication with the reciprocating and rotating mechanism.

45. The internal combustion engine of claim 44, further comprising a sliding member that slidingly engages the power take-off assembly and interconnects the power take-off assembly to the reciprocating and rotating mechanism.

46. The internal combustion engine of claim 37, further comprising a reciprocating and rotating mechanism at least partially disposed within the housing and coupled to the first cylinder for transferring energy from a component of the internal combustion engine to the reduction system.

47. The internal combustion engine of claim 46, wherein the reduction system adjusts a first rotation rate of the reciprocating and rotating mechanism to a second rotation rate of an output member of the reduction system.

48. The internal combustion engine of claim 46, wherein the reduction system further comprises a drive device coupled to the reciprocating and rotating mechanism and a driven device coupled to the output member, wherein the drive device rotates within the driven device.

49. The internal combustion engine of claim 37, further comprising:

(a) an intake chamber; and (b) a gas compression apparatus coupled to the first cylinder liner, wherein when the first cylinder liner reciprocates in a first direction, the gas compression apparatus passes through the intake chamber, thereby compressing a gas contained therewithin.

50. The internal combustion engine of claim 49, the first cylinder liner further comprising a combustion chamber defined by an inner cavity of the first cylinder liner and the first piston assembly, wherein a maximum volume of the intake chamber is equal to or greater than a maximum volume of the combustion chamber.

51. The internal combustion engine of claim 50, further comprising an intake port in fluid communication with the intake chamber and the first cylinder liner for allowing the gas compressed by the gas compression apparatus to be released into the first cylinder liner.

52. The internal combustion engine of claim 37, further comprising a first intake port located in the first cylinder liner, wherein the first intake port is operable to deliver a gas into the first cylinder liner for an adjustable duration of time, wherein the compression ratio adjustment mechanism communicates with the first piston assembly to position the first piston assembly to adjust the duration of time.

53. The internal combustion engine of claim 39, wherein the compression ratio adjustment mechanism communicates with the first piston assembly to adjust a spacing of the first piston assembly from the first cylinder.

54. The internal combustion engine of claim 39, wherein the compression ratio adjustment mechanism communicates with the first piston assembly to adjust the compression ratio of the internal combustion engine in response to a position of a power setting device.

55. The internal combustion engine of claim 39, wherein the compression ratio adjustment mechanism actuates the first piston assembly between a first position, arranging the internal combustion engine in a high compression ratio and a low power setting configuration, and a second position, arranging the internal combustion engine in a low compression ratio and a high power setting configuration.

56. The internal combustion engine of claim 37, wherein the internal combustion engine is a two-stroke cycle internal combustion engine.

57. An internal combustion engine comprising:

(a) a housing;

(b) a first cylinder disposed within the housing;

(c) a first intake port in fluid communication with the first cylinder;

(d) a first piston assembly disposed within the first cylinder, wherein the first cylinder is adaptable to be reciprocated relative to the first piston assembly, and wherein the first piston assembly is adjustable during operation of the internal combustion engine to selectively impede passage of a gas through the first intake port.

58. The internal combustion engine of claim 57, further comprising a compression ratio adjustment mechanism in communication with the first piston assembly and adaptable to adjust a compression ratio of the internal combustion engine during operation.

59. The internal combustion engine of claim 58, wherein the compression ratio adjustment mechanism communicates with the first piston assembly to adjust a spacing of the first piston assembly from the first cylinder to adjust the compression ratio of the internal combustion engine.

60. The internal combustion engine of claim 57, further comprising:

(a) an exhaust valve in fluid communication with the first cylinder; and (b) a crankshaft coupled to the first cylinder, wherein the crankshaft comprises a lobe for actuating the exhaust valve between an open position and a closed position.

61. The internal combustion engine of claim 58, wherein the compression ratio adjustment mechanism is adaptable to adjust the first piston assembly to selectively impede passage of the gas through the first intake port.

62. The internal combustion engine of claim 57, further comprising:

(a) a second piston assembly coupled to the housing so as to oppose the first piston assembly; and (b) a second cylinder coupled to the first cylinder, wherein the first and second cylinders reciprocate relative to the first and second piston assemblies during operation of the internal combustion engine.

63. The internal combustion engine of claim 62, further comprising:

(a) a third piston assembly coupled to the housing so as to oppose a fourth piston assembly coupled to the housing; and (b) a third cylinder coupled to a fourth cylinder, wherein the third and fourth cylinders reciprocate relative to the third and fourth piston assemblies and reciprocate substantially orthogonally relative to the first and second cylinders during operation of the internal combustion engine.

64. The internal combustion engine of claim 57, further comprising a crankshaft at least partially disposed within the housing and coupled to the first cylinder for transferring energy from the internal combustion engine to a power take-off assembly in communication with the crankshaft.

65. The internal combustion engine of claim 64, further comprising a sliding member that slidingly engages the power take-off assembly and interconnects the power take-off assembly to the crankshaft.

66. The internal combustion engine of claim 65, wherein the crankshaft rotates about a first axis of rotation and a second axis of rotation.

67. The internal combustion engine of claim 57, further comprising a crankshaft at least partially disposed within the housing and coupled to the first cylinder for transferring energy from a component of the internal combustion engine to the reduction system.

68. The internal combustion engine of claim 67, wherein the reduction system adjusts a first rotation rate of the crankshaft to a second rotation rate of an output member of the reduction system.

69. The internal combustion engine of claim 67, wherein the reduction system further comprises a first power transfer device coupled to the crankshaft and a second power transfer device coupled to the output member, wherein the first power transfer device rotates within the second power transfer device.

70. The internal combustion engine of claim 57, further comprising:

(a) an intake chamber; and (b) a gas compression apparatus coupled to the first cylinder, wherein when the first cylinder reciprocates in a first direction, the gas compression apparatus passes through the intake chamber, thereby compressing a gas contained therewithin.

71. The internal combustion engine of claim 70, the first cylinder further comprising a combustion chamber defined by an inner cavity of the first cylinder and the first piston assembly, wherein a maximum volume of the intake chamber is equal to or greater than a maximum volume of the combustion chamber.

72. The internal combustion engine of claim 57, wherein the internal combustion engine is a two-stroke cycle internal combustion engine.

* * * * *